US007069891B2

(12) United States Patent
Mandal et al.

(10) Patent No.: US 7,069,891 B2
(45) **Date of Patent: *Jul. 4, 2006**

(54) VALVE OPERATING ASSEMBLY AND METHOD OF MANUFACTURING

(75) Inventors: Dhruva Mandal, Vernon Hills, IL (US); Carroll D. Williams, Pocahontas, AR (US)

(73) Assignee: MacLean-Fogg Company, Mundelein, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/200,287

(22) Filed: Aug. 9, 2005

(65) Prior Publication Data

US 2005/0268875 A1 Dec. 8, 2005

Related U.S. Application Data

(63) Continuation of application No. 11/119,450, filed on Apr. 29, 2005, now Pat. No. 7,013,857, which is a continuation of application No. 10/992,531, filed on Nov. 18, 2004, now Pat. No. 6,964,251, which is a continuation of application No. 10/274,519, filed on Oct. 18, 2002, now Pat. No. 6,871,622.

(51) Int. Cl.
*F01L 1/18* (2006.01)

(52) U.S. Cl. ..... 123/90.45; 123/90.16; 123/90.44; 74/569

(58) Field of Classification Search ..... 123/90.16, 123/90.27, 90.31, 90.37, 90.39, 90.43, 90.44, 123/90.45, 90.6, 90.61, 90.2, 90.46; 74/569; 403/114, 165; 72/352
See application file for complete search history.

(56) References Cited

U.S. PATENT DOCUMENTS 5,653,651 A * 8/1997 Kawashima et al. ..... 474/110
5,979,377 A * 11/1999 Barth et al. ..... 123/90.12
2005/0252473 A1 * 11/2005 Mandal

OTHER PUBLICATIONS

Print, Aug. 6, 2001.

* cited by examiner

*Primary Examiner*—Thomas Denion
*Assistant Examiner*—Ching Chang
(74) *Attorney, Agent, or Firm*—Dana Andrew Alden

(57) ABSTRACT

The present invention relates to a leakdown plunger, comprising a first plunger opening, a second plunger opening, and an outer plunger surface that is provided with an axis and encloses an inner plunger surface, the first plunger opening is provided with a first annular plunger surface shaped to accommodate a valve insert, the second plunger opening is configured to cooperate with a socket body, the outer plunger surface includes a cylindrical plunger surface and cooperates with an engine workpiece, and the inner plunger surface includes an inner cylindrical plunger surface.

33 Claims, 66 Drawing Sheets

VALVE OPERATING ASSEMBLY AND METHOD OF MANUFACTURING

This application is a continuation of prior application Ser. No. 11/119,450, filed Apr. 29, 2005 now U.S. Pat. No. 7,013,857, which is a continuation prior application Ser. No. 10/992,531, filed Nov. 18, 2004 now U.S. Pat. No. 6,964,251, which is a continuation of prior application Ser. No. 10/274,519, filed Oct. 18, 2002, now U.S. Pat. No. 6,871,622, the disclosures of application Ser. No. 11/119,450, application Ser. No. 10/992,531 and application Ser. No. 10/274,519, now U.S. Pat. No. 6,871,622 are hereby incorporated herein by reference.

FIELD OF THE INVENTION

This invention relates to bodies for leakdown plungers, and particularly to leakdown plungers used in combustion engines.

BACKGROUND OF THE INVENTION

Leakdown plungers are known in the art and are used in camshaft internal combustion engines. Leakdown plungers are used in the opening and closing of valves that regulate fuel and air intake. As noted in U.S. Pat. No. 6,273,039 to Church, the disclosure of which is hereby incorporated herein by reference, such bodies are typically fabricated through casting and machining. Col. 8, ll. 1–3. However, casting and machining is inefficient, resulting in increased labor and decreased production.

The present invention is directed to overcoming this and other disadvantages inherent in prior-art lifter bodies.

SUMMARY OF THE INVENTION

The scope of the present invention is defined solely by the appended claims, and is not affected to any degree by the statements within this summary. Briefly stated, a leakdown plunger, comprising a first plunger opening, a second plunger opening, and an outer plunger surface that is provided with an axis and encloses an inner plunger surface, the first plunger opening is provided with a first annular plunger surface shaped to accommodate a valve insert, the second plunger opening is configured to cooperate with a socket body, the outer plunger surface includes a cylindrical plunger surface and cooperates with an engine workpiece, and the inner plunger surface includes an inner cylindrical plunger surface.

BRIEF DESCRIPTION OF THE DRAWINGS

FIG. 57-*b* depicts the top view of a preferred embodiment of a roller follower body.

DETAILED DESCRIPTION OF THE PRESENTLY PREFERRED EMBODIMENTS

Figure 1:
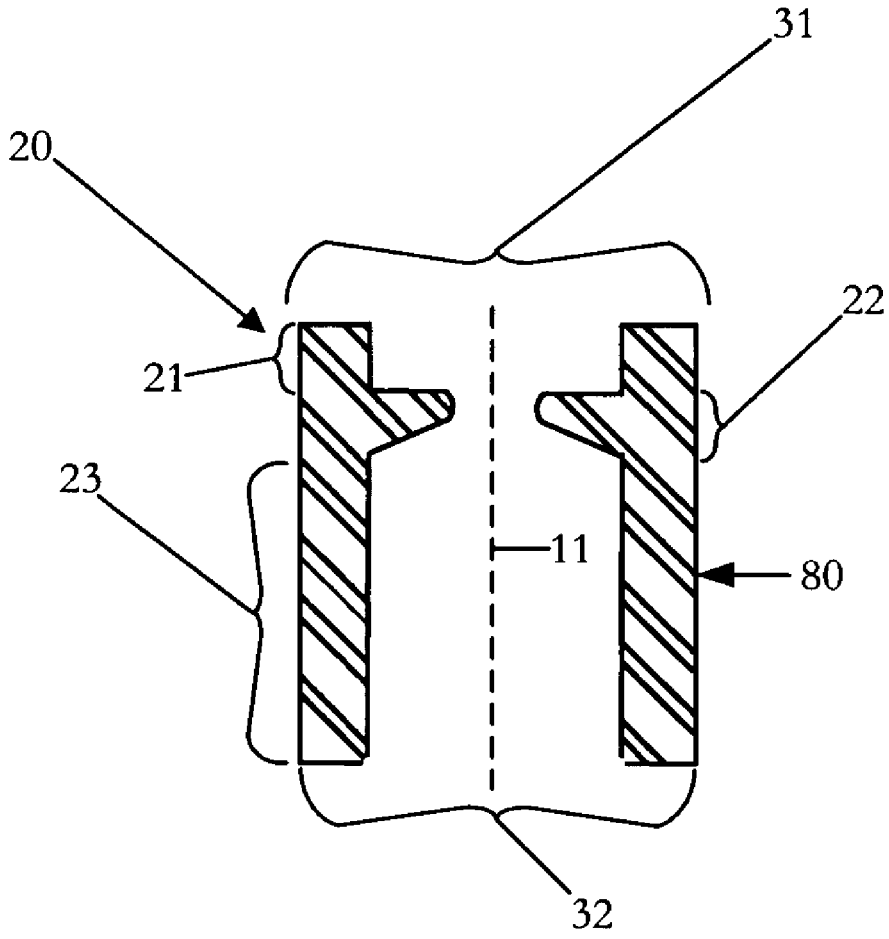
FIG. 1 depicts a preferred embodiment of a leakdown plunger.
Figure 2:
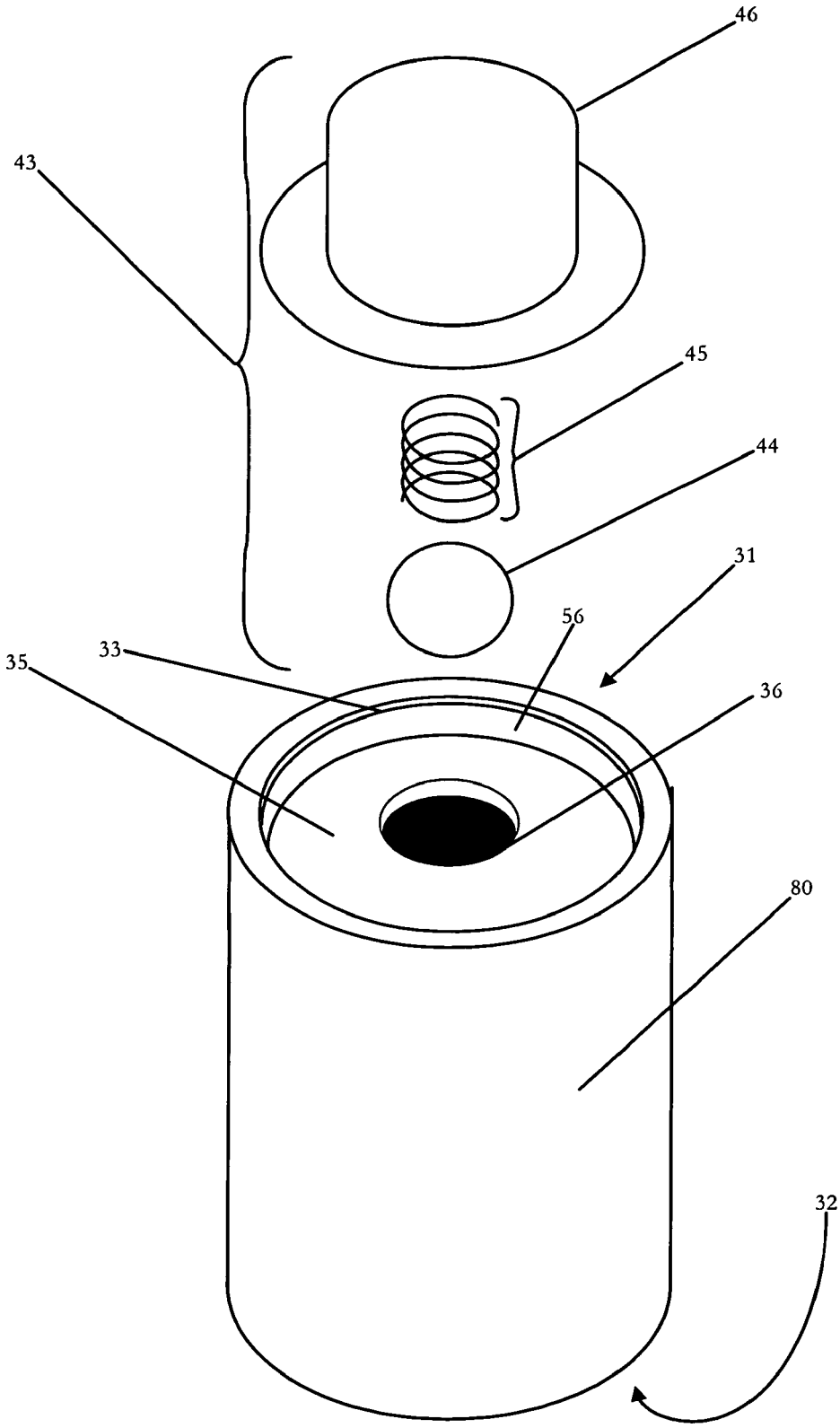
FIG. 2 depicts a preferred embodiment of a leakdown plunger.
Figure 3:
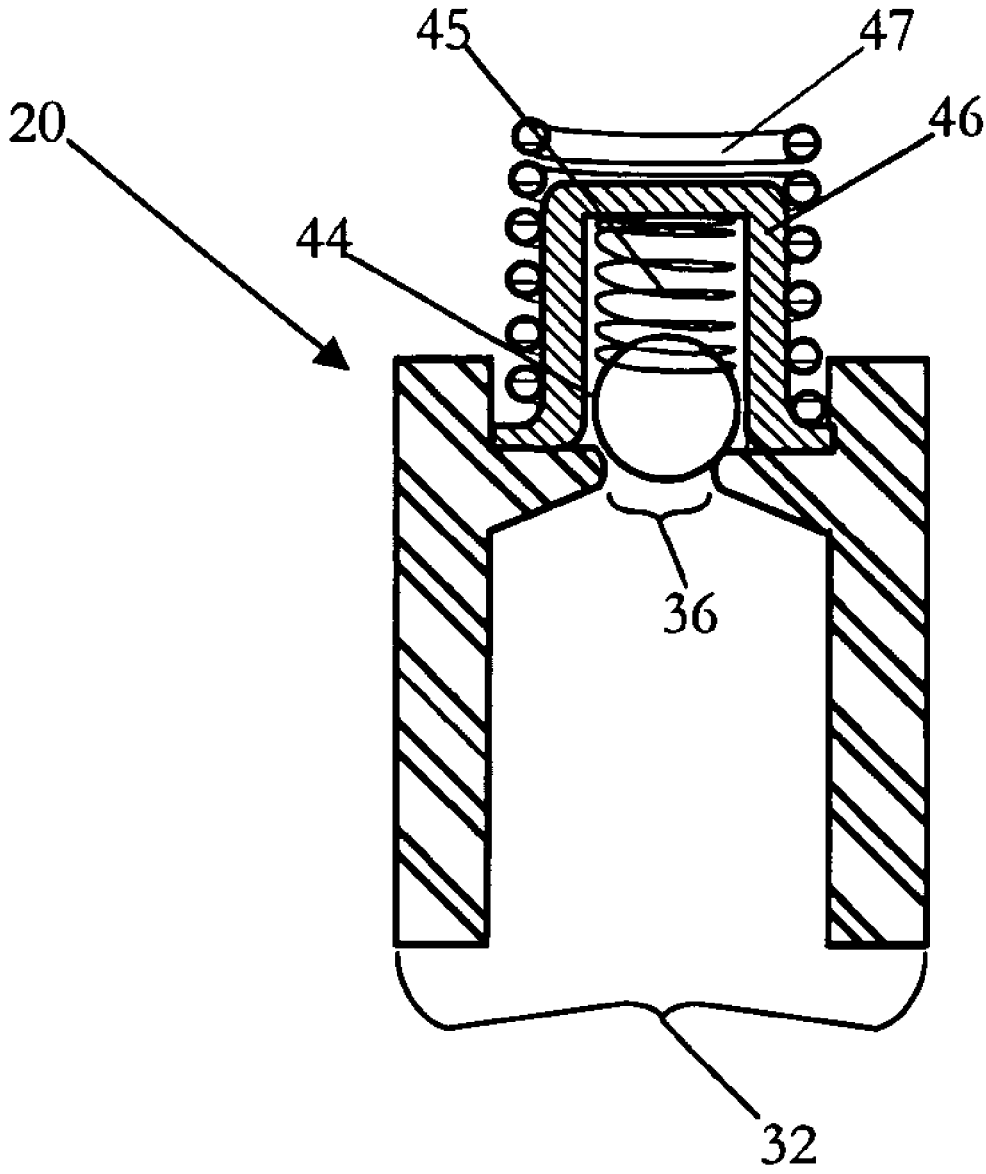
FIG. 3 depicts the cross-sectional view of a preferred embodiment of a leakdown plunger.

Turning now to the drawings, FIGS. 1, 2, and 3 show a preferred embodiment of a leakdown plunger 10. The leakdown plunger 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 10 is composed of pearlitic material. According to still another aspect of the present invention, the leakdown plunger 10 is composed of austenitic material. According to another aspect of the present invention, the metal is a ferritic material.

The body 20 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 1 depicts a cross-sectional view of the leakdown plunger 10 of the preferred embodiment of the present invention composed of a plurality of plunger elements. FIG. 1 shows the body, generally designated 20. The body 20 functions to accept a liquid, such as a lubricant and is provided with a first plunger opening 31 and a second plunger opening 32. The first plunger opening 31 functions to accommodate an insert.

The body 20 of the preferred embodiment is fabricated from a single piece of metal wire or rod and is described herein as a plurality of plunger elements. The body 20 includes a first hollow plunger element 21, a second hollow plunger element 23, and an insert-accommodating plunger element 22. As depicted in FIG. 1, the first hollow plunger element 21 is located adjacent to the insert-accommodating plunger element 22. The insert-accommodating plunger element 22 is located adjacent to the second hollow plunger element 23.

The body 20 is provided with a plurality of outer surfaces and inner surfaces. FIG. 2 depicts the first plunger opening 31 of an alternative embodiment. The first plunger opening 31 of the embodiment depicted in FIG. 2 is advantageously provided with a chamfered plunger surface 33, however a chamfered plunger surface 33 is not necessary. When used herein in relation to a surface, the term "chamfered" shall mean a surface that is rounded or angled.

The first plunger opening 31 depicted in FIG. 2 is configured to accommodate an insert. The first plunger opening 31 is shown in FIG. 2 accommodating a valve insert 43. In the embodiment depicted in FIG. 2, the valve insert 43 is shown in an exploded view and includes a generally spherically shaped member 44, a spring 45, and a cap 46. Those skilled in the art will appreciate that valves other than the valve insert 43 shown herein can be used without departing from the scope and spirit of the present invention.

As shown in FIG. 2, the first plunger opening 31 is provided with an annular plunger surface 35 defining a plunger hole 36. The plunger hole 36 is shaped to accommodate an insert. In the embodiment depicted in FIG. 2, the plunger hole 36 is shaped to accommodate the spherical member 44. The spherical member 44 is configured to operate with the spring 45 and the cap 46. The cap 46 is shaped to at least partially cover the spherical member 44 and the spring 45. The cap 46 is preferably fabricated through stamping. However, the cap may be forged or machined without departing from the scope or spirit of the present invention.

FIG. 3 shows a cross-sectional view of the embodiment depicted in FIG. 2 in a semi-assembled state. In FIG. 3 the valve insert 43 is shown in a semi-assembled state. As depicted in FIG. 3, a cross-sectional view of a cap spring 47 is shown around the cap. Those skilled in the art will appreciate that the cap spring 47 and the cap 46 are configured to be inserted into the well of another body. According to one aspect of the present invention, the cap spring 47 and the cap 46 are configured to be inserted into the well of a lash adjuster, such as the lash adjuster disclosed in Applicant's "Lash Adjuster Body," application Ser. No. 10/316,264 filed on Oct. 18, 2002, the disclosure of which is incorporated herein by reference. In the preferred embodiment, the cap spring 47 and the cap 46 are configured to be inserted into the well 150 of a lash adjuster body 110. According to another aspect of the present invention, the cap spring 47 and the cap 46 are configured to be inserted into the well of a valve lifter, such as the valve lifter disclosed in Applicant's "Valve Lifter Body," application Ser. No. 10/316,263, filed on Oct. 18, 2002, the disclosure of which is incorporated herein by reference. In an alternative embodiment, the cap spring 47 and the cap 46 are configured to be inserted into the lifter well 362 of the valve lifter body 310.

The cap 46 is configured to at least partially depress the spring 45. The spring 45 exerts a force on the spherical member 44. The annular plunger surface 35 is shown with the spherical member 44 partially located within the plunger hole 36.

Figure 4:
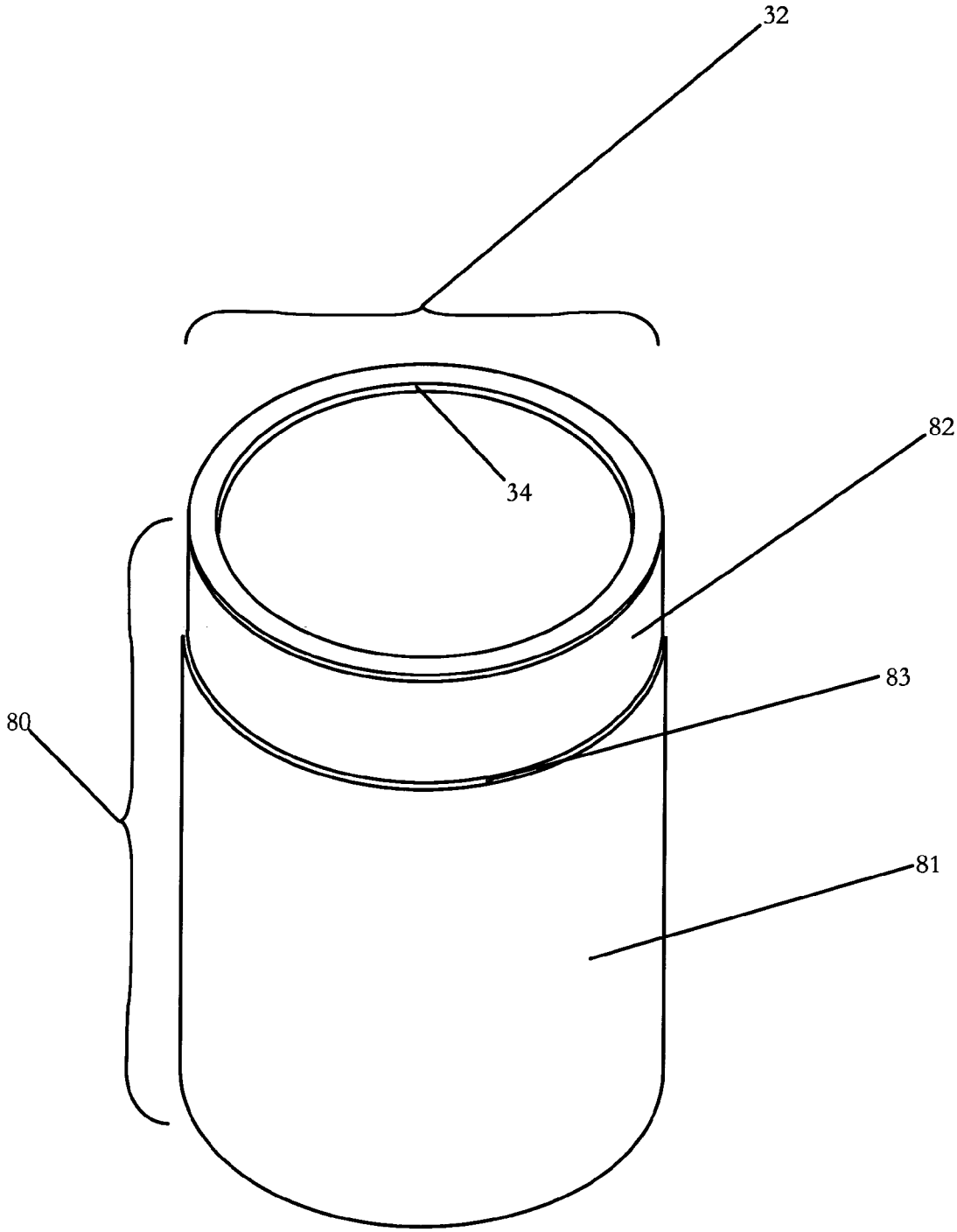
FIG. 4 depicts the top view of another preferred embodiment of a leakdown plunger.
Figure 11:
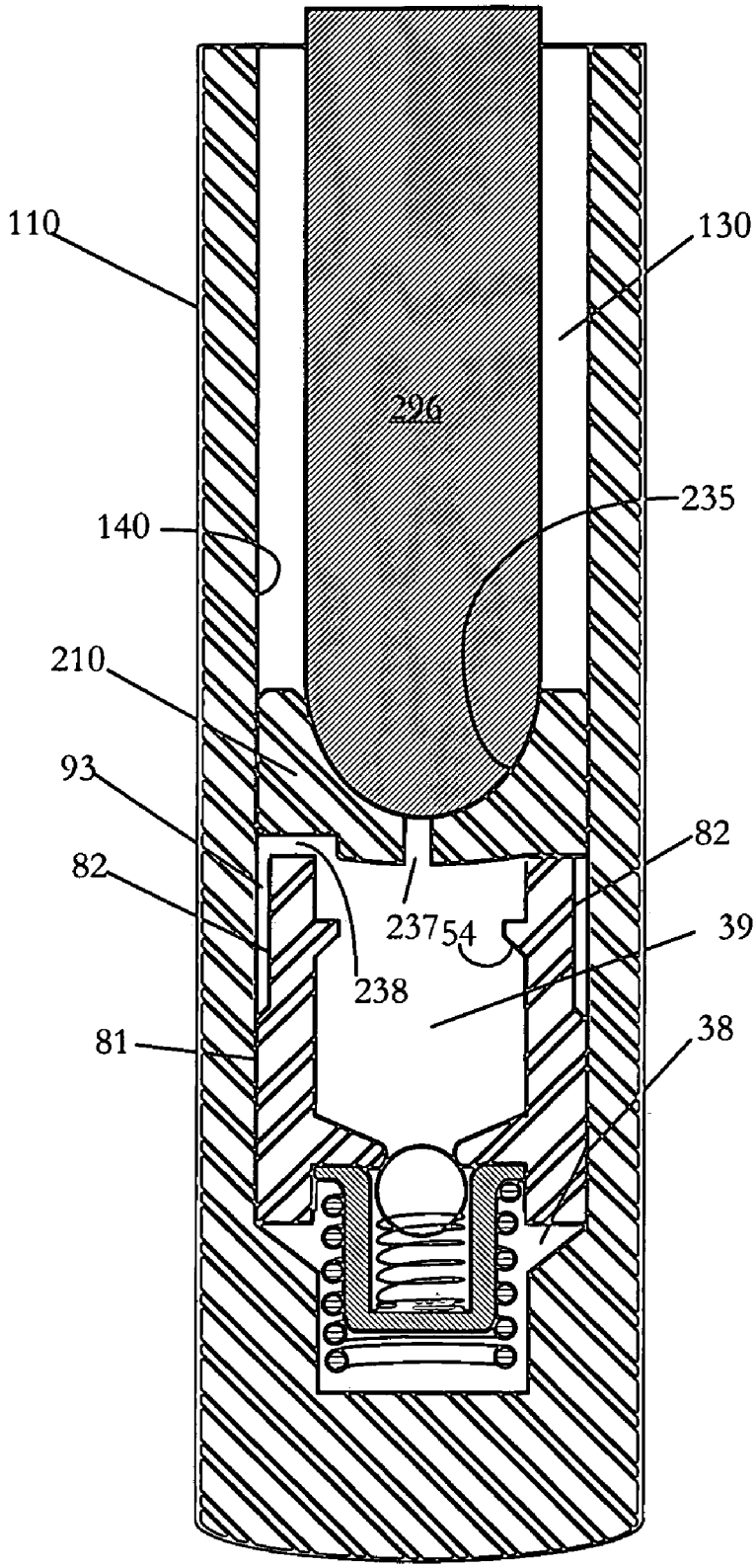
FIG. 11 depicts a sixth embodiment of a leakdown plunger.

Referring now to FIGS. 1 and 2, the embodiment is provided with an outer plunger surface 80 that includes an axis 11. The outer plunger surface 80 is preferably shaped so that the body 20 can be inserted into a lash adjuster body, such as that disclosed in the inventors' patent application entitled "Lash Adjuster Body," application Ser. No. 10/316,264 filed on Oct. 18, 2002. In the preferred embodiment, the outer plunger surface 80 is shaped so that the body 20 can be inserted into the lash adjuster body 110. Depicted in FIG. 11 is a lash adjuster body 110 having an inner lash adjuster surface 140 defining lash adjuster cavity 130. An embodiment of the leakdown plunger 10 is depicted in FIG. 11 within the lash adjuster cavity 130 of the lash adjuster body 110. As shown in FIG. 4, the body 20 of the leakdown plunger 10 is provided with an outer plunger surface 80 that is cylindrically shaped.

FIG. 4 depicts an alternative embodiment of the leakdown plunger 10. FIG. 4 depicts the second plunger opening 32 in greater detail. The second plunger opening 32 is shown with a chamfered plunger surface 34. However, those with skill in the art will appreciate that the second plunger opening 32 may be fabricated without the chamfered plunger surface 34.

The embodiment depicted in FIG. 4 is provided with a plurality of outer surfaces. As shown therein, the embodiment is provided with an outer plunger surface 80. The outer plunger surface 80 includes a plurality of surfaces. FIG. 4 depicts a cylindrical plunger surface 81, an undercut plunger surface 82, and a conical plunger surface 83. As depicted in FIG. 4, the undercut plunger surface 82 extends from one end of the body 20 and is cylindrically shaped. The diameter of the undercut plunger surface 82 is smaller than the diameter of the cylindrical plunger surface 81.

The undercut plunger surface 82 is preferably forged through use of an extruding die. Alternatively, the undercut plunger surface 82 is fabricated through machining. Machining the undercut plunger surface 82 is accomplished through use of an infeed centerless grinding machine, such as a Cincinnati grinder. The surface is first heat-treated and then the undercut plunger surface 82 is ground via a grinding wheel. Those skilled in the art will appreciate that additional surfaces can be ground into the outer surface with minor alterations to the grinding wheel.

Referring again to FIG. 4, the conical plunger surface 83 is located between the cylindrical plunger surface 81 and the undercut plunger surface 82. Those with skill in the art will appreciate that the outer plunger surface 80 can be fabricated without the conical plunger surface 83 so that the cylindrical plunger surface 81 and the undercut plunger surface 82 abut one another.

Figure 6:
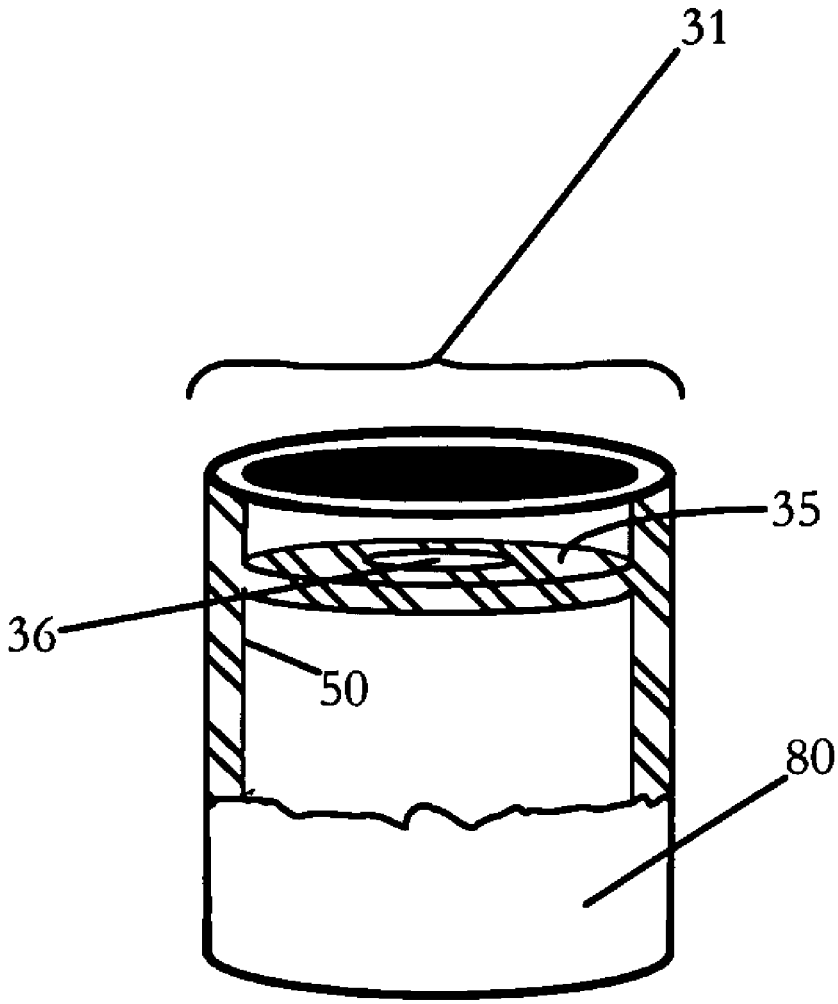
FIG. 6 depicts a third embodiment of a leakdown plunger.

FIG. 6 depicts an embodiment of the present invention with a section of the outer plunger surface 80 broken away. The embodiment depicted in FIG. 6 is provided with a first plunger opening 31. As shown in FIG. 6, the outer plunger surface 80 encloses an inner plunger surface 50. The inner plunger surface 50 includes a first annular plunger surface 35 that defines a first plunger hole 36 and a second annular plunger surface 37 that defines a second plunger hole 49.

Figure 7:
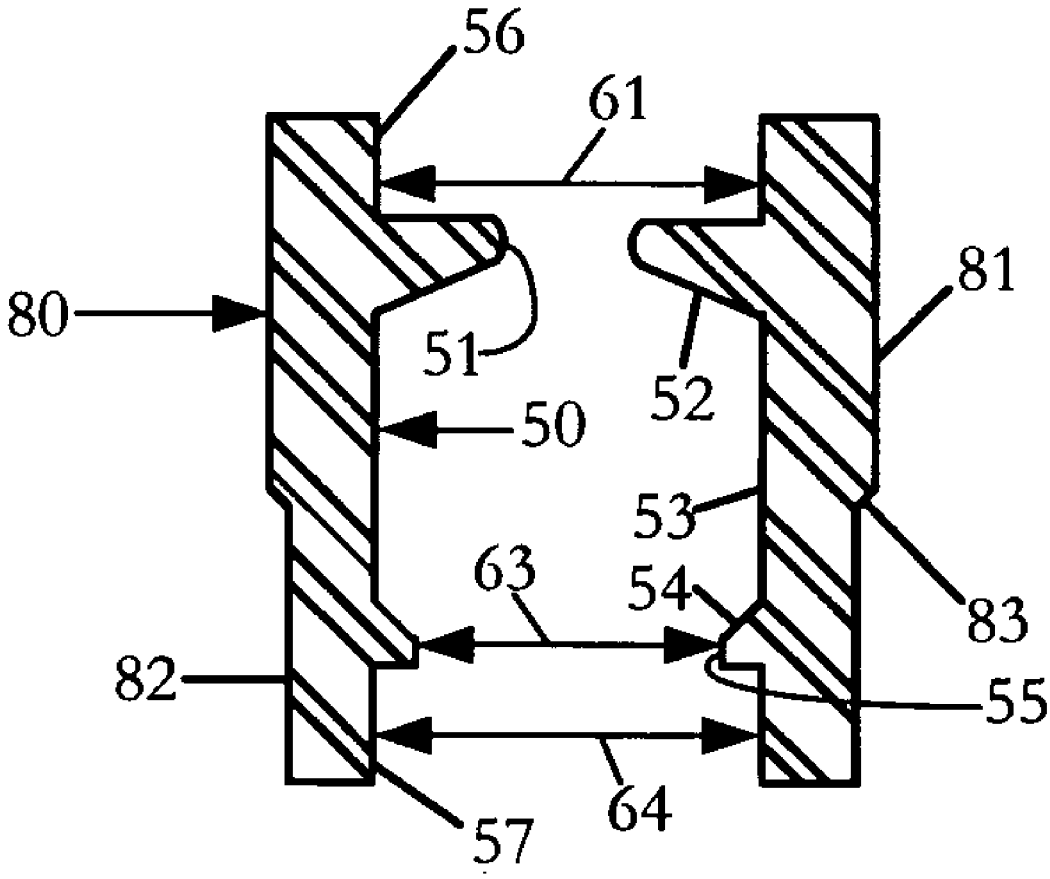
FIG. 7 depicts a fourth embodiment of a leakdown plunger.

FIG. 7 depicts a cross-sectional view of an alternative embodiment of the leakdown plunger 10. The body 20 shown in FIG. 7 is provided with an outer plunger surface 80 that includes a plurality of cylindrical and conical surfaces. In the embodiment depicted in FIG. 7, the outer plunger surface 80 includes an outer cylindrical plunger surface 81, an undercut plunger surface 82, and an outer conical plunger surface 83. As depicted in FIG. 7, the undercut plunger surface 82 extends from one end of the body 20 and is cylindrically shaped. The diameter of the undercut plunger surface 82 is smaller than, and preferably concentric relative to, the diameter of the outer cylindrical plunger surface 81. The outer conical plunger surface 83 is located between the outer cylindrical plunger surface 81 and the undercut plunger surface 82. Those with skill in the art will appreciate that the outer plunger surface 80 can be fabricated without the conical plunger surface 83 so that the outer cylindrical plunger surface 81 and the undercut plunger surface 82 abut one another.

Figure 8:
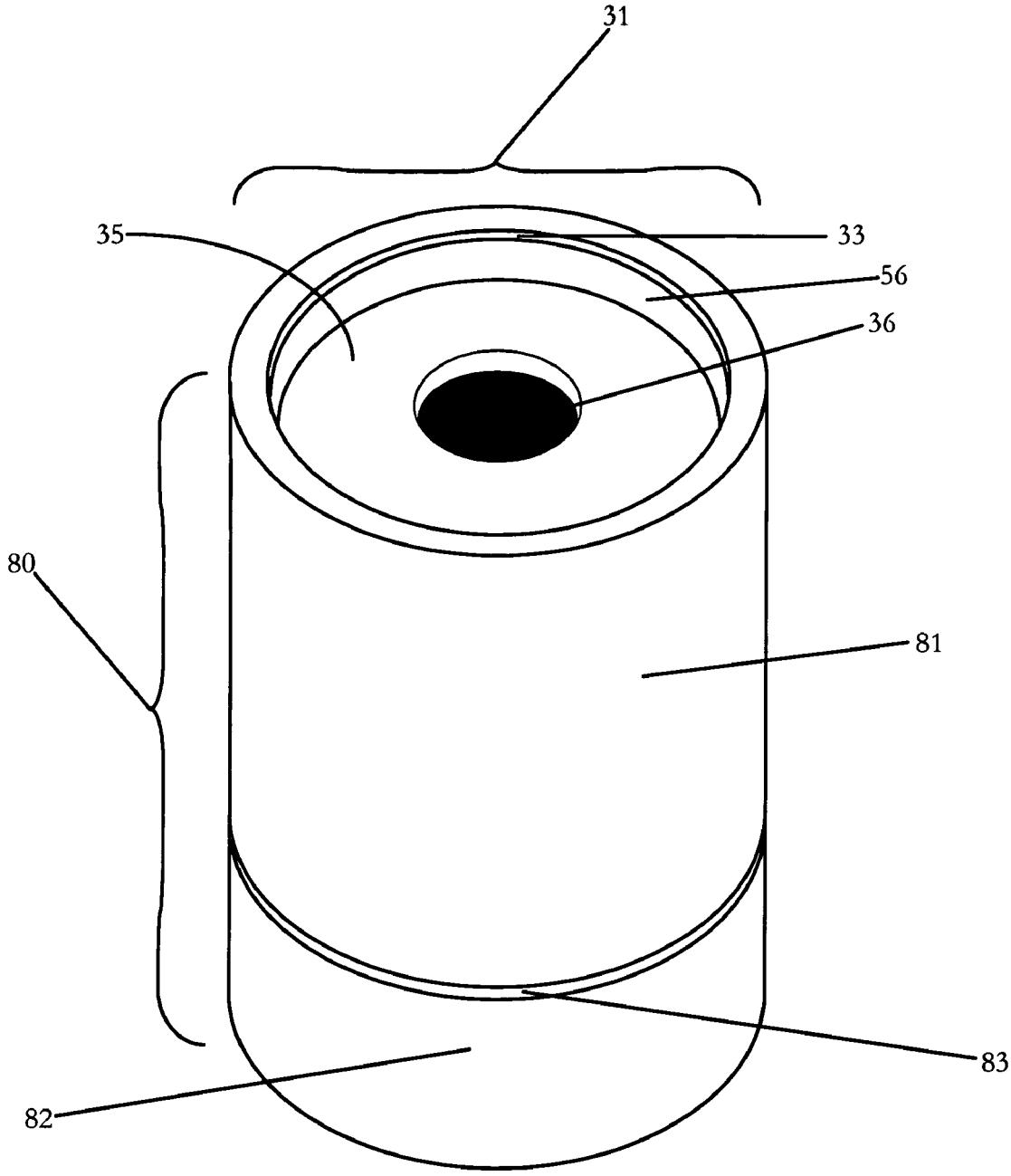
FIG. 8 depicts a fifth embodiment of a leakdown plunger.

FIG. 8 depicts in greater detail the first plunger opening 31 of the embodiment depicted in FIG. 7. The first plunger opening 31 is configured to accommodate an insert and is preferably provided with a first chamfered plunger surface 33. Those skilled in the art, however, will appreciate that the first chamfered plunger surface 33 is not necessary. As further shown in FIG. 8, the first plunger opening 31 is provided with a first annular plunger surface 35 defining a plunger hole 36.

The embodiment depicted in FIG. 8 is provided with an outer plunger surface 80 that includes a plurality of surfaces. The outer plunger surface 80 includes a cylindrical plunger surface 81, an undercut plunger surface 82, and a conical plunger surface 83. As depicted in FIG. 8, the undercut plunger surface 82 extends from one end of the body 20 and is cylindrically shaped. The diameter of the undercut plunger surface 82 is smaller than the diameter of the cylindrical plunger surface 81. The conical plunger surface 83 is located between the cylindrical plunger surface 81 and the undercut plunger surface 82. However, those with skill in the art will appreciate that the outer plunger surface 80 can be fabricated without the conical plunger surface 83 so that the cylindrical plunger surface 81 and the undercut plunger surface 82 abut one another. Alternatively, the cylindrical plunger surface 81 may abut the undercut plunger surface 82 so that the conical plunger surface 83 is an annular surface.

Figure 9:
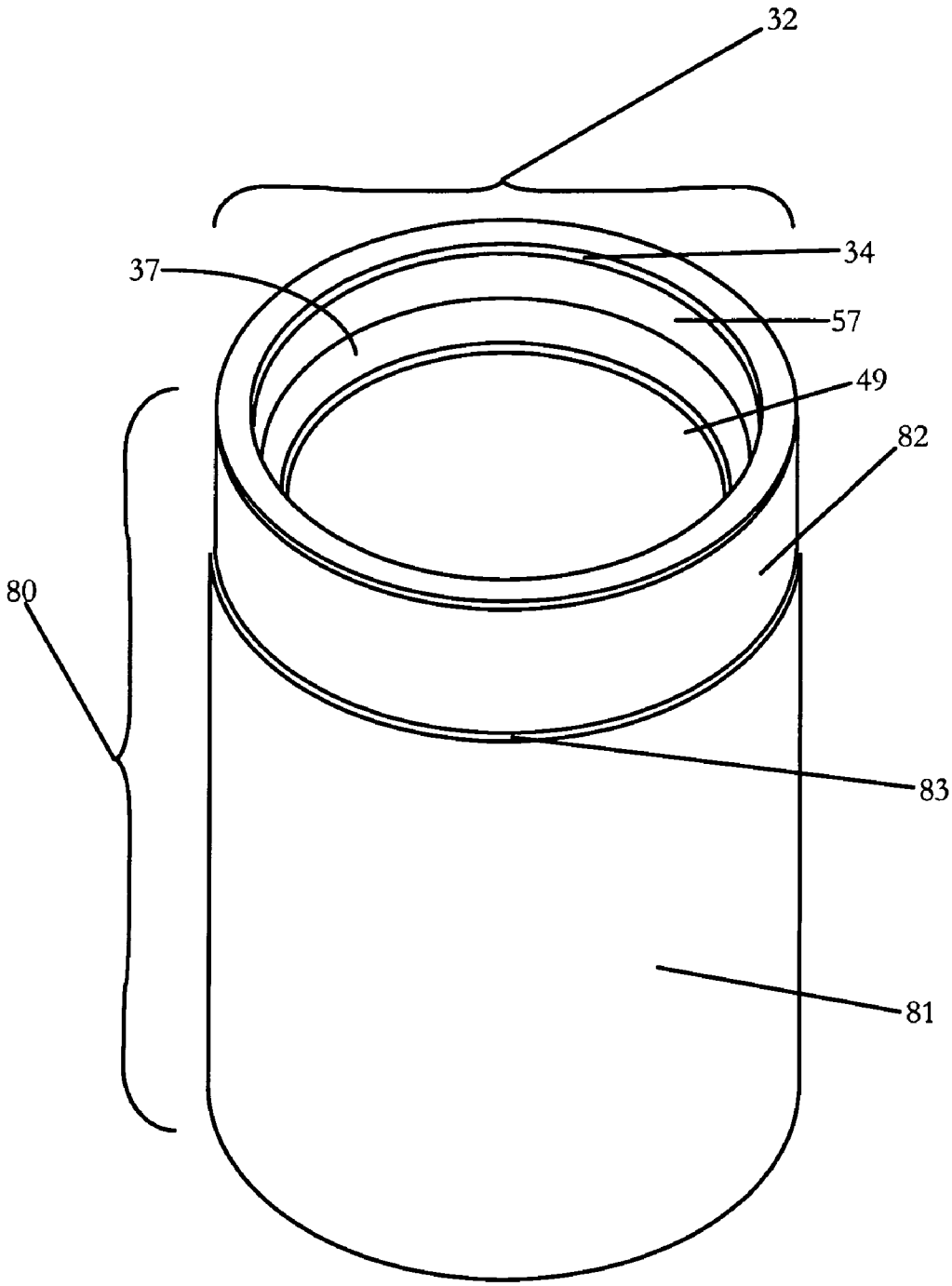
FIG. 9 depicts a perspective view of another preferred embodiment of a leakdown plunger.

FIG. 9 depicts the second plunger opening 32 of the embodiment depicted in FIG. 7. The second plunger opening 32 is shown with a second chamfered plunger surface 34. However, those with skill in the art will appreciate that the second plunger opening 32 may be fabricated without the second chamfered plunger surface 34. The second plunger opening 32 is provided with a second annular plunger surface 37.

Figure 10:
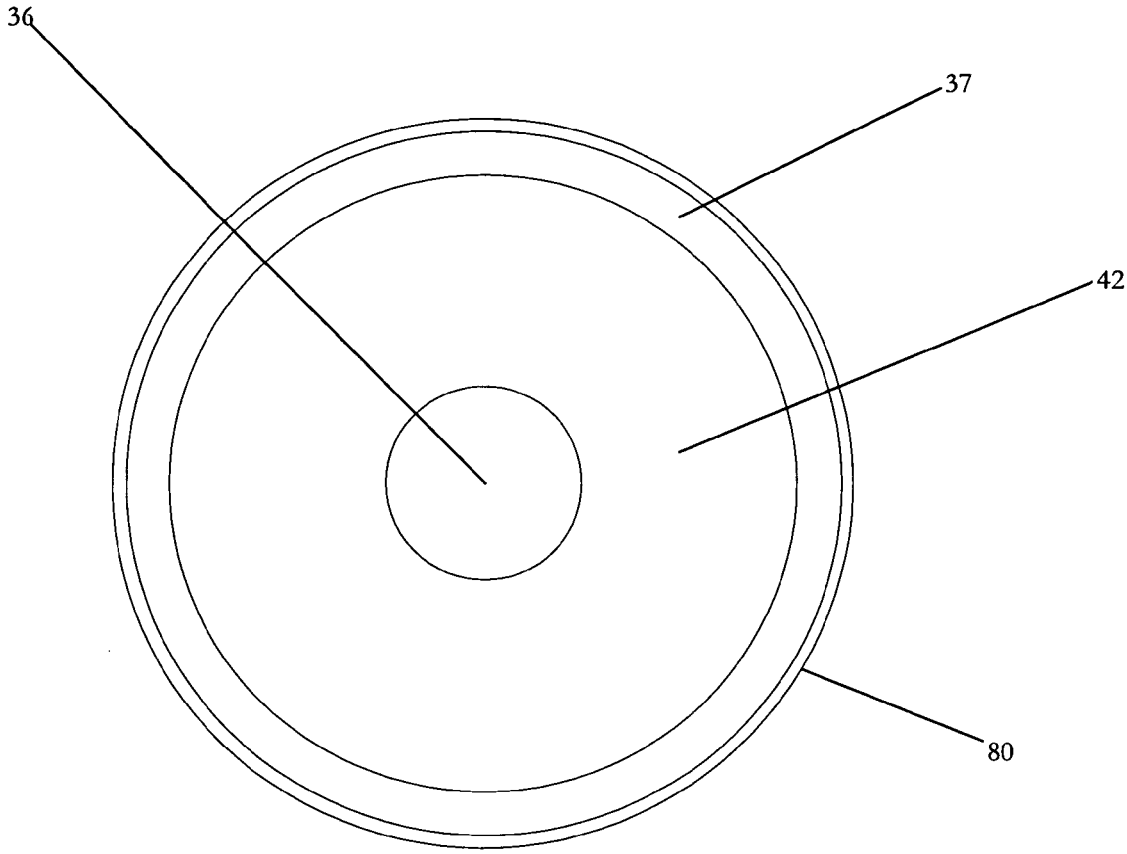
FIG. 10 depicts the top view of another preferred embodiment of a leakdown plunger.

FIG. 10 depicts a top view of the second plunger opening 32 of the embodiment depicted in FIG. 7. In FIG. 10, the second annular plunger surface 37 is shown in relation to the first conical plunger surface 42 and the plunger hole 36. As shown in FIG. 10, the plunger hole 36 is concentric relative to the outer plunger surface 80 and the annulus formed by the second annular plunger surface 37.

Figure 5:
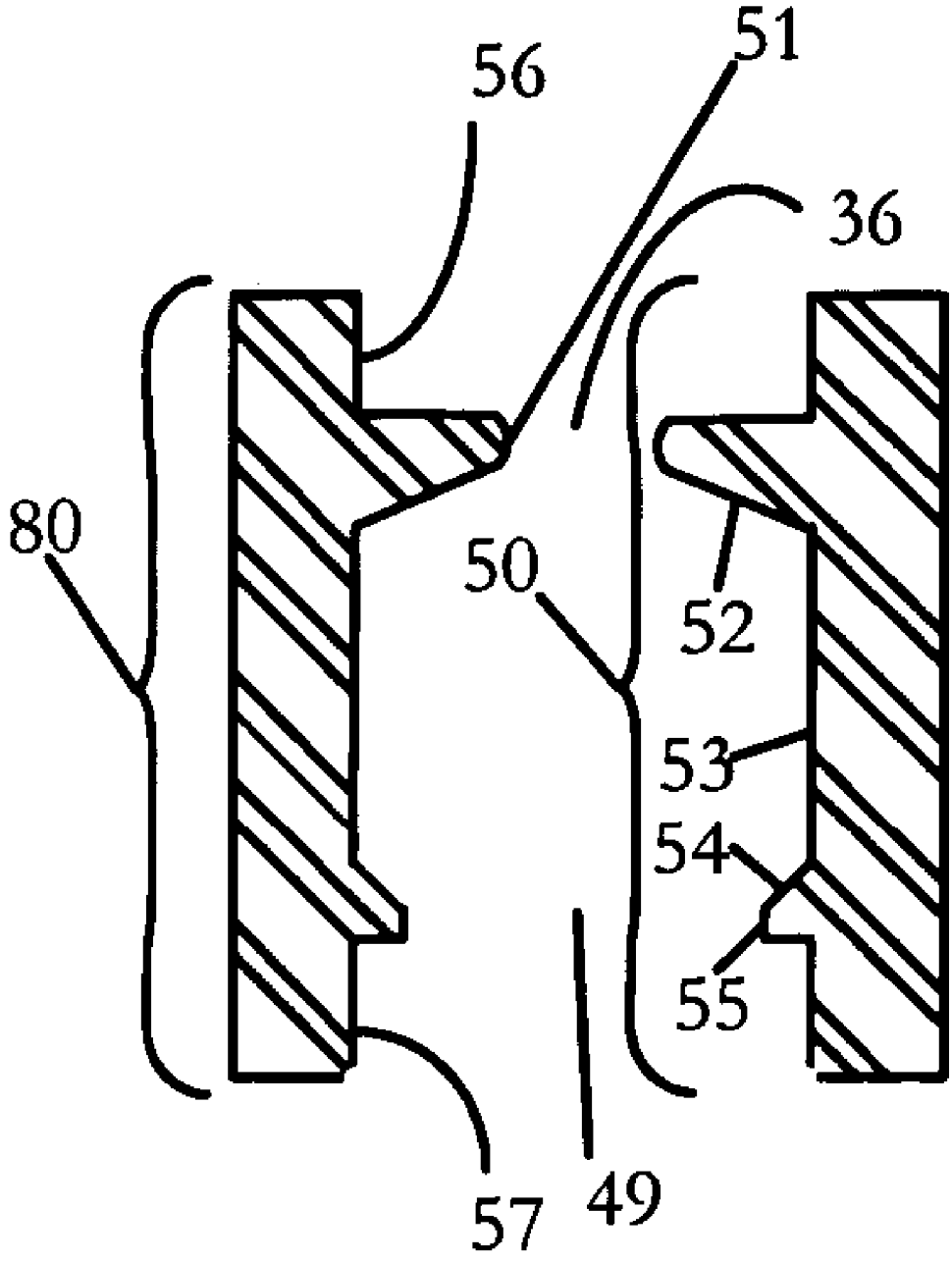
FIG. 5 depicts a second embodiment of a leakdown plunger.

Referring now to FIG. 5, the outer plunger surface 80 encloses an inner plunger surface 50. The inner plunger surface 50 includes a plurality of surfaces. In the alternative embodiment depicted in FIG. 5, the inner plunger surface 50 includes first inner cylindrical surface 56. The first inner cylindrical surface is located adjacent to the first annular plunger surface 35. The first annular plunger surface is located adjacent to a rounded plunger surface 51 that defines a plunger hole 36. Those skilled in the art will appreciate that the rounded plunger surface 51 need not be rounded, but may be flat. The rounded plunger surface 51 is located adjacent to a first inner frusto-conical plunger surface 52, which is located adjacent to a second inner cylindrical surface 53. The second inner cylindrical surface is located adjacent to a second inner conical plunger surface 54, which is located adjacent to a third inner cylindrical surface 55. The third inner cylindrical surface 55 is located adjacent to the second annular plunger surface 37, which is located adjacent to a fourth inner cylindrical surface 57.

The inner plunger surface 50 includes a plurality of diameters. As shown in FIG. 7, the first inner cylindrical surface 56 is provided with a first inner diameter 61, the third inner cylindrical surface 55 is provided with a third inner diameter 63, and the fourth cylindrical surface 57 is provided with a fourth inner diameter 64. In the embodiment depicted, the third inner diameter 63 is smaller than the fourth inner diameter 64.

FIG. 11 depicts an embodiment of the present invention within another body cooperating with a plurality of inserts. The undercut plunger surface 82 preferably cooperates with another body, such as a lash adjuster body or a valve lifter, to form a cavity 93. FIG. 11 depicts an embodiment of the present invention within a lash adjuster body 110; however, those skilled in the art will appreciate that the present invention may be inserted within other bodies, such as roller followers, and valve lifters.

As shown in FIG. 11, the undercut plunger surface 82 is configured to cooperate with the inner lash adjuster surface 140 of a lash adjuster body 110. The undercut plunger surface 82 and the inner lash adjuster surface 140 of the lash adjuster body 110 cooperate to define a cavity 93 that acts as a leakdown path for a liquid such as a lubricant.

The embodiment depicted in FIG. 11 is further provided with a cylindrical plunger surface 81. The cylindrical plunger surface 81 cooperates with the inner lash adjuster surface 140 of the lash adjuster body 110 to provide a first chamber 38. Those skilled in the art will appreciate that the first chamber 38 functions as a high pressure chamber for a liquid, such as a lubricant.

The second plunger opening 32 is configured to cooperate with a socket, such as the socket 210. The socket 210 is configured to cooperate with a push rod 296. In the embodiment depicted in FIG. 11, the socket 210 preferably functions as a socket, such as that disclosed in Applicants' "Metering Socket," application Ser. No. 10/316,262, filed on Oct. 18, 2002, the disclosure of which is incorporated herein by reference. As shown in FIG. 11, the socket 210 is provided with a push rod cooperating surface 295. The push rod cooperating surface 295 is configured to function with a push rod 296. Those skilled in the art will appreciate that the push rod 296 cooperates with the rocker arm (not shown) of an internal combustion engine (not shown).

The socket 210 cooperates with the body 20 of the leakdown plunger 10 to define at least in part a second chamber 39 within the inner plunger surface 50. Those skilled in the art will appreciate that the second chamber 39 may advantageously function as a reservoir for a lubricant. The inner plunger surface 50 of the body 20 functions to increase the quantity of retained fluid in the second chamber 39 through the damming action of the second inner conical plunger surface 54.

The socket 210 is provided with a plurality of passages that function to fluidly communicate with the lash adjuster cavity 130 of the lash adjuster body 110. In the embodiment depicted in FIG. 11, the socket 210 is provided with a socket passage 237 and a plunger reservoir passage 238. The plunger reservoir passage 238 functions to fluidly connect the second chamber 39 with the cavity 130 of the lash adjuster body 110. As shown in FIG. 11, the socket passage 237 functions to fluidly connect the socket 210 and the cavity 130 of the lash adjuster body 110.

FIG. 12 to 16 illustrate the presently preferred method of fabricating a leakdown plunger. FIG. 12 to 16 depict what is known in the art as "slug progressions" that show the fabrication of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 10 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 12:
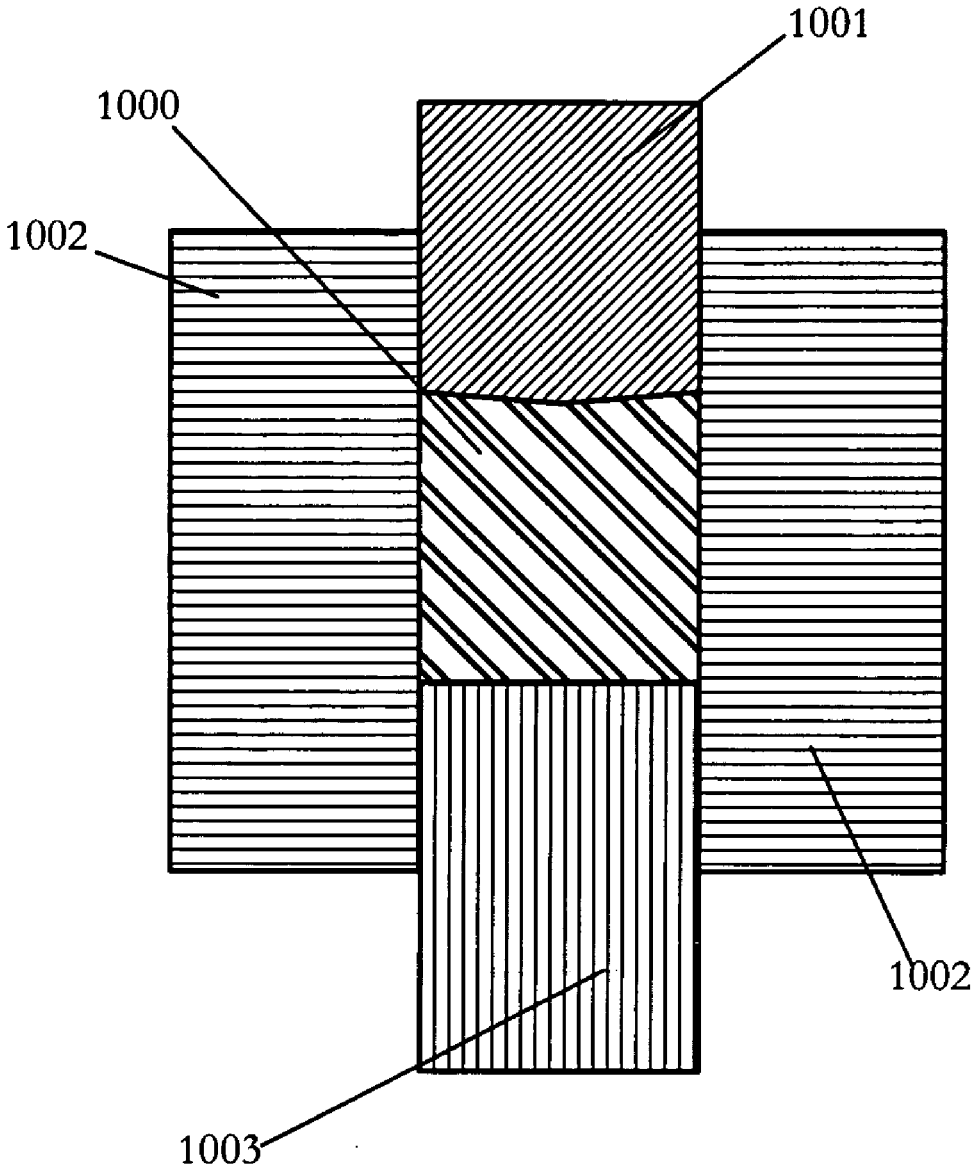
FIG. 12-16 depict a preferred method of fabricating a leakdown plunger.

The process of forging an embodiment of the present invention begins with a metal wire or metal rod 1000 which is drawn to size. The ends of the wire or rod are squared off. As shown in FIG. 12, this is accomplished through the use of a first punch 1001, a first die 1002, and a first knock out pin 1003.

Figure 13:
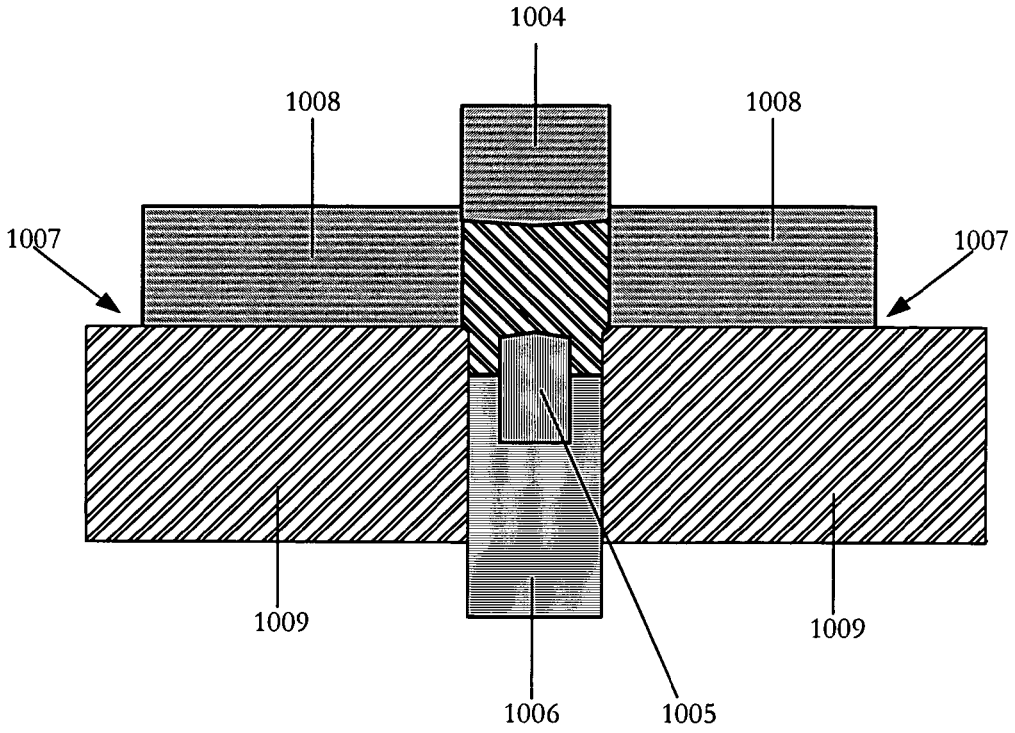

After being drawn to size, the wire or rod 1000 is run through a series of dies or extrusions. As depicted in FIG. 13, the fabrication of the second plunger opening 32 and the outer plunger surface 80 is preferably commenced through use of a second punch 1004, a second knock out pin 1005, a first sleeve 1006, and a second die 1007. The second plunger opening 32 is fabricated through use of the second knock out pin 1005 and the first sleeve 1006. The second die 1007 is used to fabricate the outer plunger surface 80. As shown in FIG. 13, the second die 1007 is composed of a second die top 1008 and a second die rear 1009. In the preferred forging process, the second die rear 1009 is used to form the undercut plunger surface 82 and the conical plunger surface 83.

Figure 14:
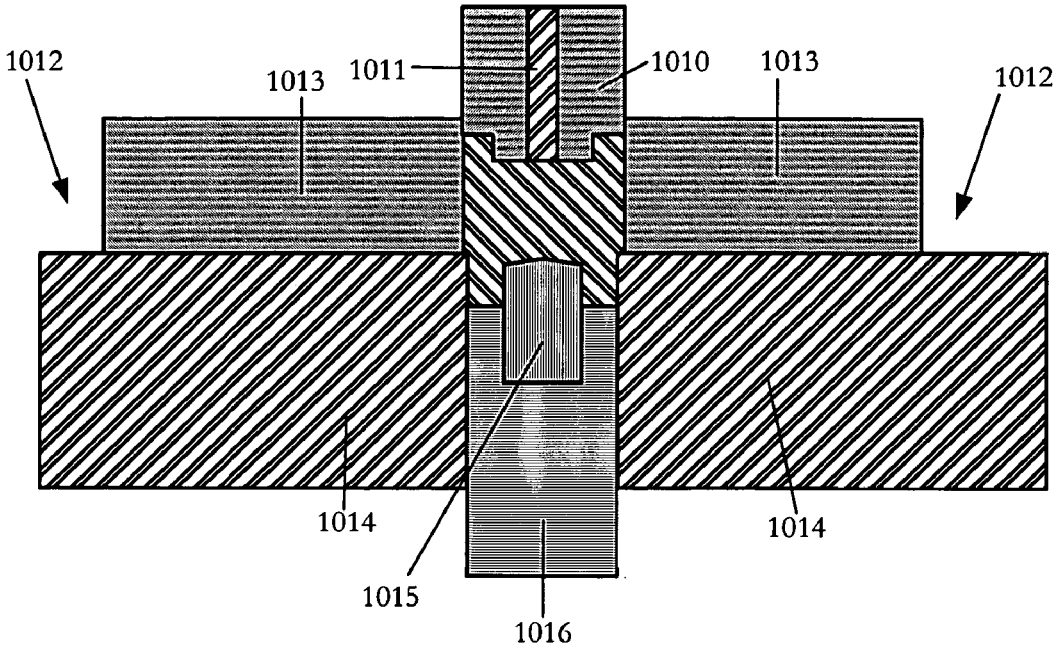

As depicted in FIG. 14, the first plunger opening 31 is fabricated through use of a third punch 1010. Within the third punch 1010 is a first pin 1011. The third punch 1010 and the first pin 1011 are used to fabricate at least a portion of the annular plunger surface 35. As shown in FIG. 14, it is desirable to preserve the integrity of the outer plunger surface 80 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second plunger opening 32.

Figure 15:
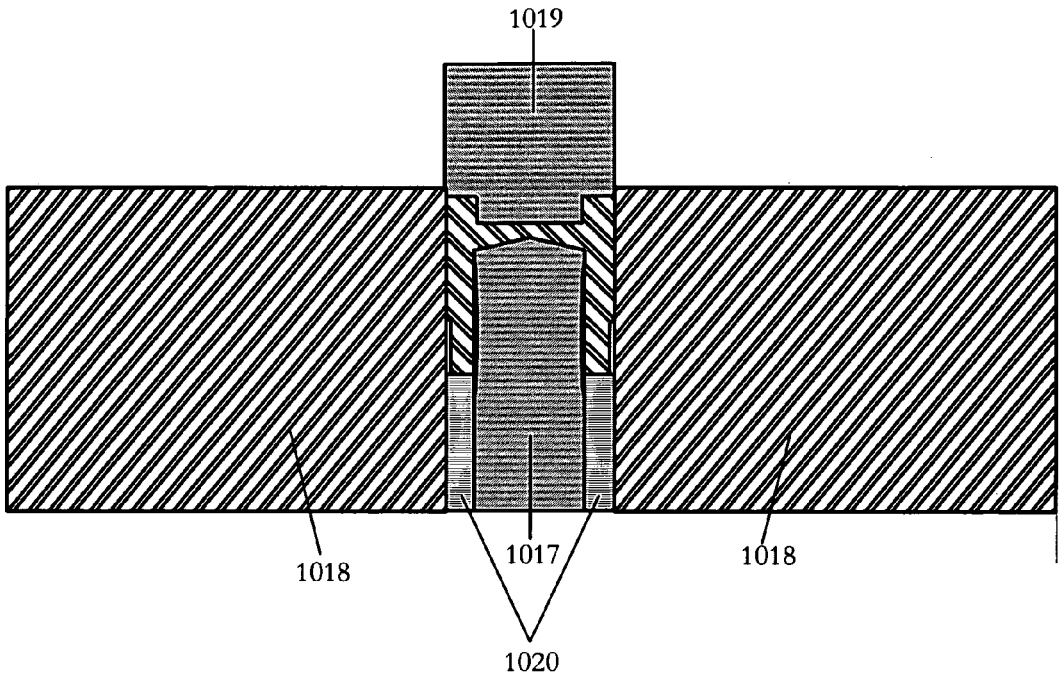

FIG. 15 depicts the forging of the inner plunger surface 50. As depicted, the inner plunger surface 50 is forged through use of a punch extrusion pin 1017. Those skilled in the art will appreciate that it is advantageous to preserve the integrity of the first plunger opening 31 and the outer plunger surface 80. This function is accomplished through use of a fourth die 1018 and a fourth knock out pin 1019. A punch stripper sleeve 1020 is used to remove the punch extrusion pin 1017 from the inner plunger surface 50.

Figure 16:
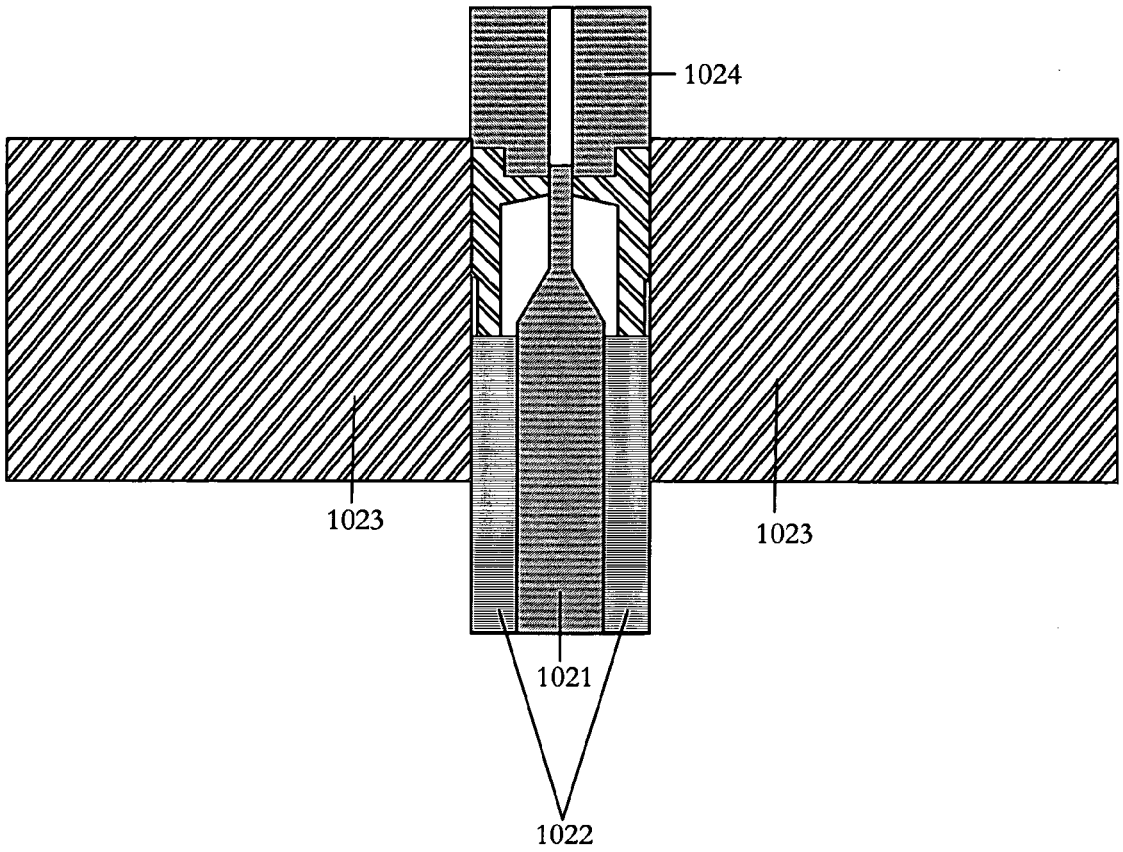

As shown in FIG. 16, the plunger hole 36 is fabricated through use of a piercing punch 1021 and a stripper sleeve 1022. To assure that other forging operations are not affected during the fabrication of the plunger hole 36, a fifth die 1023 is used around the outer plunger surface 80 and a tool insert 1024 is used at the first opening 31.

Figure 17:
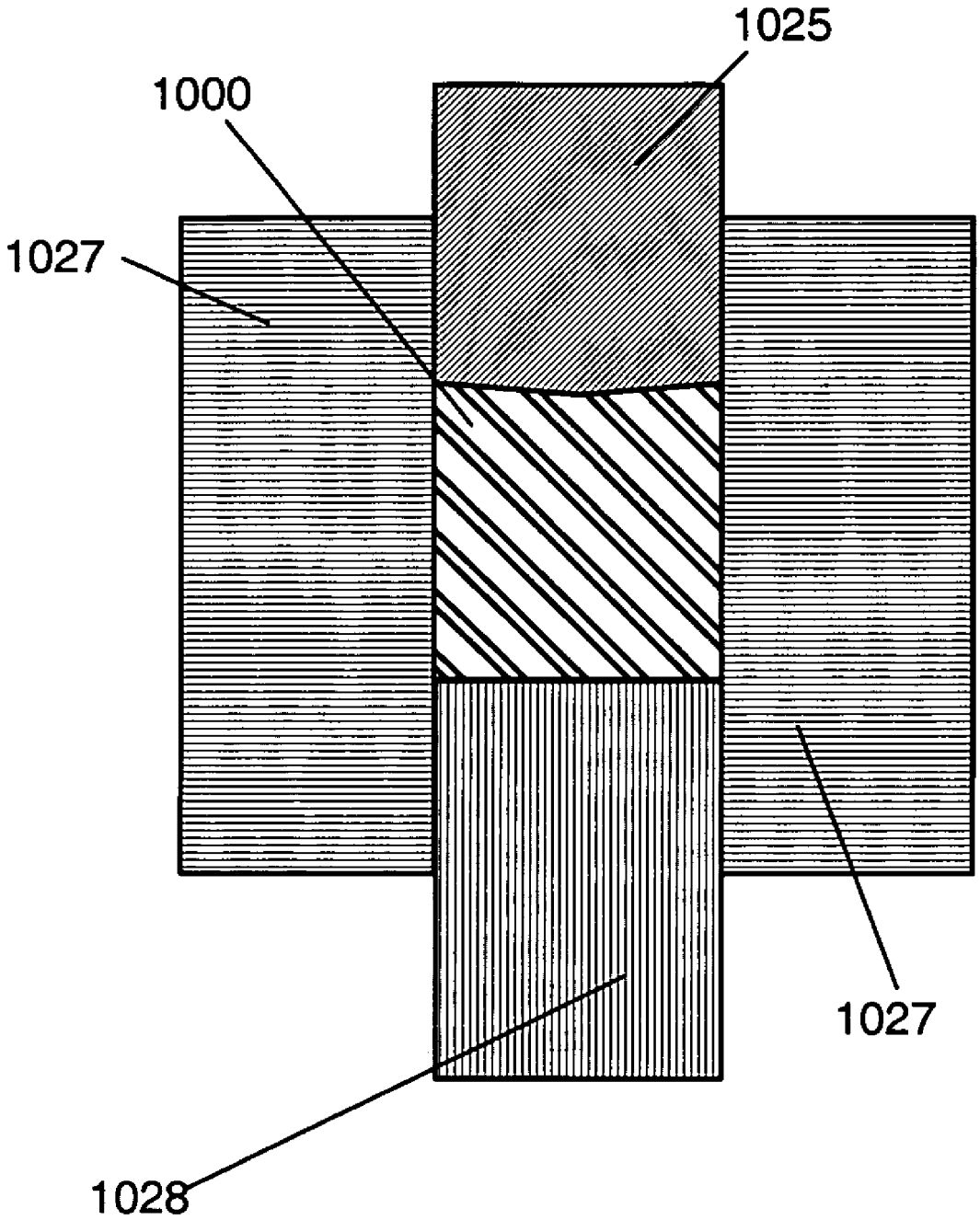
FIG. 17-21 depict an alternative method of fabricating a leakdown plunger.

FIG. 17 to 21 illustrate an alternative method of fabricating a leakdown plunger. FIG. 17 depicts a metal wire or metal rod 1000 drawn to size. The ends of the wire or rod 1000 are squared off through the use of a first punch 1025, a first die 1027, and a first knock out pin 1028.

Figure 18:
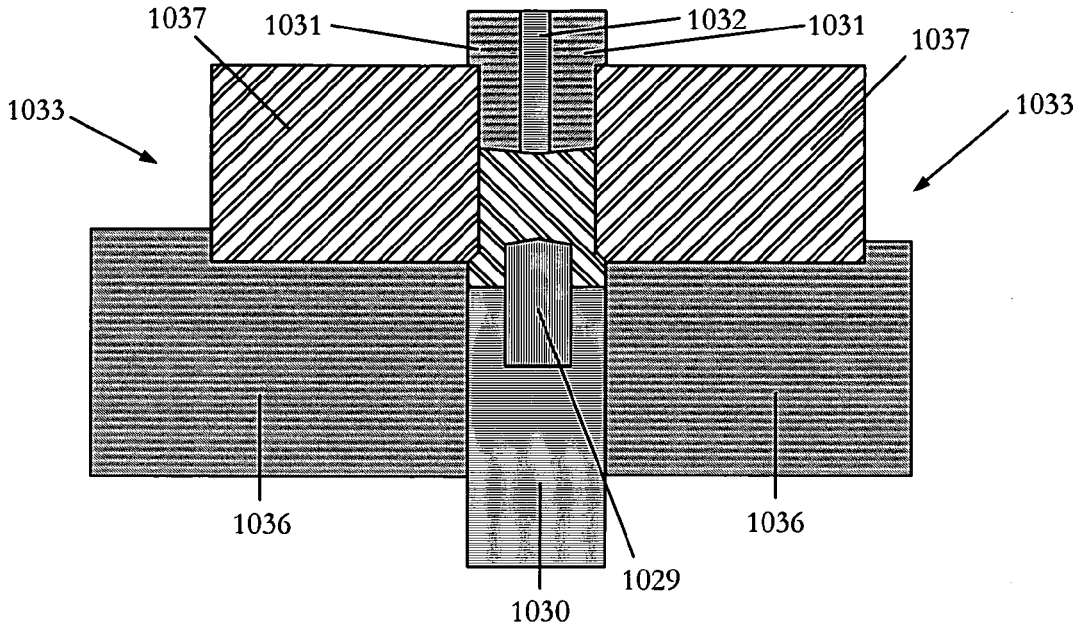

As depicted in FIG. 18, the fabrication of the first plunger opening 31, the second plunger opening 32, and the outer plunger surface 80 is preferably commenced through use of a punch pin 1029, a first punch stripper sleeve 1030, second knock out pin 1031, a stripper pin 1032, and a second die 1033. The first opening 31 is fabricated through use of the second knock out pin 1031. The stripper pin 1032 is used to remove the second knock out pin 1031 from the first plunger opening 31.

The second plunger opening 32 is fabricated, at least in part, through the use of the punch pin 1029. A first punch stripper sleeve 1030 is used to remove the punch pin 1029 from the second plunger opening 32. The outer plunger surface 80 is fabricated, at least in part, through the use of a second die 1033. The second die 1033 is composed of a second die top 1036 and a second die rear 1037.

Figure 19:
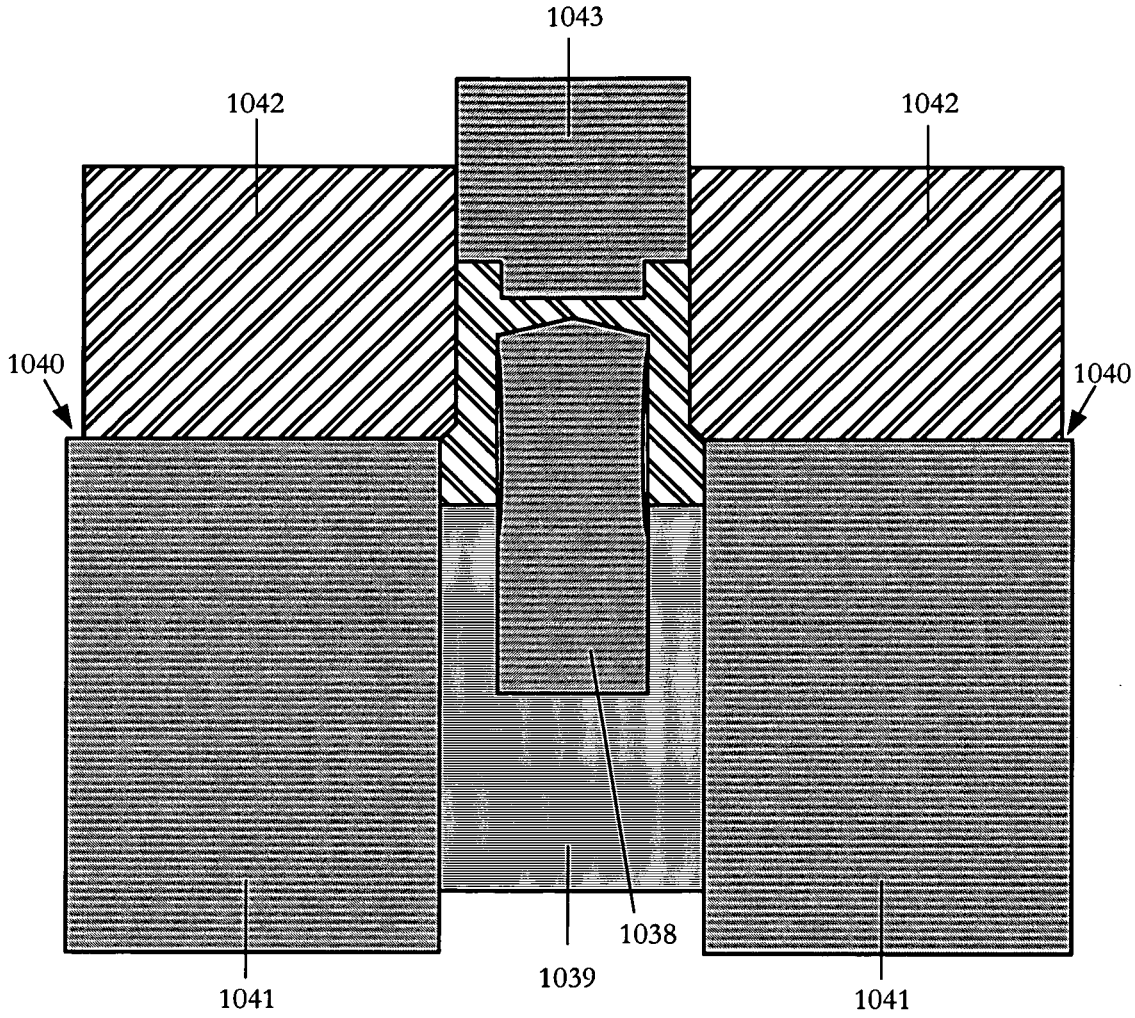

FIG. 19 depicts the forging of the inner plunger surface 50. As depicted, the inner plunger surface 50 is forged through the use of an extrusion punch 1038. A second punch stripper sleeve 1039 is used to remove the extrusion punch 1038 from the inner plunger surface 50.

Those skilled in the art will appreciate that it is advantageous to preserve the previous forging of the first plunger opening 31 and the outer plunger surface 80. A third knock out pin 1043 is used to preserve the previous forging operations on the first plunger opening 31. A third die 1040 is used to preserve the previous forging operations on the outer plunger surface 80. As depicted in FIG. 19, the third die 1040 is composed of a third die top 1041 and a third die rear 1042.

Figure 20:
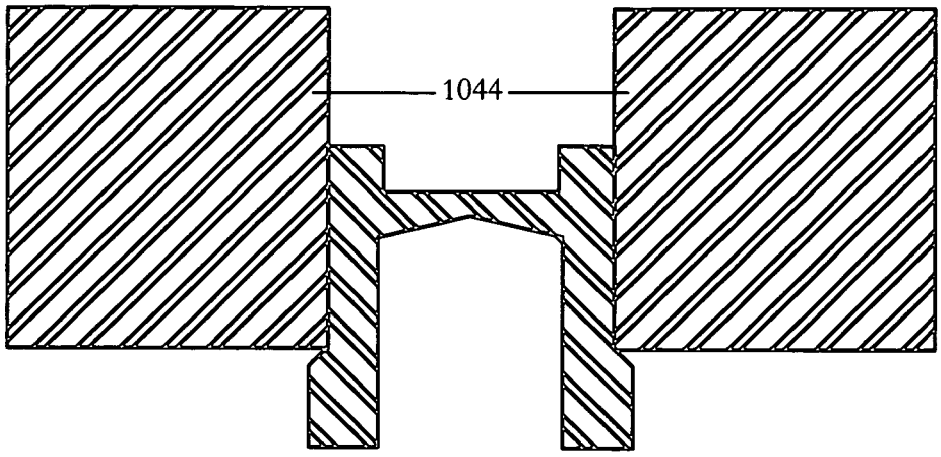

As depicted in FIG. 20, a sizing die 1044 is used in fabricating the second inner conical plunger surface 54 and the second inner cylindrical plunger surface 55. The sizing die 1044 is run along the outer plunger surface 80 from the first plunger opening 31 to the second plunger opening 32. This operation results in metal flowing through to the inner plunger surface 50.

Figure 21:
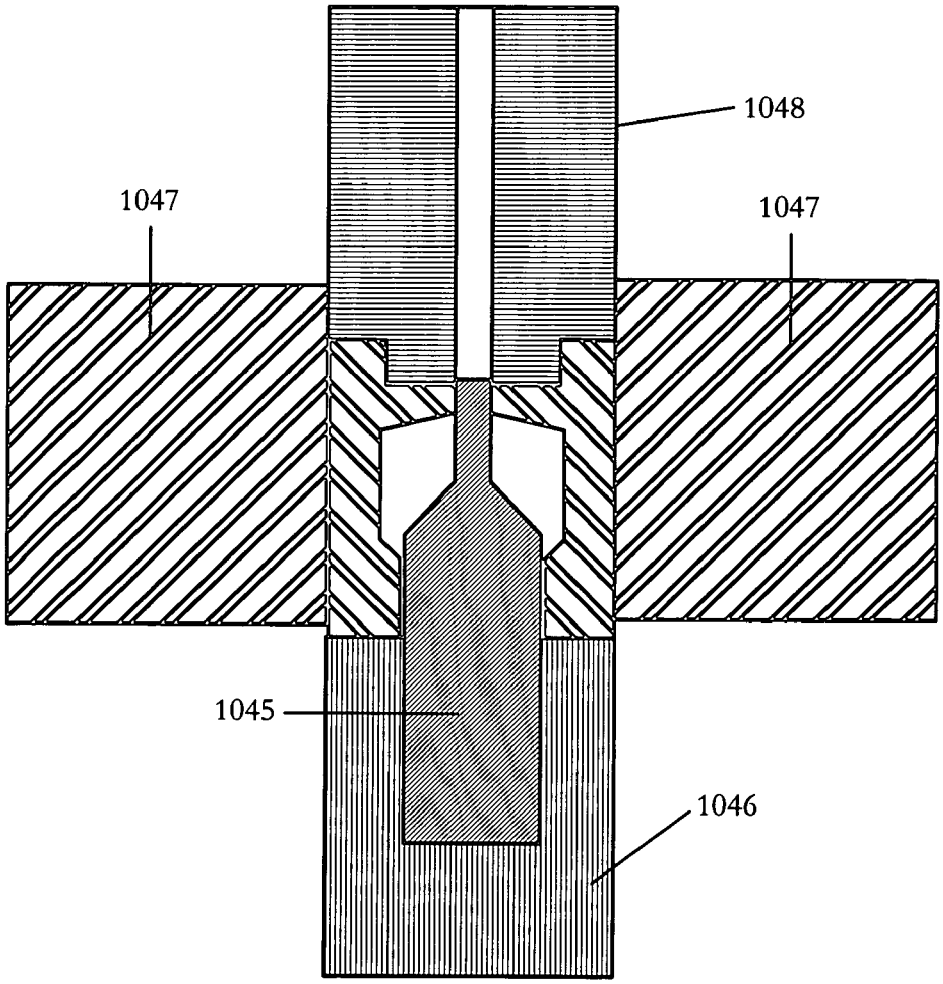

As shown in FIG. 21, the plunger hole 36 is fabricated through use of a piercing punch 1045 and a stripper sleeve 1046. The stripper sleeve 1046 is used in removing the piercing punch 1045 from the plunger hole 36. To assure that other forging operations are not affected during the fabrication of the plunger hole 36, a fourth die 1047 is used around the outer plunger surface 80 and a tool insert 1048 is used at the first plunger opening 31.

Figure 22:
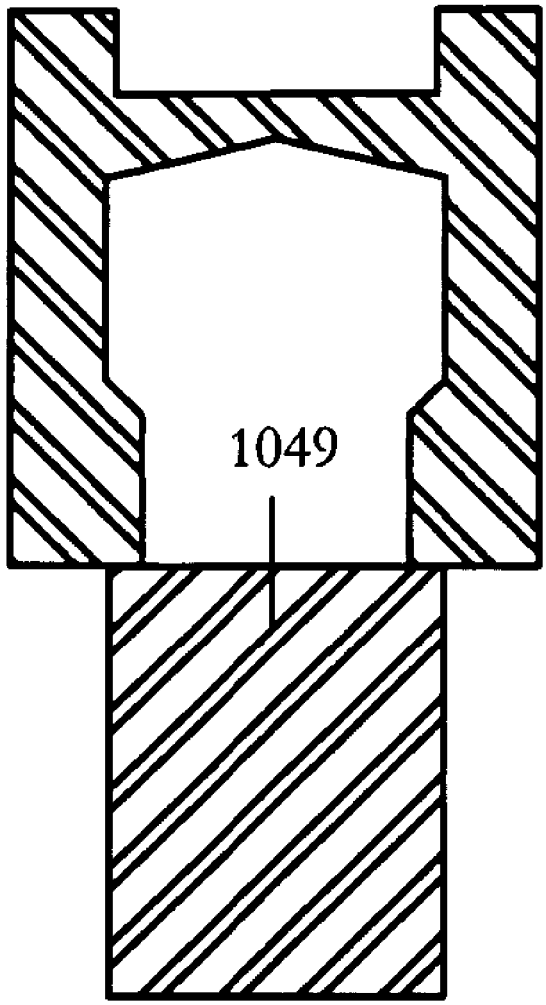
FIG. 22 depicts a step in an alternative method of fabricating a leakdown plunger.

Those skilled in the art will appreciate that further desirable finishing may be accomplished through machining. For example, an undercut plunger surface 82 may be fabricated and the second plunger opening 32 may be enlarged through machining. Alternatively, as depicted in FIG. 22, a shave punch 1049 may be inserted into the second plunger opening 32 and plow back excess material.

Figure 23:
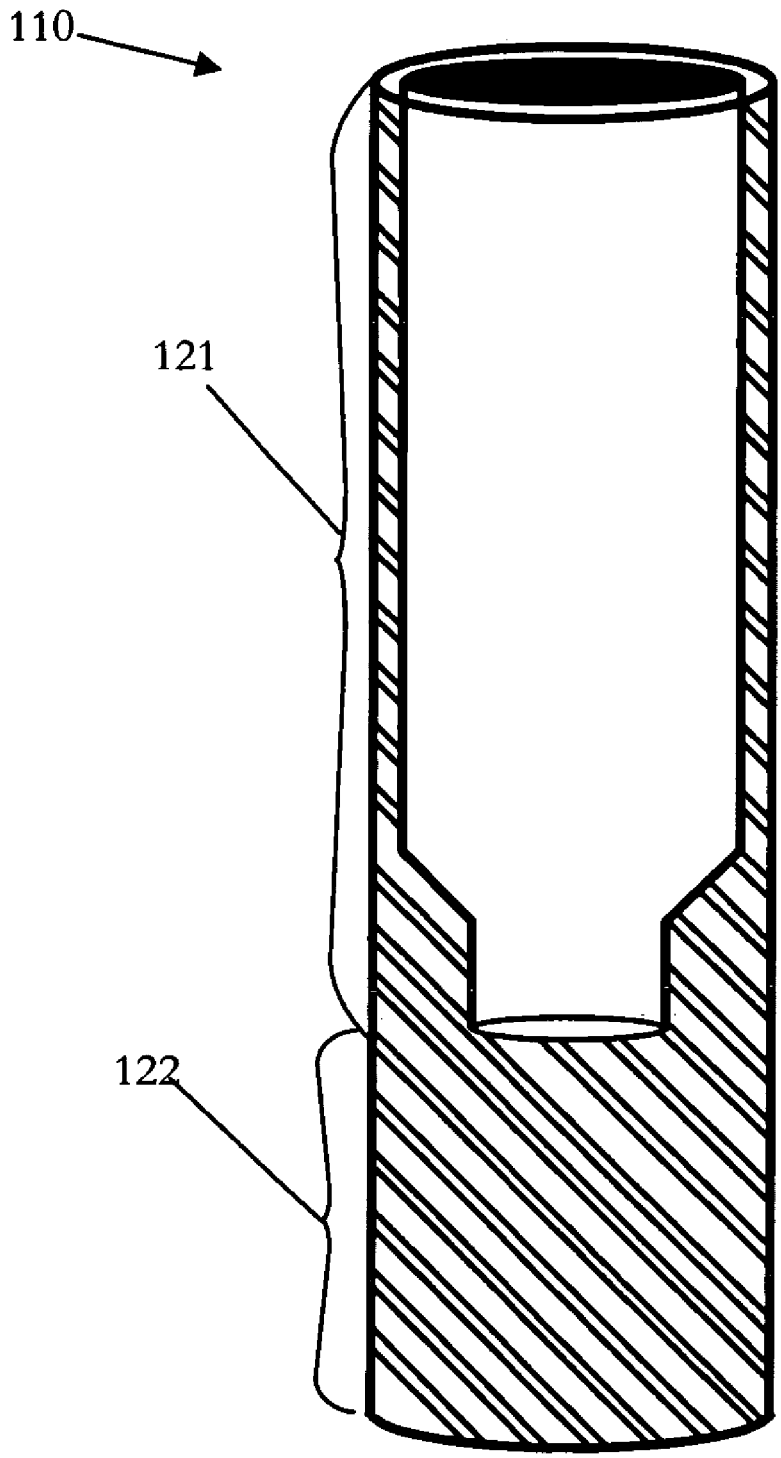
FIG. 23 depicts a preferred embodiment of a lash adjuster body.
Figure 24:
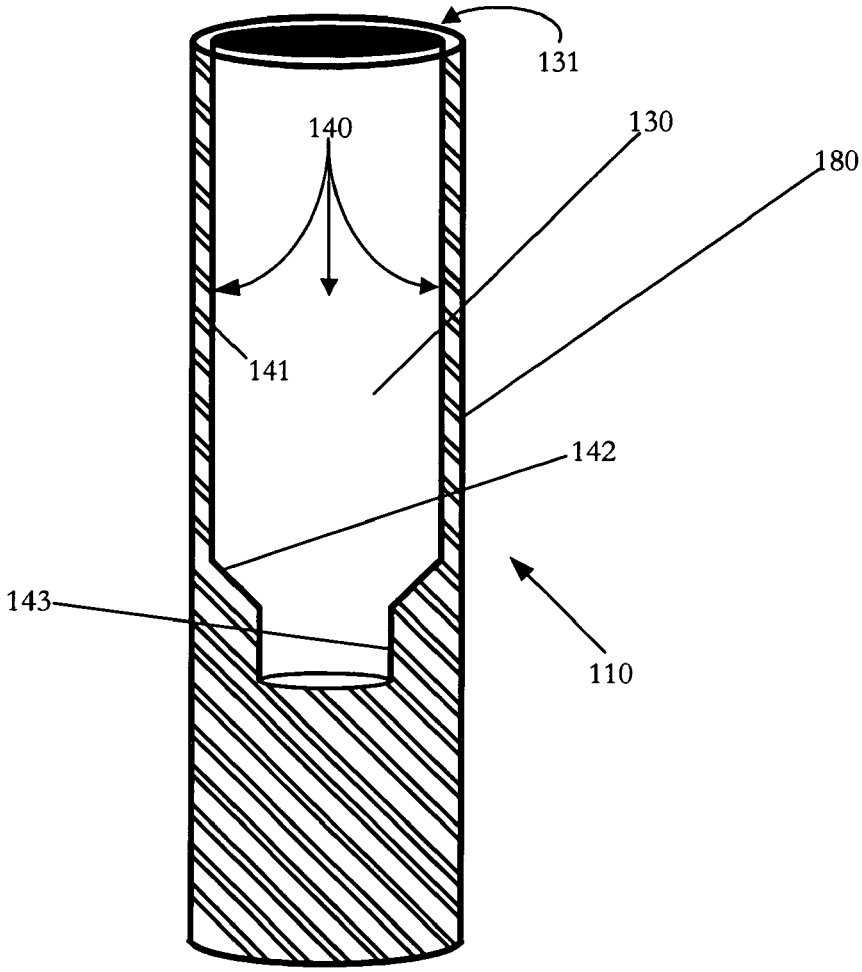
FIG. 24 depicts a preferred embodiment of a lash adjuster body.
Figure 25:
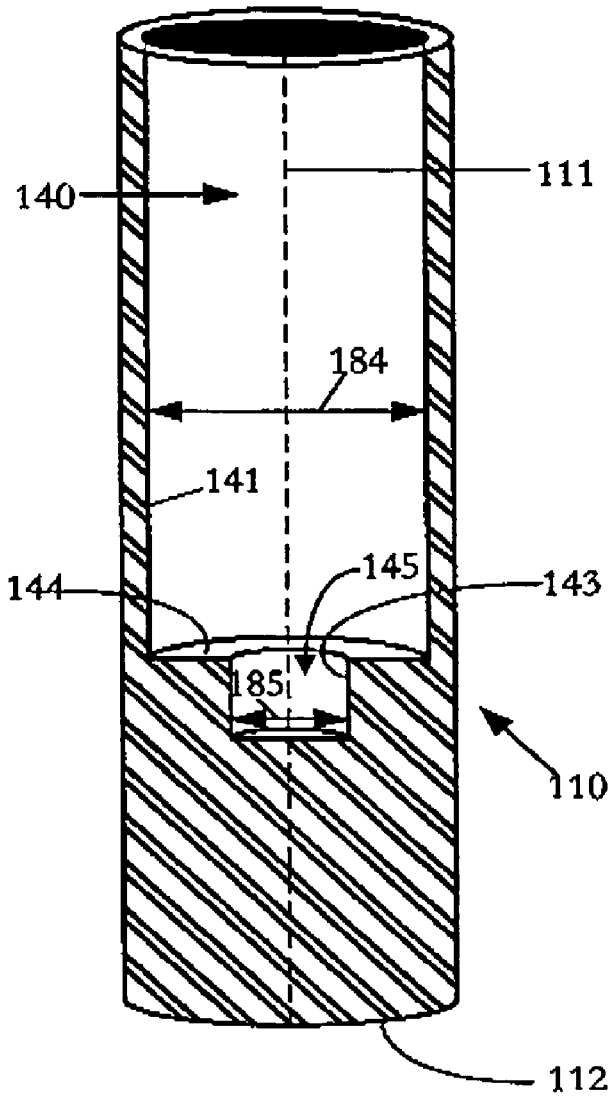
FIG. 25 depicts another embodiment of a lash adjuster body.

FIGS. 23, 24, and 25 show a preferred embodiment of the lash adjuster body 110. The lash adjuster body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the lash adjuster body 110 is composed of pearlitic material. According to still another aspect of the present invention, the lash adjuster body 110 is composed of austenitic material. According to another aspect of the present invention, the metal is a ferritic material.

The lash adjuster body 110 is composed of a plurality of lash adjuster elements. According to one aspect of the present invention, the lash adjuster element is cylindrical in shape. According to another aspect of the present invention, the lash adjuster element is conical in shape. According to yet another aspect of the present invention, the lash adjuster element is solid. According to still another aspect of the present invention, the lash adjuster element is hollow.

FIG. 23 depicts a cross-sectional view of the lash adjuster 110 composed of a plurality of lash adjuster elements. FIG. 23 shows the lash adjuster body, generally designated 110. The lash adjuster body 110 of the preferred embodiment is fabricated from a single piece of metal wire or rod and is described herein as a plurality of lash adjuster elements. The lash adjuster body 110 includes a hollow lash adjuster element 121 and a solid lash adjuster element 122. In the preferred embodiment, the solid lash adjuster element 122 is located adjacent to the hollow lash adjuster element 121.

The lash adjuster body 110 functions to accommodate a plurality of inserts. According to one aspect of the present invention, the lash adjuster body 110 accommodates a leakdown plunger, such as the leakdown plunger 10. According to another aspect of the present invention, the lash adjuster body 110 accommodates a push rod seat (not shown). According to yet another aspect of the present invention, the lash adjuster body 110 accommodates a socket, such as the socket 210.

The lash adjuster body 110 is provided with a plurality of outer surfaces and inner surfaces. FIG. 24 depicts a cross-sectional view of the preferred embodiment of the present invention. As shown in FIG. 24, the lash adjuster body 110 is provided with an outer lash adjuster surface 180 which is configured to be inserted into another body. According to one aspect of the present invention, the outer lash adjuster surface 180 is configured to be inserted into a valve lifter body, such as the valve lifter body 310. According to another aspect of the present invention, the outer lash adjuster surface 180 is configured to be inserted into a roller follower, such as roller follower 410.

The outer lash adjuster surface 180 encloses at least one cavity. As depicted in FIG. 24, the outer lash adjuster surface 180 encloses a lash adjuster cavity 130. The lash adjuster cavity 130 is configured to cooperate with a plurality of inserts. According to one aspect of the present invention, the lash adjuster cavity 130 is configured to cooperate with a leakdown plunger. In the preferred embodiment, the lash adjuster cavity 130 is configured to cooperate with the leakdown plunger 10. According to another aspect of the present invention, the lash adjuster cavity 130 is configured to cooperate with a socket. In the preferred embodiment, the lash adjuster cavity 130 is configured to cooperate with the socket 210. According to yet another aspect of the present invention, the lash adjuster cavity 130 is configured to cooperate with a push rod. According to still yet another aspect of the present invention, the lash adjuster cavity is configured to cooperate with a push rod seat.

Referring to FIG. 24, the lash adjuster body 110 of the present invention is provided with a lash adjuster cavity 130 that includes a lash adjuster opening 131. The lash adjuster opening 131 is in a circular shape. The lash adjuster cavity 130 is provided with the inner lash adjuster surface 140.

The inner lash adjuster surface 140 includes a plurality of surfaces. According to one aspect of the present invention, the inner lash adjuster surface 140 includes a cylindrical lash adjuster surface. According to another aspect of the present invention, the inner lash adjuster surface 140 includes a conical or frustoconical surface.

As depicted in FIG. 24, the inner lash adjuster surface 140 is provided with a first cylindrical lash adjuster surface 141, preferably concentric relative to the outer lash adjuster surface 180. Adjacent to the first cylindrical lash adjuster surface 141 is a conical lash adjuster surface 142. Adjacent to the conical lash adjuster surface 142 is a second cylindrical lash adjuster surface 143. However, those skilled in the art will appreciate that the inner lash adjuster surface 140 can be fabricated without the conical lash adjuster surface 142.

Figure 37:
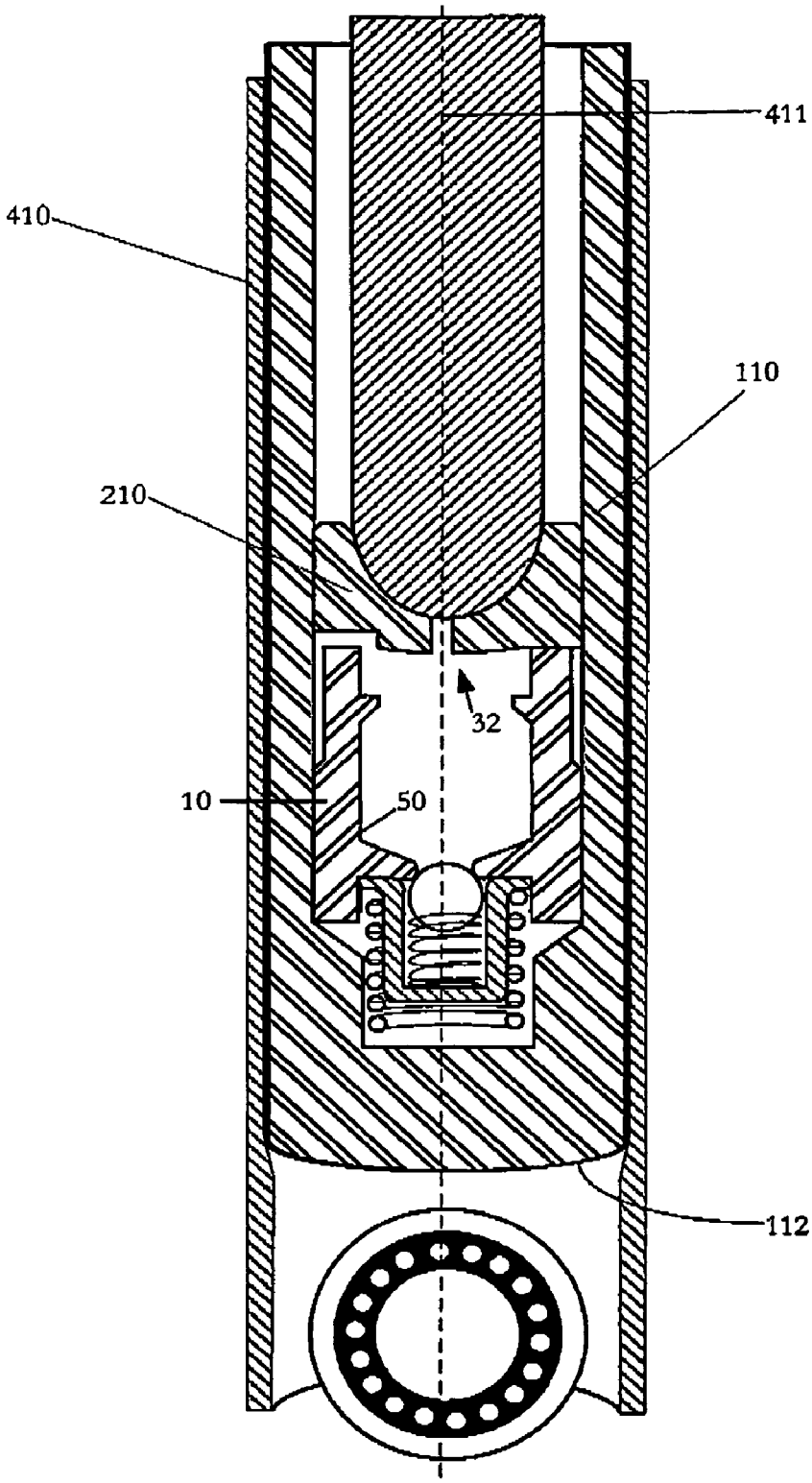
FIG. 37 depicts an embodiment of a socket cooperating with an engine work piece.

FIG. 25 depicts a cut-away view of the lash adjuster body 110 of the preferred embodiment. The lash adjuster body 110 is provided with a lash adjuster axis 111 depicted as a dashed line designated "111" on FIG. 25 and a bottom surface 112 located on the outer surface 180 at the end of the lash adjuster body 110. The inner lash adjuster surface 140 is provided with a first cylindrical lash adjuster surface 141 that includes a first inner lash adjuster diameter 184. The first cylindrical lash adjuster surface 141 abuts an annular lash adjuster surface 144 with an annulus 145. The annulus 145 defines a second cylindrical lash adjuster surface 143 that includes a second inner lash adjuster diameter 185. In the embodiment depicted, the second inner lash adjuster diameter 185 is smaller than the first inner lash adjuster diameter 184. The annular lash adjuster surface 144 and the bottom surface 112 are oriented to be generally orthogonal to the lash adjuster axis 111 of the lash adjuster body 110, and, when the lash adjuster body 110 is inserted into a roller follower body 410 (as represented in FIG. 37), the annular lash adjuster surface 144 and the bottom surface 112 are oriented to be generally orthogonal to the axis of the roller follower body 410 (referred to herein as a "axis 411").

The lash adjuster body 110 of the present invention is fabricated through a plurality of processes. According to one aspect of the present invention, the lash adjuster body 110 is machined. According to another aspect of the present invention, the lash adjuster body 110 is forged. According to yet another aspect of the present invention, the lash adjuster body 110 is fabricated through casting. The preferred embodiment of the present invention is forged. As used herein, the term "forge," "forging," or "forged" is intended to encompass what is known in the art as "cold forming," "cold heading," "deep drawing," and "hot forging."

In the preferred embodiment, the lash adjuster body 110 is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The lash adjuster cavity 130 is extruded through use of a punch and an extruding pin. After the lash adjuster cavity 130 has been extruded, the lash adjuster cavity 130 is forged. The lash adjuster cavity 130 is extruded through use of an extruding punch and a forming pin.

Alternatively, the lash adjuster body 110 is fabricated through machining. As used herein, machining means the use of a chucking machine, a drilling machine, a grinding machine, or a broaching machine. Machining is accomplished by first feeding the lash adjuster body 110 into a chucking machine, such as an ACME-Gridley automatic chucking machine. Those skilled in the art will appreciate that other machines and other manufacturers of automatic chucking machines can be used.

To machine the lash adjuster cavity 130, the end containing the lash adjuster opening 131 is faced so that it is substantially flat. The lash adjuster cavity 130 is bored. Alternatively, the lash adjuster cavity 130 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the lash adjuster cavity 130 is ground using an internal diameter grinding machine, such as a Heald grinding machine. Those skilled in the art will appreciate that the lash adjuster cavity 130 can be ground using other grinding machines.

Figure 26:
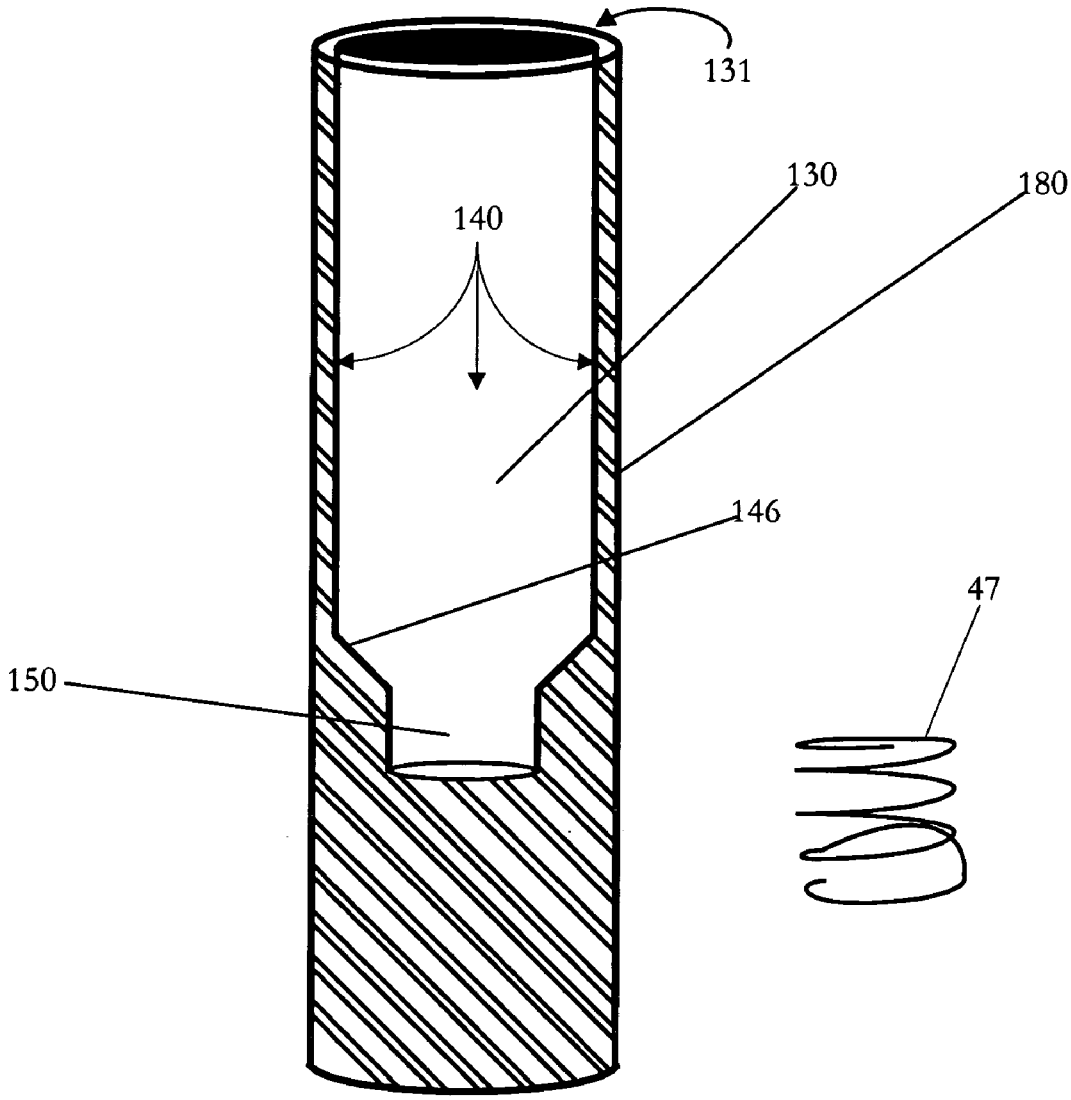
FIG. 26 depicts another embodiment of a lash adjuster body.

FIG. 26 depicts the inner lash adjuster surface 140 provided with a lash adjuster well 150. The lash adjuster well 150 is shaped to accommodate a cap spring 47. In the embodiment depicted in FIG. 26, the lash adjuster well 150 is cylindrically shaped at a diameter that is smaller than the diameter of the inner lash adjuster surface 140. The cylindrical shape of the lash adjuster well 150 is preferably concentric relative to the outer lash adjuster surface 180. The lash adjuster well 150 is preferably forged through use of an extruding die pin.

Alternatively, the lash adjuster well 150 is machined by boring the lash adjuster well 150 in a chucking machine. Alternatively, the lash adjuster well 150 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lash adjuster well 150 is ground using an internal diameter grinding machine, such as a Heald grinding machine. Those skilled in the art will appreciate that the lash adjuster well 150 can be ground using other grinding machines.

Adjacent to the lash adjuster well 150, in the embodiment depicted in FIG. 26, is a lash adjuster lead surface 146 which is conically shaped and can be fabricated through forging or machining. However, those skilled in the art will appreciate that the present invention can be fabricated without the lash adjuster lead surface 146.

Figure 27:
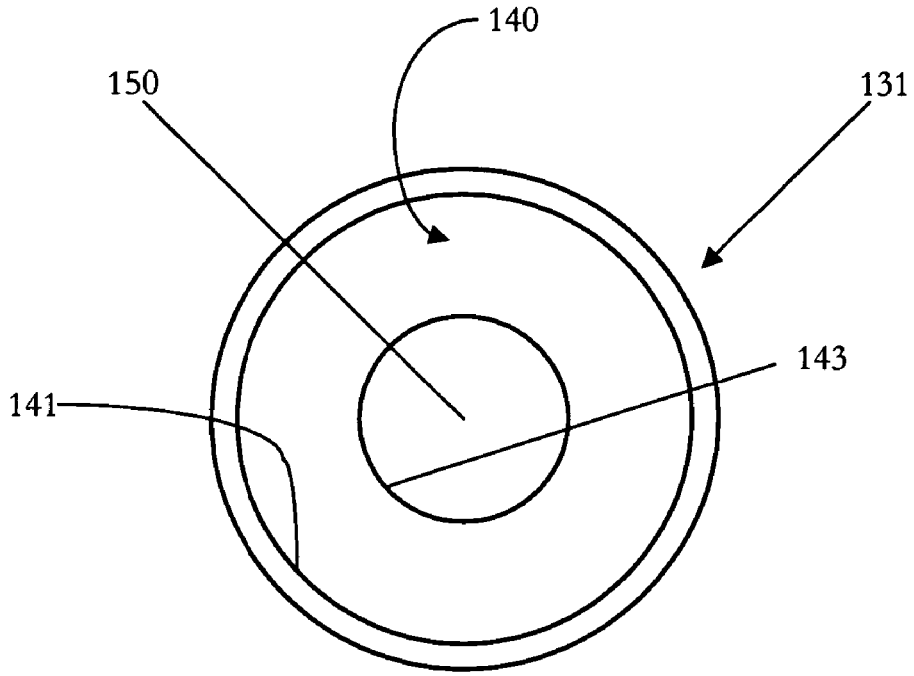
FIG. 27 depicts a top view of an embodiment of a lash adjuster body.

FIG. 27 depicts a view of the lash adjuster opening 131 that reveals the inner lash adjuster surface 140 of the preferred embodiment of the present invention. The inner lash adjuster surface 140 is provided with a first cylindrical lash adjuster surface 141. A lash adjuster well 150 is defined by a second cylindrical lash adjuster surface 143. As shown in FIG. 27, the second cylindrical lash adjuster surface 143 is concentric relative to the first cylindrical lash adjuster surface 141.

Figure 28:
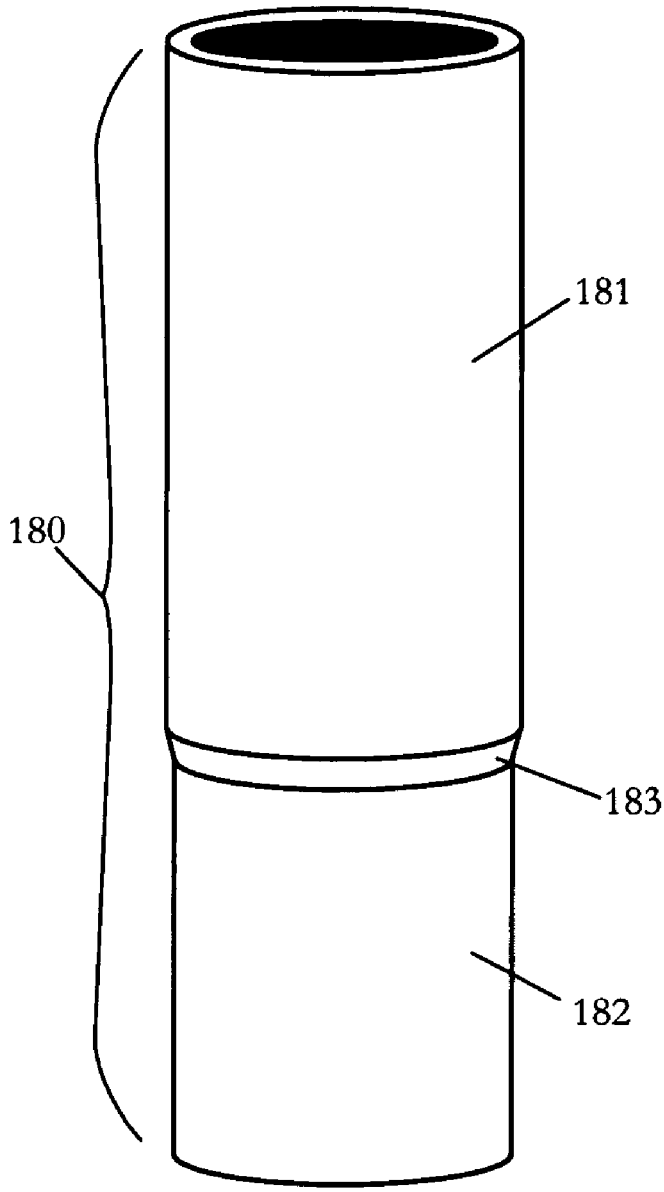
FIG. 28 depicts the top view of another preferred embodiment of a lash adjuster body.

Depicted in FIG. 28 is a lash adjuster body 110 of an alternative embodiment. As shown in FIG. 28, the lash adjuster body 110 is provided with an outer lash adjuster surface 180. The outer lash adjuster surface 180 includes a plurality of surfaces. In the embodiment depicted in FIG. 28, the outer lash adjuster surface 180 includes an outer cylindrical lash adjuster surface 181, an undercut lash adjuster surface 182, and a conical lash adjuster surface 183. As depicted in FIG. 28, the undercut lash adjuster surface 182 extends from one end of the lash adjuster body 110 and is cylindrically shaped. The diameter of the undercut lash adjuster surface 182 is smaller than the diameter of the outer cylindrical lash adjuster surface 181.

The undercut lash adjuster surface 182 is forged through use of an extruding die. Alternatively, the undercut lash adjuster surface 182 is fabricated through machining. Machining the undercut lash adjuster surface 182 is accomplished through use of an infeed centerless grinding machine, such as a Cincinnati grinder. The surface is first heat-treated and then the undercut lash adjuster surface 182 is ground via a grinding wheel. Those skilled in the art will appreciate that additional surfaces can be ground into the outer lash adjuster surface 180 with minor alterations to the grinding wheel.

As depicted in FIG. 28, the conical lash adjuster surface 183 is located between the outer cylindrical lash adjuster surface 181 and the undercut lash adjuster surface 182. The conical lash adjuster surface 183 is forged through use of an extruding die. Alternatively, the conical lash adjuster surface 183 is fabricated through machining. Those with skill in the art will appreciate that the outer lash adjuster surface 180 can be fabricated without the conical lash adjuster surface 183 so that the outer cylindrical lash adjuster surface 181 and the undercut lash adjuster surface 182 abut one another.

Those skilled in the art will appreciate that the features of the lash adjuster body 110 may be fabricated through a combination of machining, forging, and other methods of fabrication. By way of example and not limitation, aspects of the lash adjuster cavity 130 can be machined; other aspects of the lash adjuster cavity can be forged.

Figure 29:
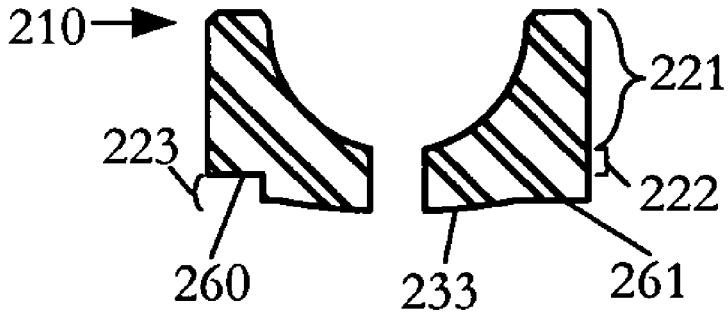
FIG. 29 depicts a preferred embodiment of a socket.
Figure 30:
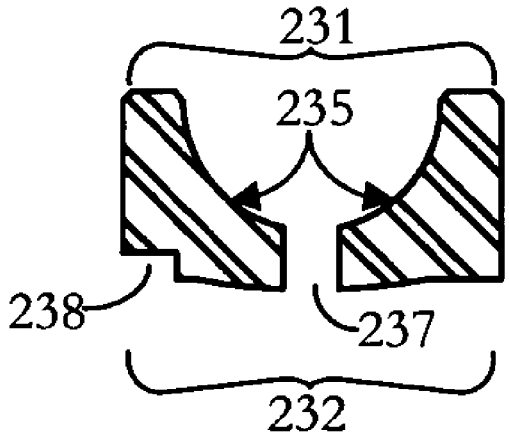
FIG. 30 depicts a preferred embodiment of a socket.
Figure 31:
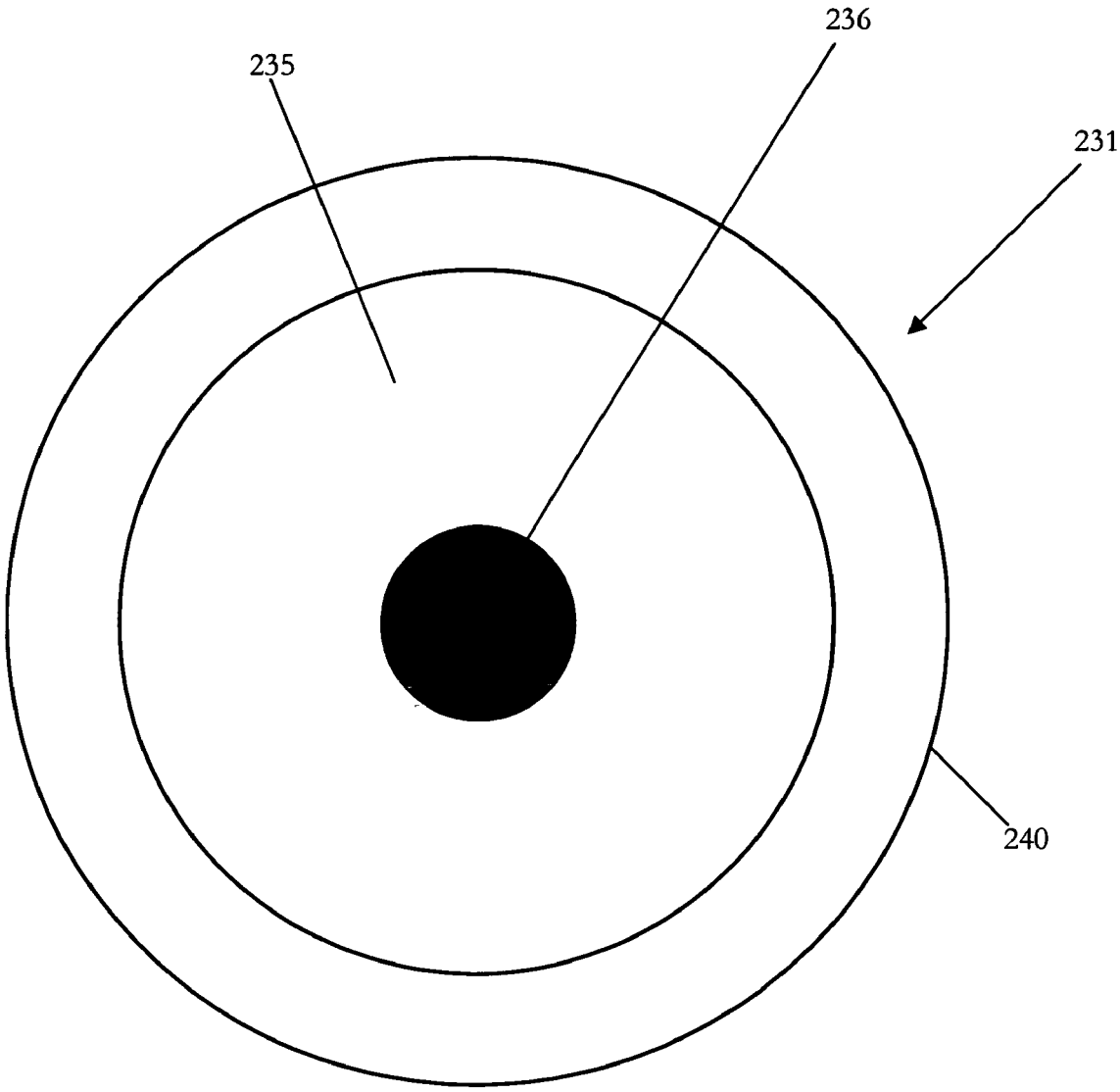
FIG. 31 depicts the top view of a surface of a socket.

Turning now to the drawings, FIGS. 29, 30, and 31 show a preferred embodiment of a socket 210. The socket 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 210 is composed of pearlitic material. According to still another aspect of the present invention, the socket 210 is composed of austenitic material. According to another aspect of the present invention, the metal is a ferritic material.

The socket 210 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 29 depicts a cross-sectional view of the socket 210 of the preferred embodiment of the present invention composed of a plurality of socket elements. FIG. 29 shows the socket, generally designated 210. The socket 210 functions to accept a liquid, such as a lubricant and is provided with a plurality of surfaces and passages. Referring now to FIG. 31, the first socket surface 231 functions to accommodate an insert, such as, for example, a push rod 296.

The socket 210 of the preferred embodiment is fabricated from a single piece of metal wire or rod and is described herein as a plurality of socket elements. The socket 210 includes a first hollow socket element 221, a second hollow socket element 222, and a third hollow socket element 223. As depicted in FIG. 29, the first hollow socket element 221 is located adjacent to the second hollow socket element 222. The second hollow socket element 222 is located adjacent to the third hollow socket element 223.

The first hollow socket element 221 functions to accept an insert, such as a push rod. The third hollow socket element 223 functions to conduct fluid. The second hollow socket element 222 functions to fluidly link the first hollow socket element 221 with the third hollow socket element 223.

Referring now to FIG. 30, the socket 210 is provided with a plurality of outer surfaces and inner surfaces. FIG. 30 depicts a cross sectional view of the socket 210 of the preferred embodiment of the present invention. As shown in FIG. 30, the preferred embodiment of the present invention is provided with a first socket surface 231. The first socket surface 231 is configured to accommodate an insert. The socket 210 of the preferred embodiment is also provided with a second socket surface 232. The second socket surface 232 is configured to cooperate with an engine workpiece.

FIG. 31 depicts a top view of the first socket surface 231. As shown in FIG. 31, the first socket surface 231 is provided with a generally spherical push rod cooperating surface 235 defining a first socket hole 236. Preferably, the push rod cooperating surface 235 is concentric relative to the outer socket surface 240; however, such concentricity is not necessary. In the embodiment depicted in FIG. 31, the first socket hole 236 fluidly links the first socket surface 231 with a socket passage 237. The socket passage 237 is shaped to conduct fluid, preferably a lubricant. In the embodiment depicted in FIG. 31, the socket passage 237 is cylindrically shaped; however, those skilled in the art will appreciate that the socket passage 237 may assume any shape so long as it is able to conduct fluid.

Figure 32:
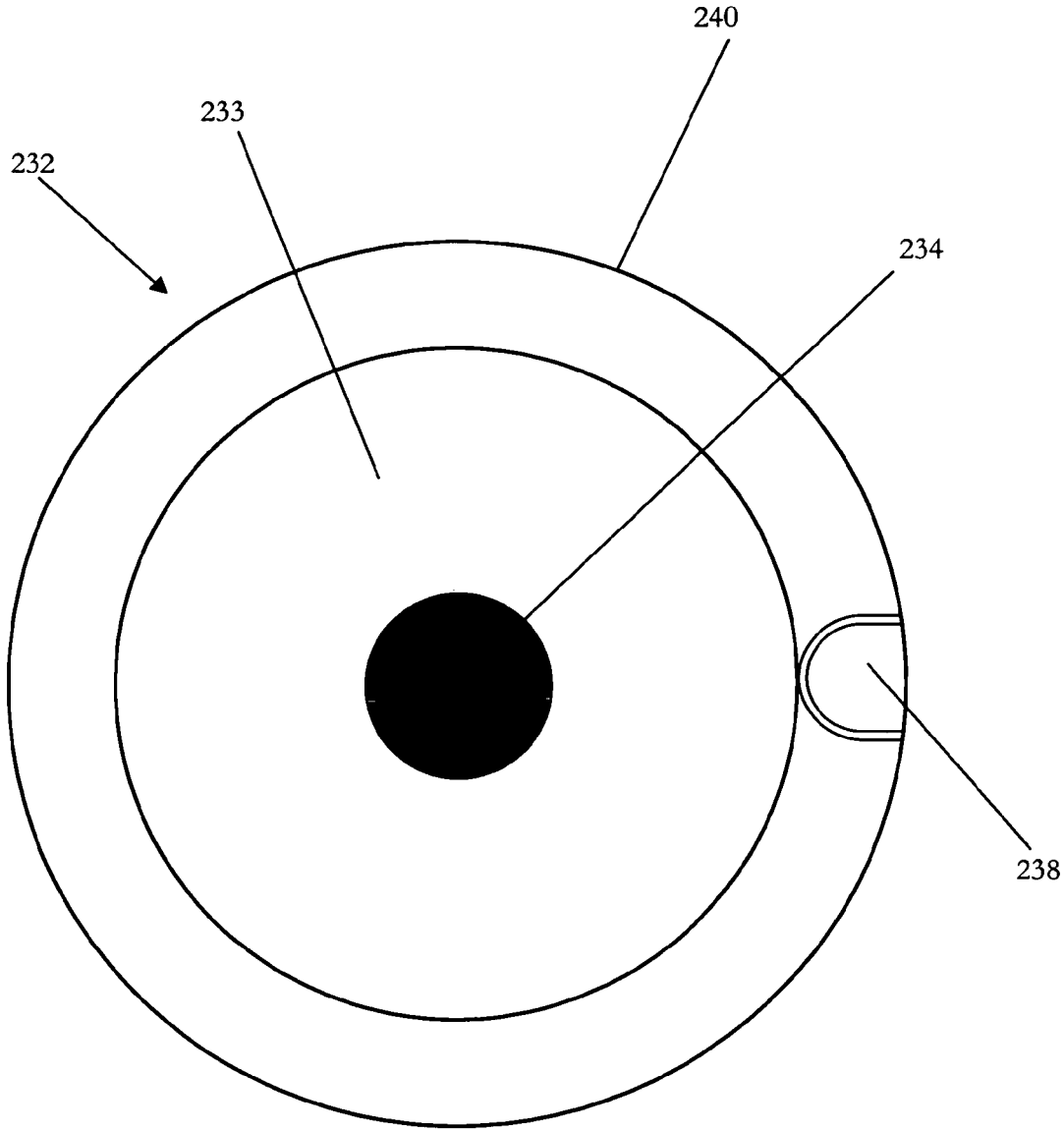
FIG. 32 depicts the top view of another surface of a socket.

FIG. 32 depicts a top view of the second socket surface 232. The second socket surface 232 is provided with a plunger reservoir passage 238. The plunger reservoir passage 238 is configured to conduct fluid, preferably a lubricant. As depicted in FIG. 32, the plunger reservoir passage 238 of the preferred embodiment is generally cylindrical in shape; however, those skilled in the art will appreciate that the plunger reservoir passage 238 may assume any shape so long as it conducts fluid.

Figure 34:
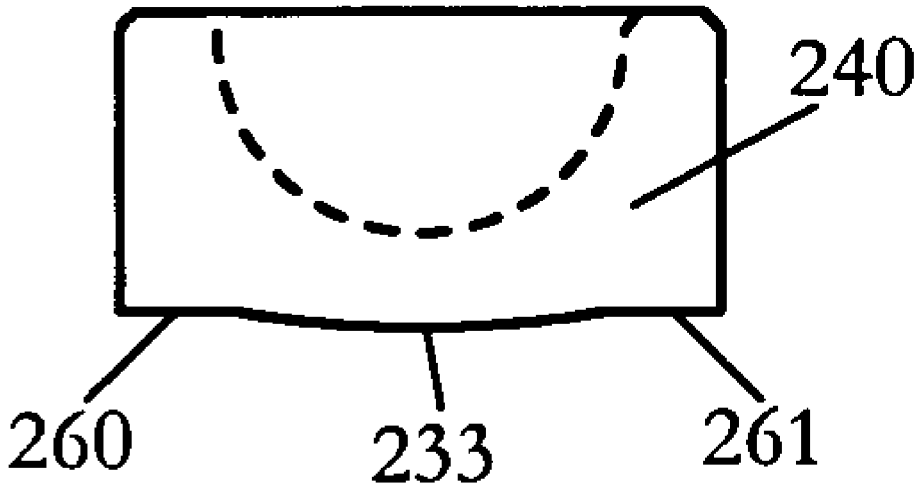
FIG. 34 depicts an outer surface of an embodiment of a socket.

The second socket surface 232 defines a second socket hole 234. The second socket hole 234 fluidly links the second socket surface 232 with socket passage 237. The second socket surface 232 is provided with a protruding surface 233. In the embodiment depicted the protruding surface 233 is generally curved The protruding surface 233 is preferably concentric relative to the outer socket surface 240. However, those skilled in the art will appreciate that it is not necessary that the second socket surface 232 be provided with a protruding socket surface 233 or, as depicted in FIG. 34, that the protruding socket surface 233 be concentric relative to the outer socket surface 240. The second socket surface 232 may be provided with any surface, and the curved socket surface 233 of the preferred embodiment may assume any shape so long as the second socket surface 232 cooperates with the opening of an engine workpiece.

As shown in FIG. 29, the protruding surface 233 on the second socket surface 232 is located between a first flat surface 260 and a second flat surface 261. As shown therein, the protruding surface 233 is raised with respect to the first and second flat surfaces 260, 261.

Figure 33:
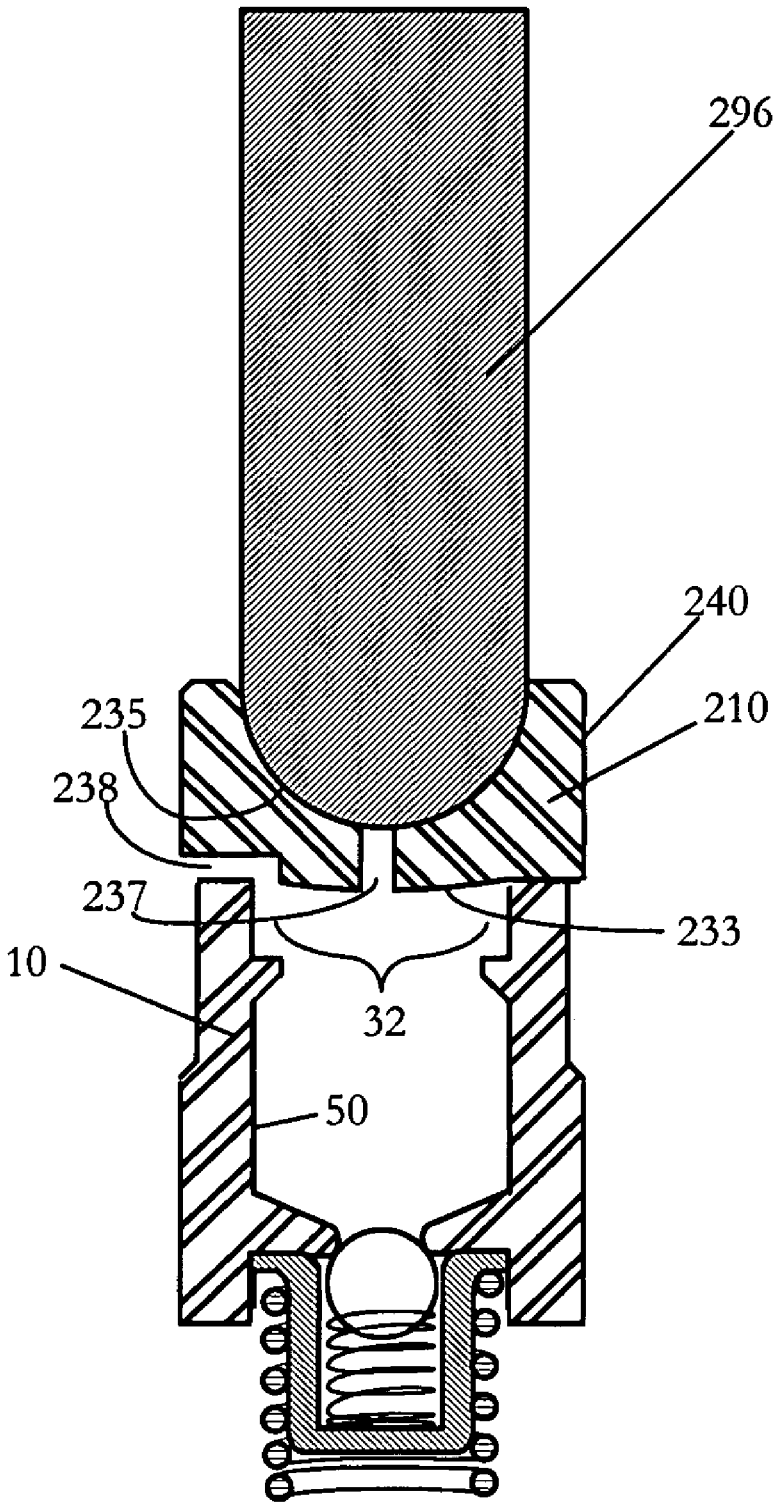
FIG. 33 depicts an embodiment of a socket accommodating an engine work piece.

As shown in FIG. 33, the protruding surface 233 on the second socket surface 232 is located between a first flat surface 260 and a second flat surface 260, 261. As shown therein, the protruding surface 233 is raised with respect to the first and second flat surfaces 260, 261.

Referring now to FIG. 33, the first socket surface 231 is depicted accommodating an insert. As shown in FIG. 33, that insert is a push rod 296. The second socket surface 232 is further depicted cooperating with an engine workpiece. In FIG. 33, that engine workpiece is a leakdown plunger 10. Those skilled in the art will appreciate that push rods other than the push rod 296 shown herein can be used without departing from the scope and spirit of the present invention. Furthermore, those skilled in the art will appreciate that leakdown plungers other than the leakdown plunger 10 shown herein can be used without departing from the scope and spirit of the present invention.

As depicted in FIG. 33, the protruding socket surface 233 cooperates with a second plunger opening 32 of the leakdown plunger 10. According to one aspect of the present invention, the protruding socket surface 233 preferably corresponds to the second plunger opening 32 of the leakdown plunger 10. According to another aspect of the present invention, the protruding socket surface 233 preferably provides a closer fit between the second socket surface 232 of the socket 210 and the second plunger opening 32 of the leakdown plunger 10.

In the embodiment depicted in FIG. 33, a socket passage 237 is provided. The socket passage 237 preferably functions to lubricate the push rod cooperating surface 235. The embodiment depicted in FIG. 33 is also provided with a plunger reservoir passage 238. The plunger reservoir passage 238 is configured to conduct fluid, preferably a lubricant.

The plunger reservoir passage 238 performs a plurality of functions. According to one aspect of the present invention, the plunger reservoir passage 238 fluidly links the second plunger opening 32 of the leakdown plunger 10 and the outer socket surface 240 of the socket 210. According to another aspect of the present invention, the plunger reservoir passage 238 fluidly links the inner plunger surface 50 of the leakdown plunger 10 and the outer socket surface 240 of the socket 210.

Those skilled in the art will appreciate that the plunger reservoir passage 238 can be extended so that it joins socket passage 237 within the socket 210. However, it is not necessary that the passages 237, 238 be joined within the socket 210. As depicted in FIG. 33, the plunger reservoir passage 238 of an embodiment of the present invention is fluidly linked to socket passage 237. Those skilled in the art will appreciate that the outer socket surface 240 is fluidly linked to the first socket surface 231 in the embodiment depicted in FIG. 33.

As depicted in FIG. 34, the socket 210 is provided with an outer socket surface 240 that is configured to cooperate with the inner surface of an engine workpiece. As shown in FIG. 34, the outer socket surface 240 is cylindrically shaped. However, those skilled in the art will appreciate that the outer socket surface 240 may assume any shape so long as it is configured to cooperate with the inner surface of an engine workpiece.

Figure 35:
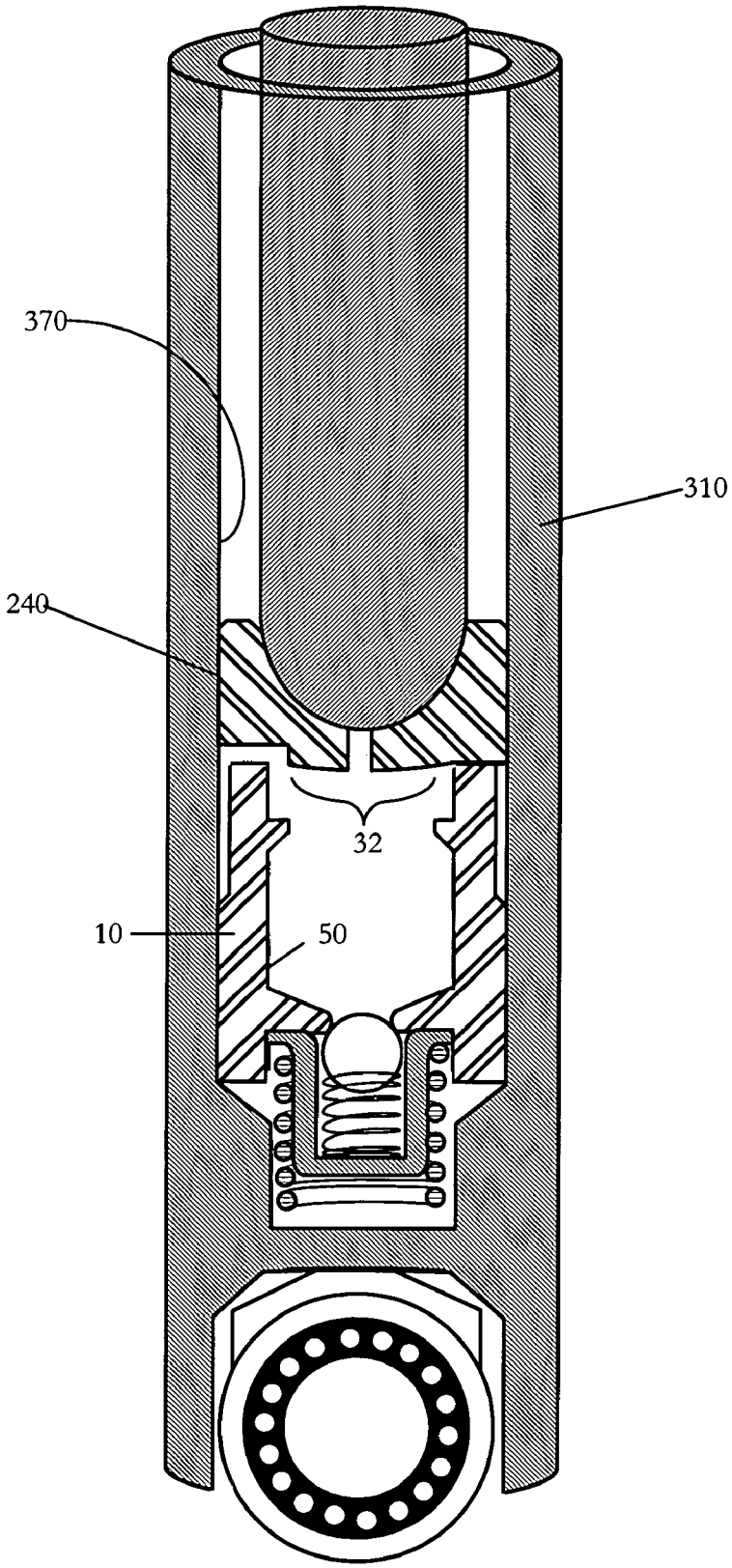
FIG. 35 depicts an embodiment of a socket cooperating with an engine work piece.

As depicted in FIG. 35, the outer socket surface 240 may advantageously be configured to cooperate with the inner surface of an engine workpiece. As shown in FIG. 35, the outer socket surface 240 is configured to cooperate with the second inner lifter surface 370 of a valve lifter body 310. Those skilled in the art will appreciate that the outer socket surface 40 may advantageously be configured to cooperate with the inner surfaces of other lifter bodies.

Figure 36:
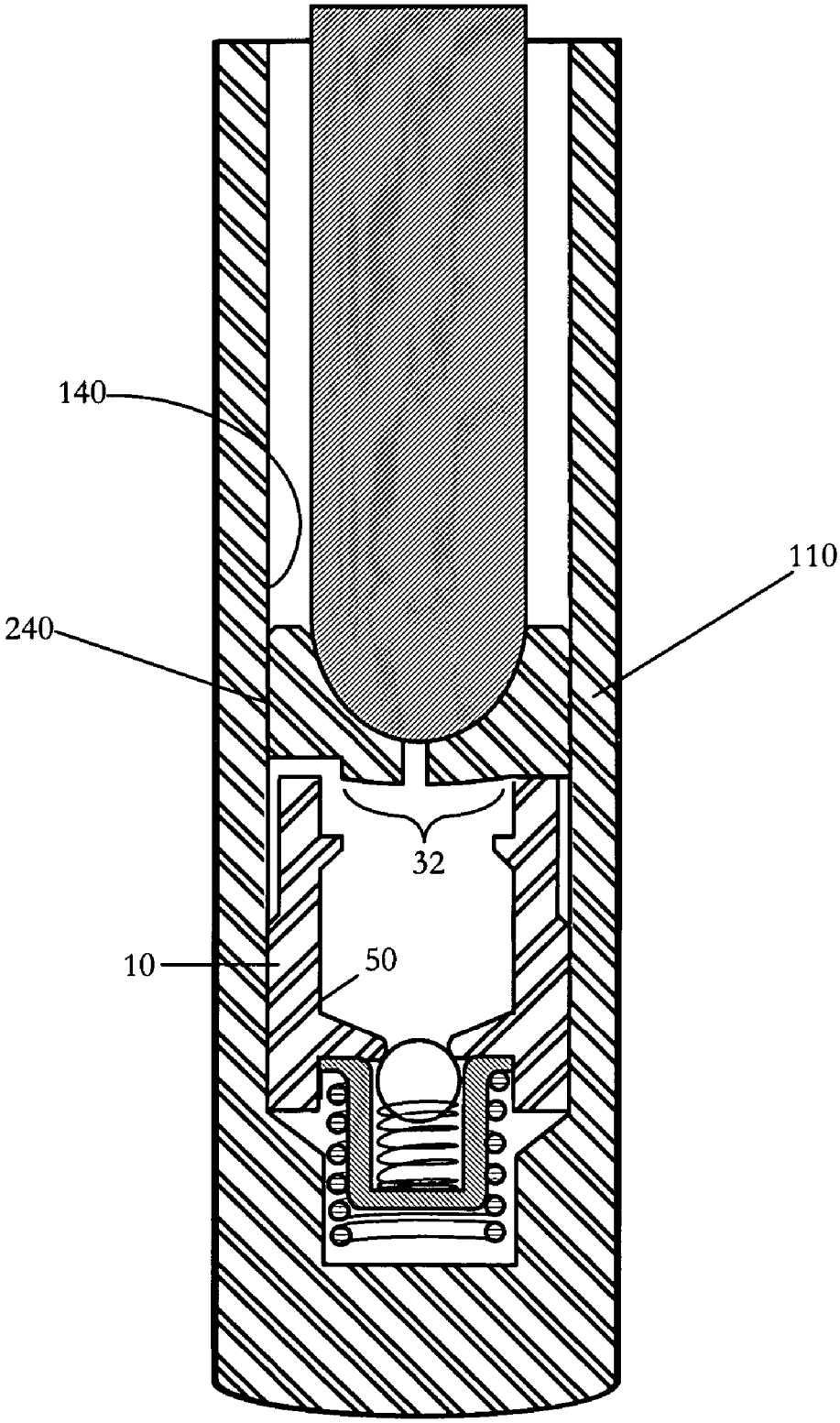
FIG. 36 depicts an embodiment of a socket cooperating with an engine work piece.

FIG. 36 depicts the outer socket surface 240 configured to cooperate with the inner surface of another workpiece. Those skilled in the art will appreciate that the outer socket surface 40 may be configured to cooperate with a lash adjuster. As shown in FIG. 36, the outer socket surface 240 is configured to cooperate with the inner lash adjuster surface 140 of a lash adjuster body 110. As depicted in FIG. 37, the lash adjuster body 110, with the socket 210 of the present invention located therein, may be inserted into a roller follower body 410.

Referring now to FIG. 38 to FIG. 42, the presently preferred method of fabricating a socket 210 is disclosed. FIG. 38 to 42 depict what is known in the art as a "slug progression" that shows the fabrication of the present invention from a rod or wire to a finished or near-finished body. In the slug progression shown herein, pins are shown on the punch side; however, those skilled in the art will appreciate that the pins can be switched to the die side without departing from the scope of the present invention.

The socket 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 38:
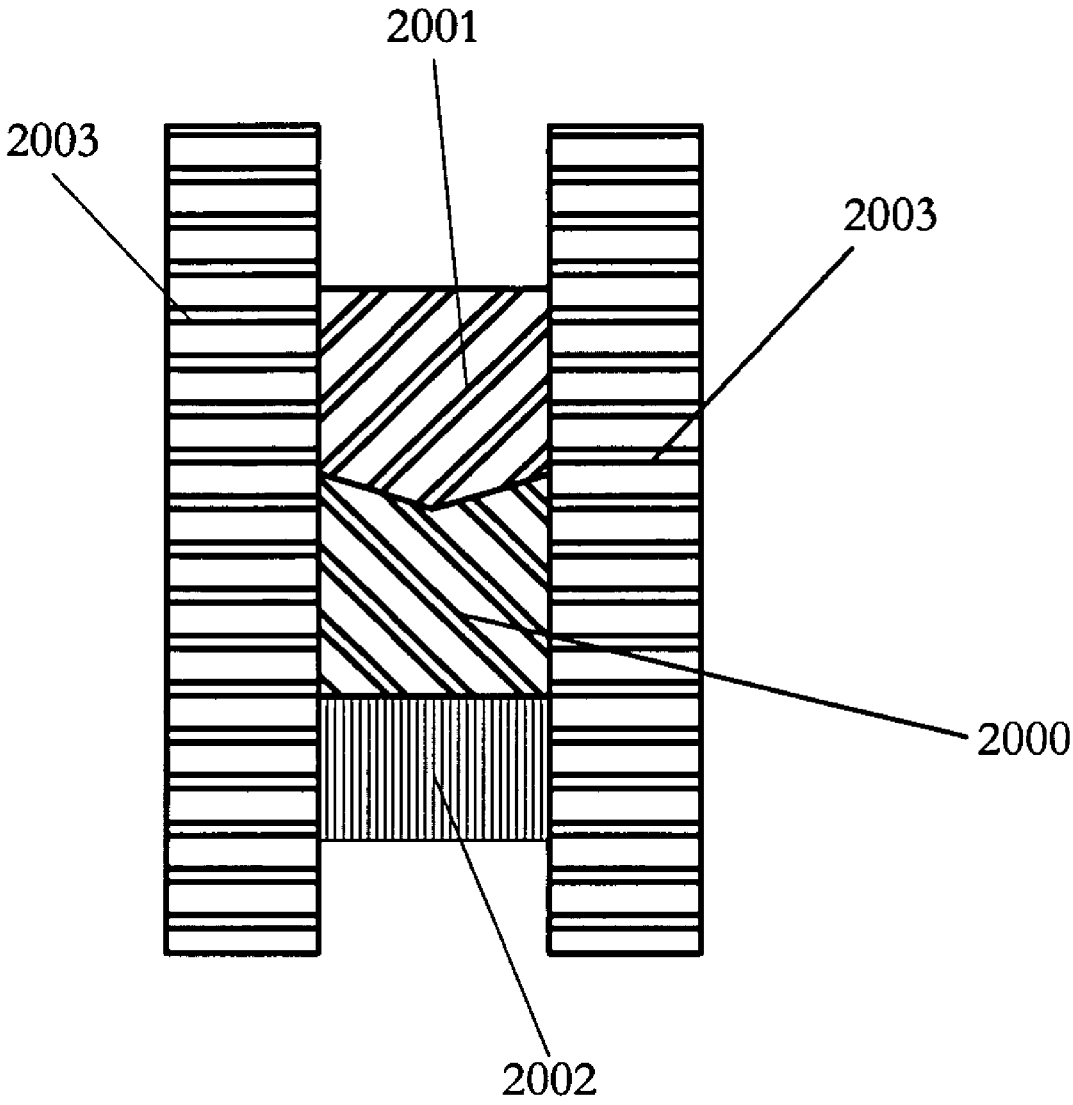
FIGS. 38–42 depict a preferred method of fabricating a socket.

The process of forging an embodiment of the present invention begins with a metal wire or metal rod 2000 which is drawn to size. The ends of the wire or rod are squared off As shown in FIG. 38, this is accomplished through the use of a first punch 2001, a first die 2002, and a first knock out pin 2003.

Figure 39:
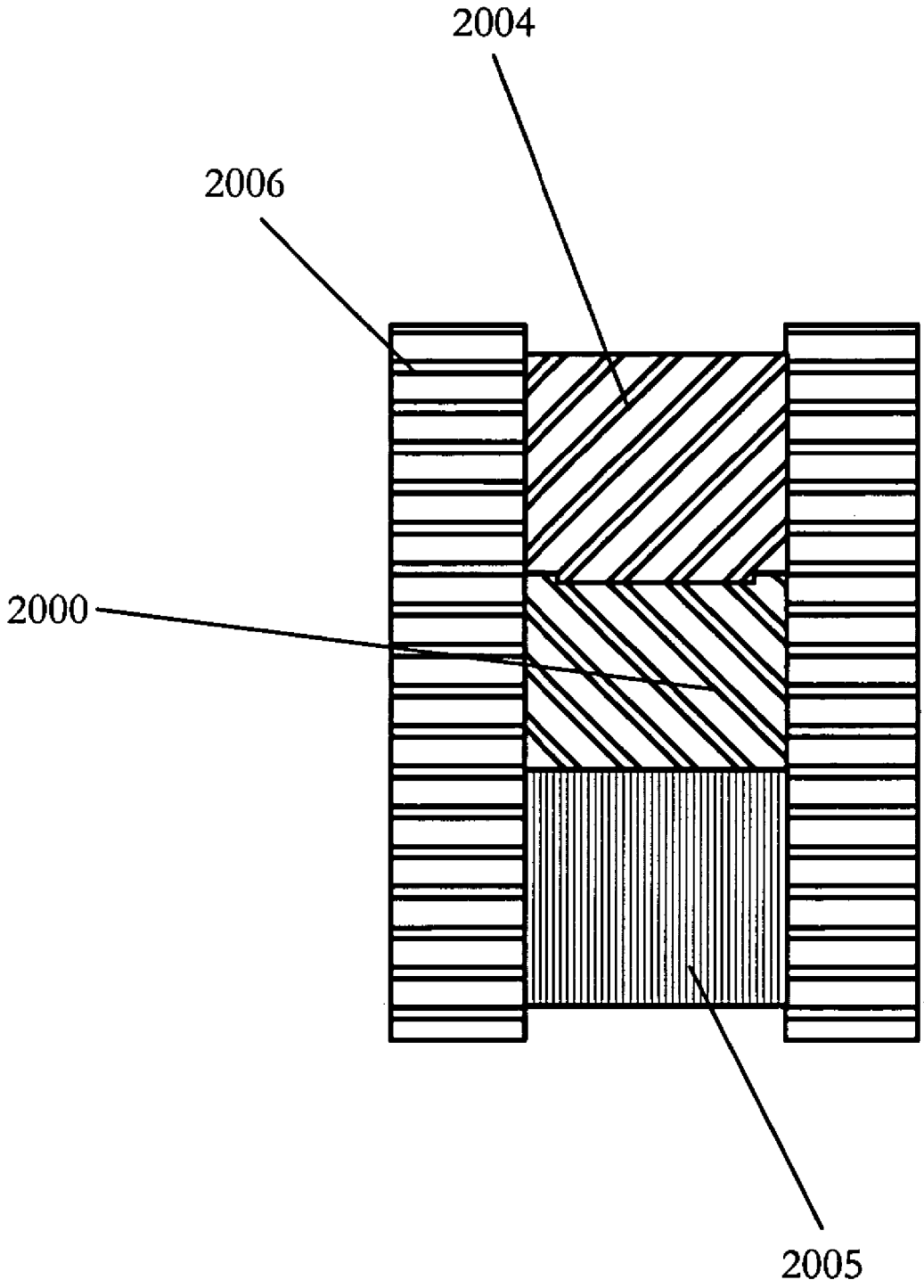

After being drawn to size, the wire or rod 2000 is run through a series of dies or extrusions. As depicted in FIG. 39, the fabrication of the first socket surface 231, the outer socket surface 240, and the second socket surface 232 is preferably commenced through use of a second punch 2004, a second knock out pin 2005, and a second die 2006. The second punch 2004 is used to commence fabrication of the first socket surface 231. The second die 2006 is used against the outer socket surface 240. The second knock out pin 2005 is used to commence fabrication of the second socket surface 232.

Figure 40:
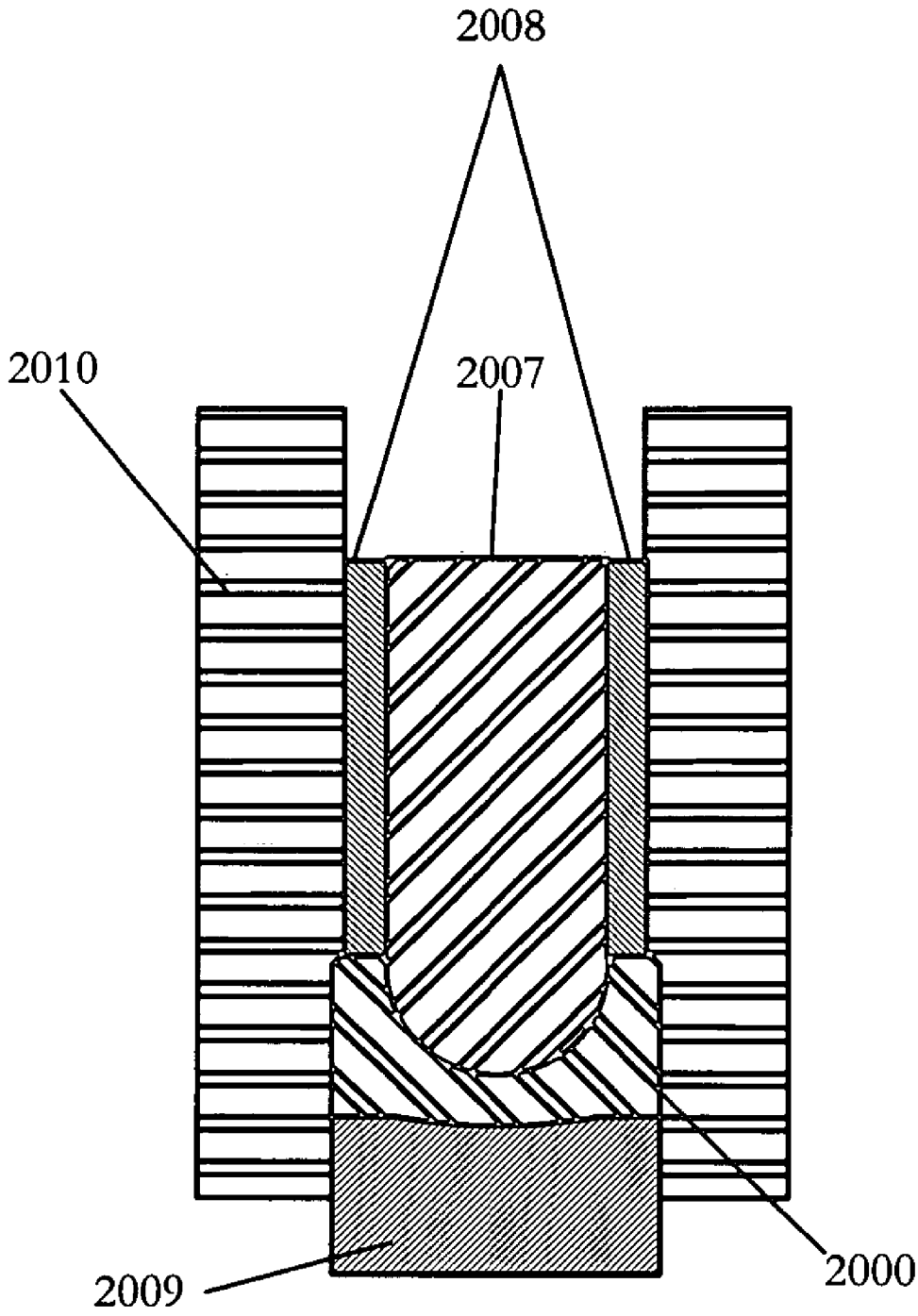

FIG. 40 depicts the fabrication of the first socket surface 231, the second socket surface 232, and the outer socket surface 240 through use of a third punch 2007, a first stripper sleeve 2008, a third knock out pin 2009, and a third die 2010. The first socket surface 231 is fabricated using the third punch 2007. The first stripper sleeve 2008 is used to remove the third punch 2007 from the first socket surface 231. The second socket surface 232 is fabricated through use of the third knock out pin 2009, and the outer socket surface 240 is fabricated through use of the third die 2010.

Figure 41:
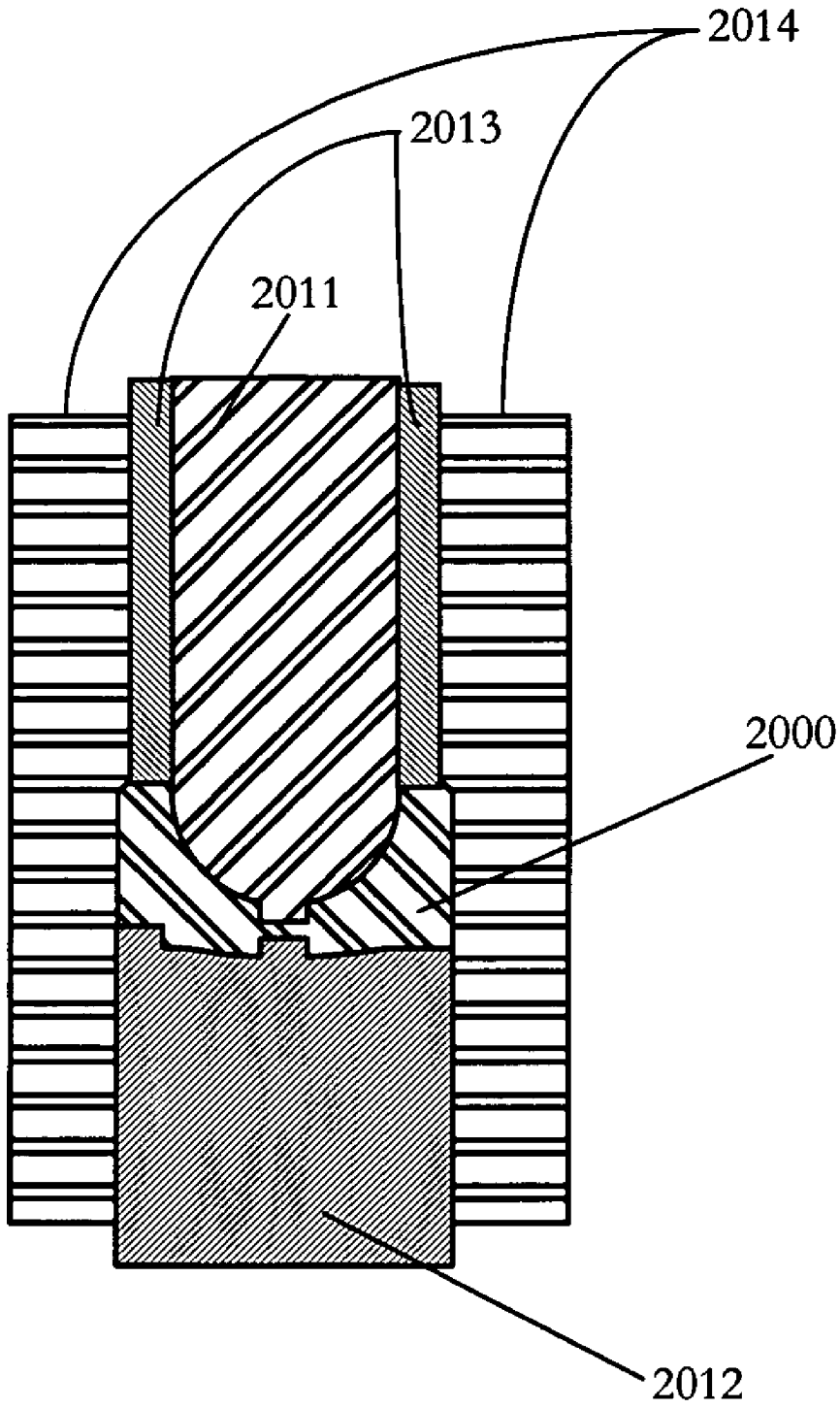

As depicted in FIG. 41, the fabrication of the passages 237, 238 is commenced through use of a punch pin 2011 and a fourth knock out pin 2012. A second stripper sleeve 2013 is used to remove the punch pin 2011 from the first socket surface 231. The fourth knock out pin 2012 is used to fabricate the plunger reservoir passage 238. A fourth die 2014 is used to prevent change to the outer socket surface 240 during the fabrication of the passages 237, 238.

Figure 42:
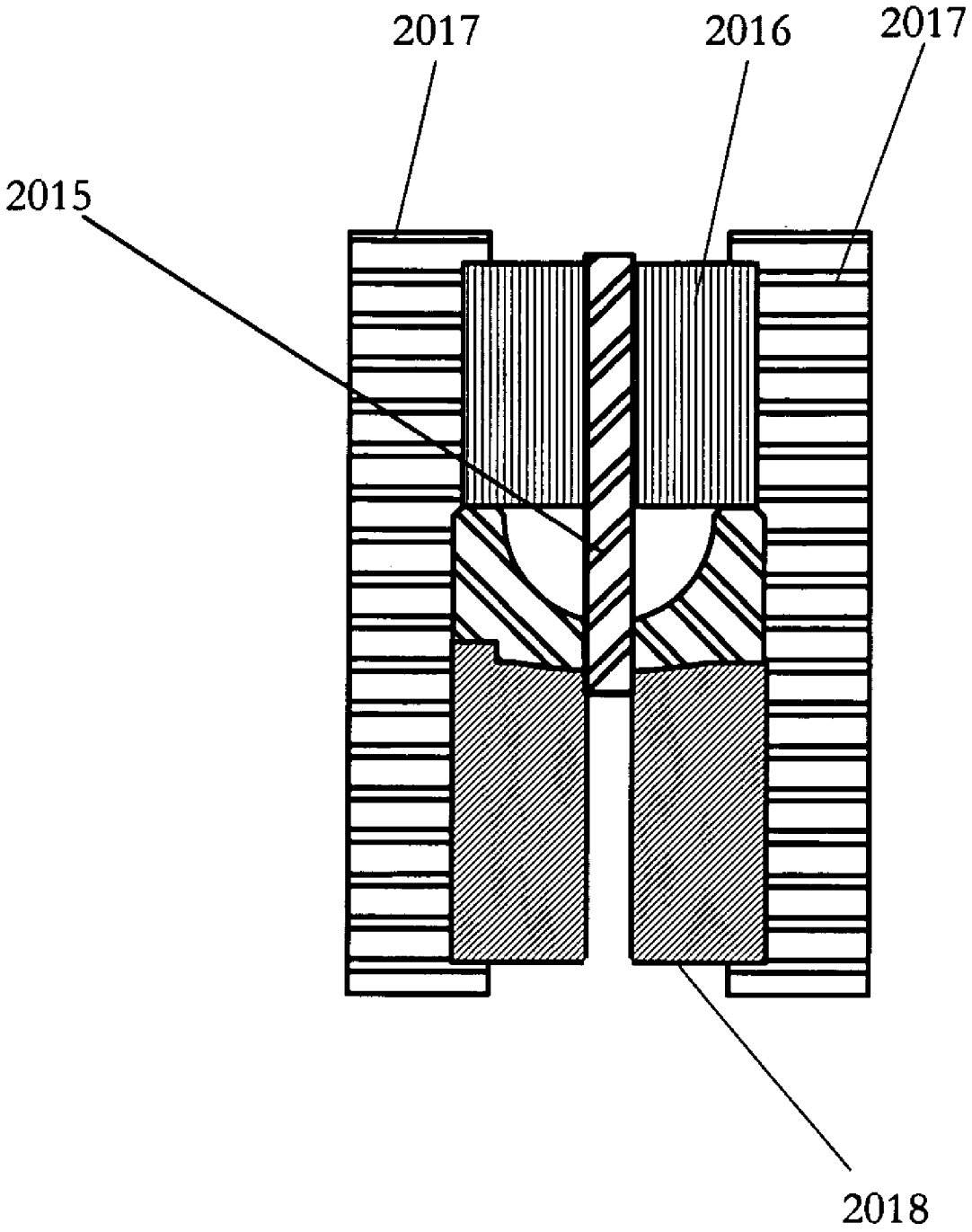

Referring now to FIG. 42, fabrication of socket passage 237 is completed through use of pin 2015. A third stripper sleeve 2016 is used to remove the pin 2015 from the first socket surface 231. A fifth die 2017 is used to prevent change to the outer socket surface 240 during the fabrication of socket passage 237. A tool insert 2018 is used to prevent change to the second socket surface 232 and the plunger reservoir passage 238 during the fabrication of socket passage 237.

Those skilled in the art will appreciate that further desirable finishing may be accomplished through machining. For example, passages 237, 238 may be enlarged and other passages may be drilled. However, such machining is not necessary.

Figure 43:
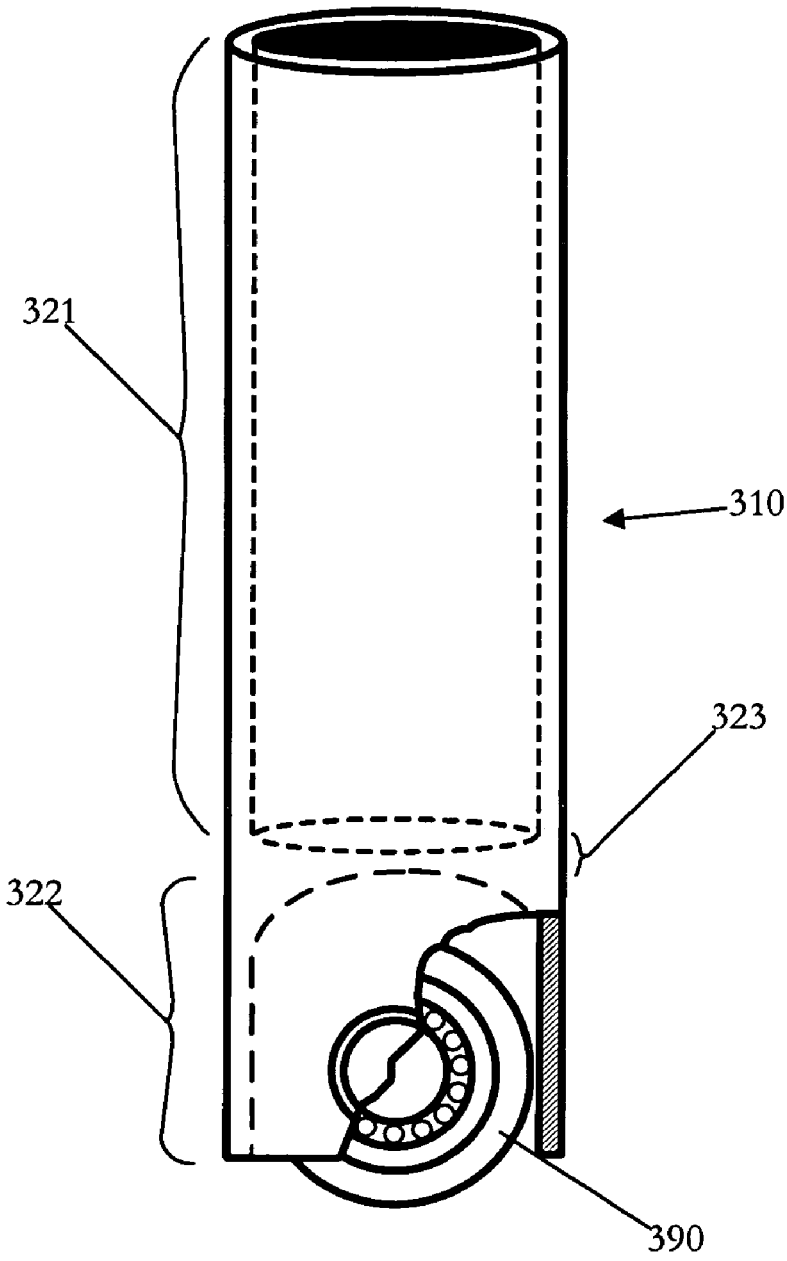
FIG. 43 depicts a preferred embodiment of a valve lifter body.
Figure 44:
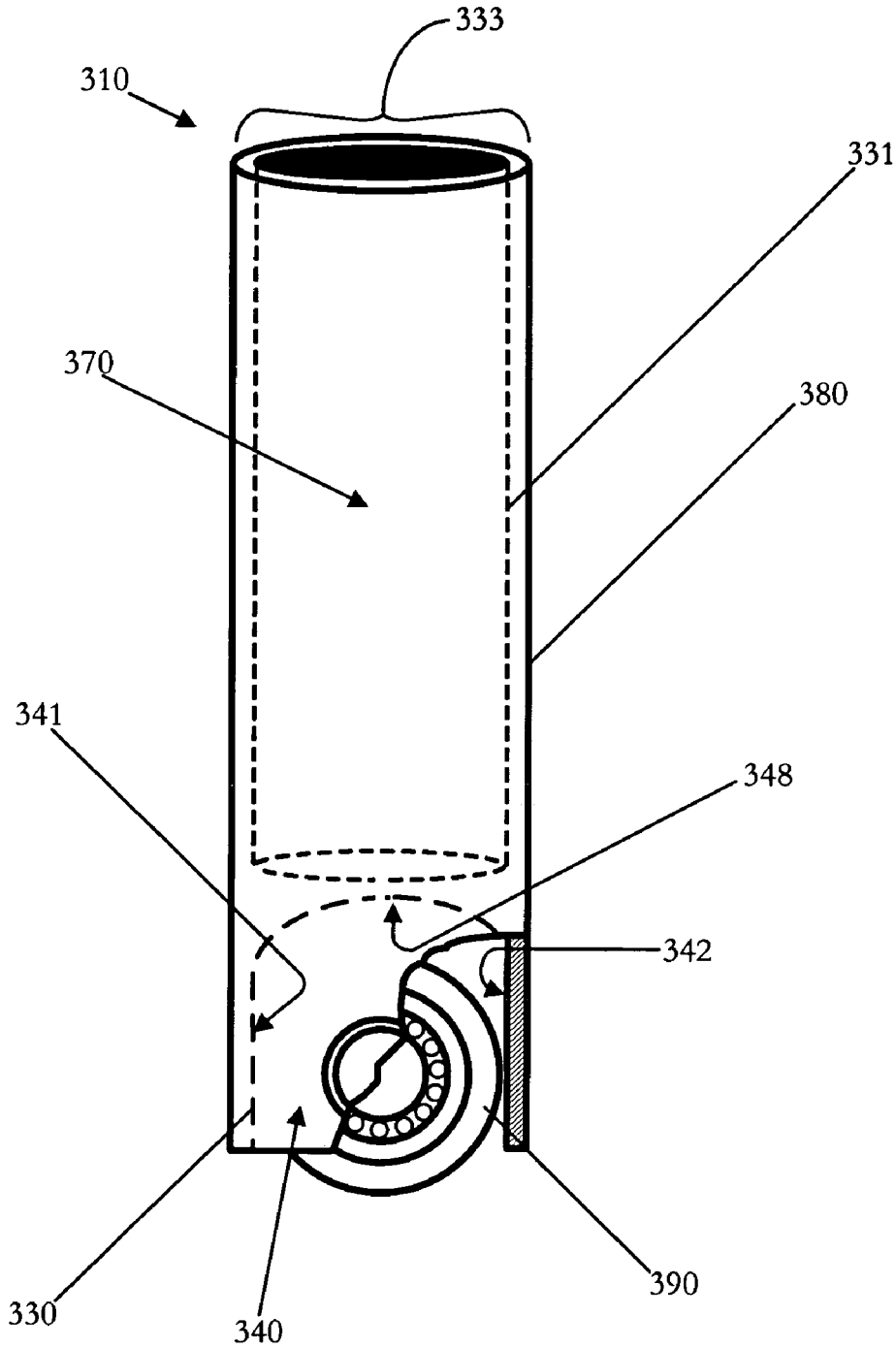
FIG. 44 depicts a preferred embodiment of a valve lifter body.
Figure 45:
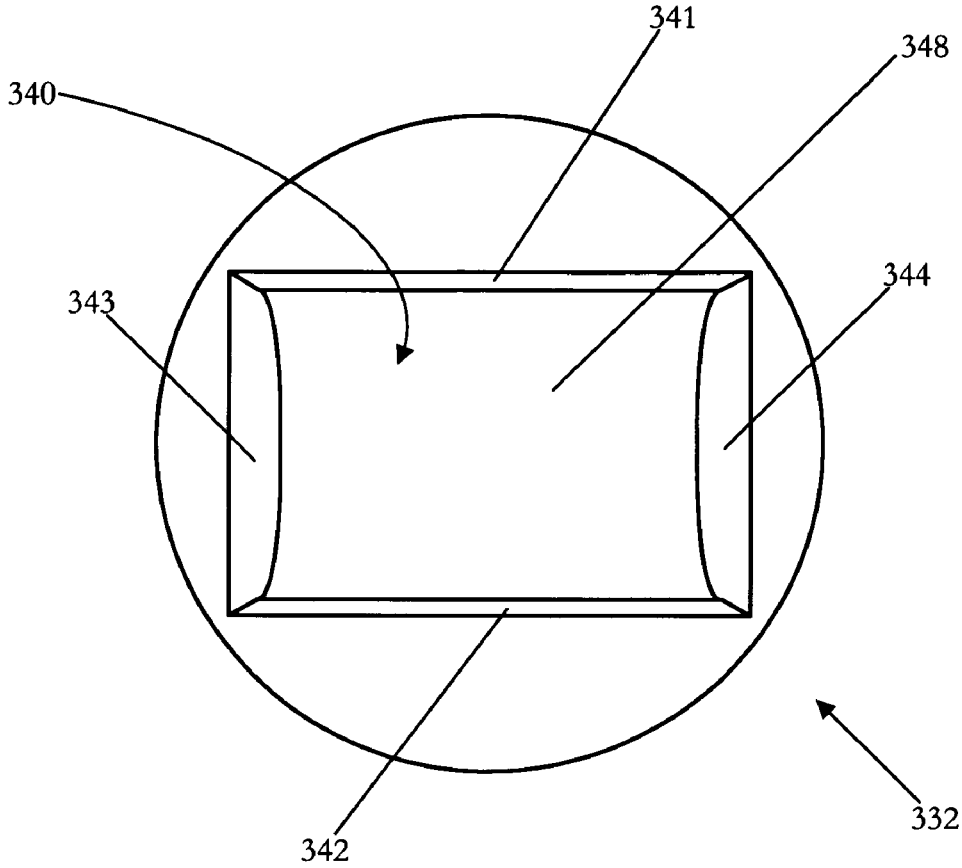
FIG. 45 depicts the top view of a preferred embodiment of a valve lifter body.

Turning now to the drawings, FIGS. 43, 44, and 45 show a preferred embodiment of the valve lifter body 310. The valve lifter 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter 310 is composed of pearlitic material. According to still another aspect of the present invention, the valve lifter 310 is composed of austenitic material. According to another aspect of the present invention, the metal is a ferritic material.

The valve lifter body 310 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 43 depicts a cross-sectional view of the valve lifter body 310 of the preferred embodiment of the present invention composed of a plurality of lifter elements. FIG. 43 shows the valve lifter body, generally designated 310, with a roller 390. The valve lifter body 310 of the preferred embodiment is fabricated from a single piece of metal wire or rod and is described herein as a plurality of lifter elements. The valve lifter body 310 includes a first hollow lifter element 321, a second hollow lifter element 322, and a solid lifter element 323. In the preferred embodiment, the solid lifter element 323 is located between the first hollow lifter element 321 and the second hollow lifter element 322.

The valve lifter body 310 functions to accommodate a plurality of inserts. According to one aspect of the present invention, the valve lifter body 310 accommodates a lash adjuster, such as the lash adjuster body 110. According to another aspect of the present invention, the valve lifter body 310 accommodates a leakdown plunger, such as the leakdown plunger 10. According to another aspect of the present invention, the valve lifter body 310 accommodates a push rod seat (not shown). According to yet another aspect of the present invention, the valve lifter body 310 accommodates a socket, such as the socket 210.

The valve lifter body 310 is provided with a plurality of outer surfaces and inner surfaces. FIG. 44 depicts a cross-sectional view of the valve lifter body 310 of the preferred embodiment of the present invention. As shown in FIG. 44, the valve lifter body 310 is provided with an outer lifter surface 380 which is cylindrically shaped. The outer lifter surface 380 encloses a plurality of cavities. As depicted in FIG. 44, the outer lifter surface 380 encloses a first lifter cavity 330 and a second lifter cavity 331. The first lifter cavity 330 includes a first inner lifter surface 340. The second lifter cavity 331 includes a second inner lifter surface 370.

FIG. 45 depicts a top view and provides greater detail of the first lifter cavity 330 of the preferred embodiment. As shown in FIG. 45, the first lifter cavity 330 is provided with a first lifter opening 332 shaped to accept a cylindrical insert. The first inner lifter surface 340 is configured to house a cylindrical insert 390, which, in the preferred embodiment of the present invention, functions as a roller. Those skilled in the art will appreciate that housing a cylindrical insert can be accomplished through a plurality of different configurations. The first inner lifter surface 340 of the preferred embodiment includes a curved surface and a plurality of walls. As depicted in FIG. 45, the inner lifter surface 340 includes a first lifter wall 341, a second lifter wall 342, a third lifter wall 343, and a fourth lifter wall 344. The first lifter wall 341 is adjacent to a curved lifter surface 348. The curved lifter surface 348 is adjacent to a second lifter wall 342. The third and fourth walls 343, 344 are located on opposing sides of the curved lifter surface 348.

Figure 54:
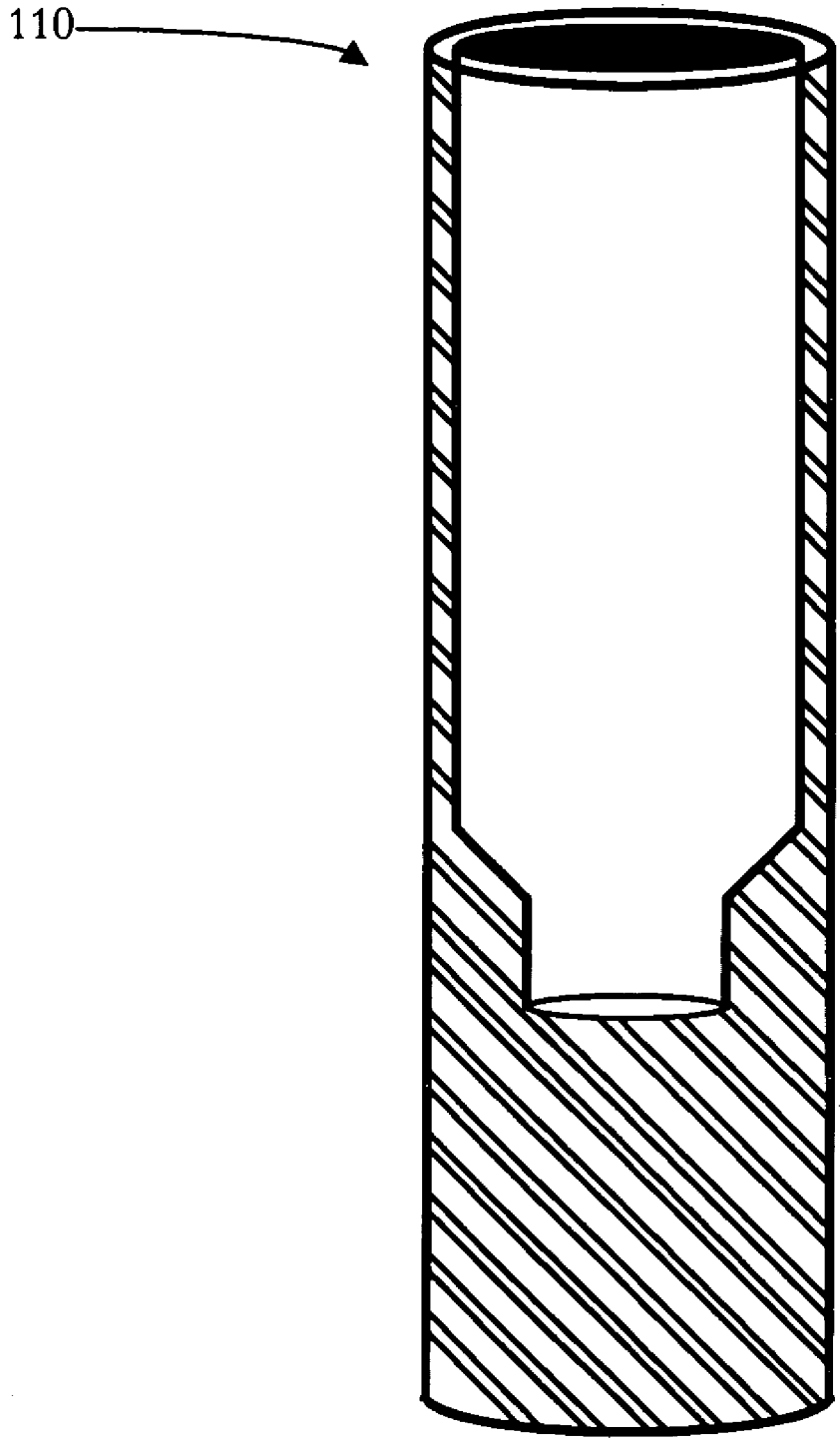
FIG. 54 depicts a lash adjuster body.

Referring to FIG. 44, the valve lifter body 310 of the present invention is provided with a second lifter cavity 331 which includes a second lifter opening 333 which is in a circular shape. The second lifter cavity 331 is provided with a second inner lifter surface 370. The second inner lifter surface 370 of the preferred embodiment is cylindrically shaped. Alternatively, the second inner lifter surface 370 is configured to house a lash adjuster generally designated 110 on FIG. 54. However, those skilled in the art will appreciate that the second inner lifter surface 370 can be conically or frustoconically shaped without departing from the spirit of the present invention.

The present invention is fabricated through a plurality of processes. According to one aspect of the present invention, the valve lifter body 310 is machined. According to another aspect of the present invention, the valve lifter body 310 is forged. According to yet another aspect of the present invention, the valve lifter body 310 is fabricated through casting. The valve lifter body 310 of the preferred embodiment of the present invention is forged. As used herein, the term "forge," "forging," or "forged" is intended to encompass what is known in the art as "cold forming," "cold heading," "deep drawing," and "hot forging."

The valve lifter body 310 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 310 preferably begins with a metal wire or metal rod which is drawn to size. The ends of the wire or rod are squared off by a punch. After being drawn to size, the wire or rod is run through a series of dies or extrusions. The second lifter cavity 331 is extruded through use of a punch and an extruding pin. After the second lifter cavity 331 has been extruded, the first lifter cavity 330 is forged. The first lifter cavity 330 is extruded through use of an extruding punch and a forming pin.

Alternatively, the valve lifter body 310 is fabricated through machining. As used herein, machining means the use of a chucking machine, a drilling machine, a grinding machine, or a broaching machine. Machining is accomplished by first feeding the valve lifter body 310 into a chucking machine, such as an ACME-Gridley automatic chucking machine. Those skilled in the art will appreciate that other machines and other manufacturers of automatic chucking machines can be used.

To machine the second lifter cavity 331, the end containing the second lifter opening 333 is faced so that it is substantially flat. The second lifter cavity 331 is bored. Alternatively, the second lifter cavity 331 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 331 is ground using an internal diameter grinding machine, such as a Heald grinding machine. Those skilled in the art will appreciate that the second lifter cavity 331 can be ground using other grinding machines.

Those skilled in the art will appreciate that the other features of the present invention may be fabricated through machining. For example, the first lifter cavity 330 can be machined. To machine the first lifter cavity 330, the end containing the first lifter opening 332 is faced so that it is substantially flat. The first lifter cavity 330 is drilled and then the first lifter opening 332 is broached using a broaching machine.

Figure 46:
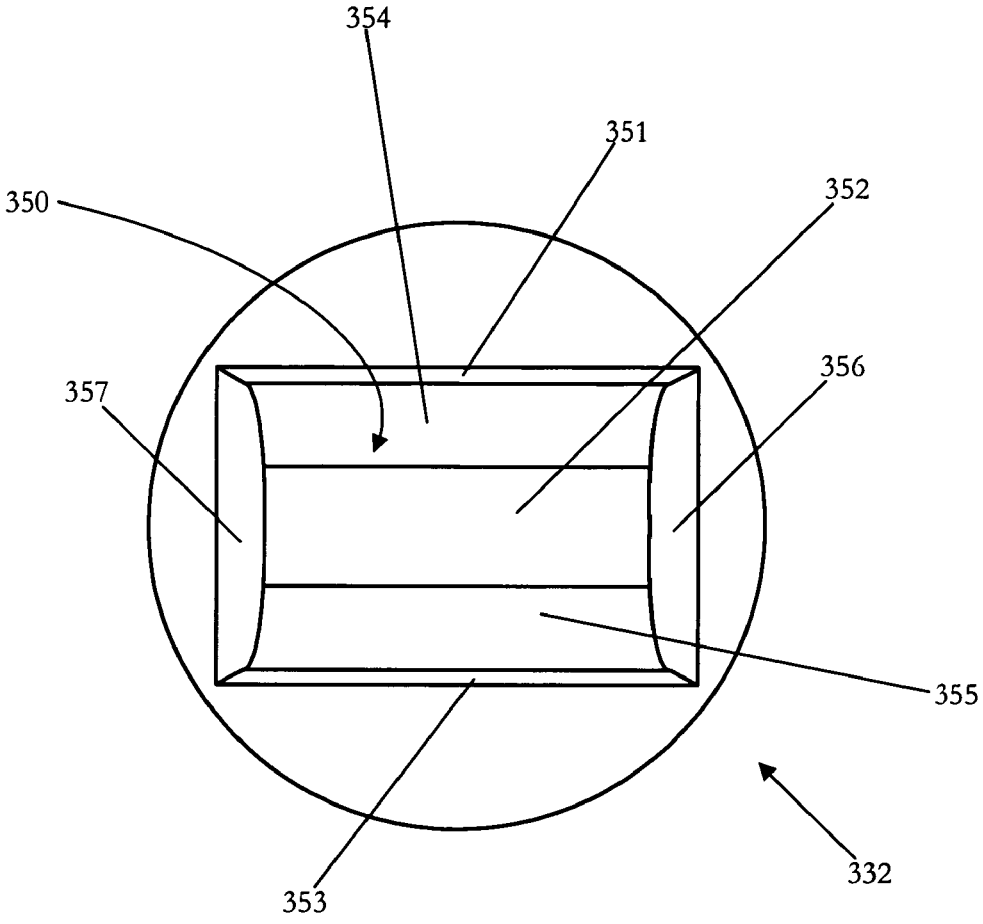
FIG. 46 depicts the top view of another preferred embodiment of a valve lifter body.

In an alternative embodiment of the present invention depicted in FIG. 46, the first lifter cavity 330 is provided with a first lifter opening 332 shaped to accept a cylindrical insert and a first inner lifter surface 350. The first inner lifter surface 350 includes a lifter surface, a plurality of curved surfaces, and a plurality of walls referred to herein as a first wall 351, a second wall 353, a third wall 356, and a fourth wall 357. As depicted in FIG. 46, the first wall 351 is adjacent to a first curved lifter surface 354. The first curved lifter surface 354 is adjacent to a lifter surface 352. The lifter surface 352 is adjacent to a second curved lifter surface 355. The second curved lifter surface 355 is adjacent to the second wall 353.

Figure 47:
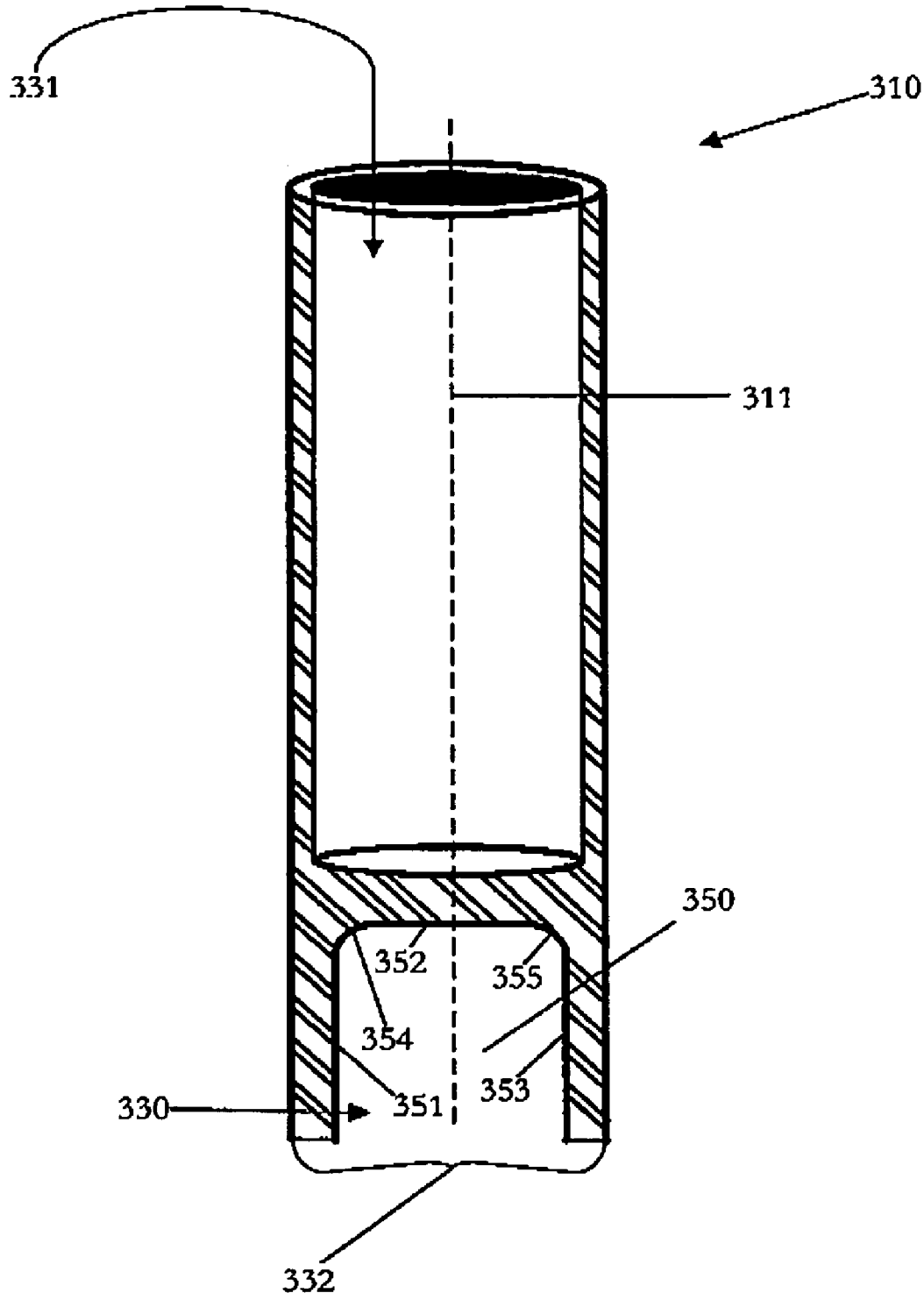
FIG. 47 depicts a second embodiment of a valve lifter body.

As depicted in FIG. 46, the third wall 356 and the fourth wall 357 are located on opposing, sides of the second wall 353. FIG. 47 depicts a cross-sectional view of the valve lifter body 310 with the first lifter cavity 330 shown in FIG. 46. As shown in FIG. 47, the lifter surface 352 preferably is, relative to the first and second curved surfaces 354, 355, generally flat in shape and oriented to be generally orthogonal to the valve lifter axis 311 of the valve lifter body 310.

Figure 48:
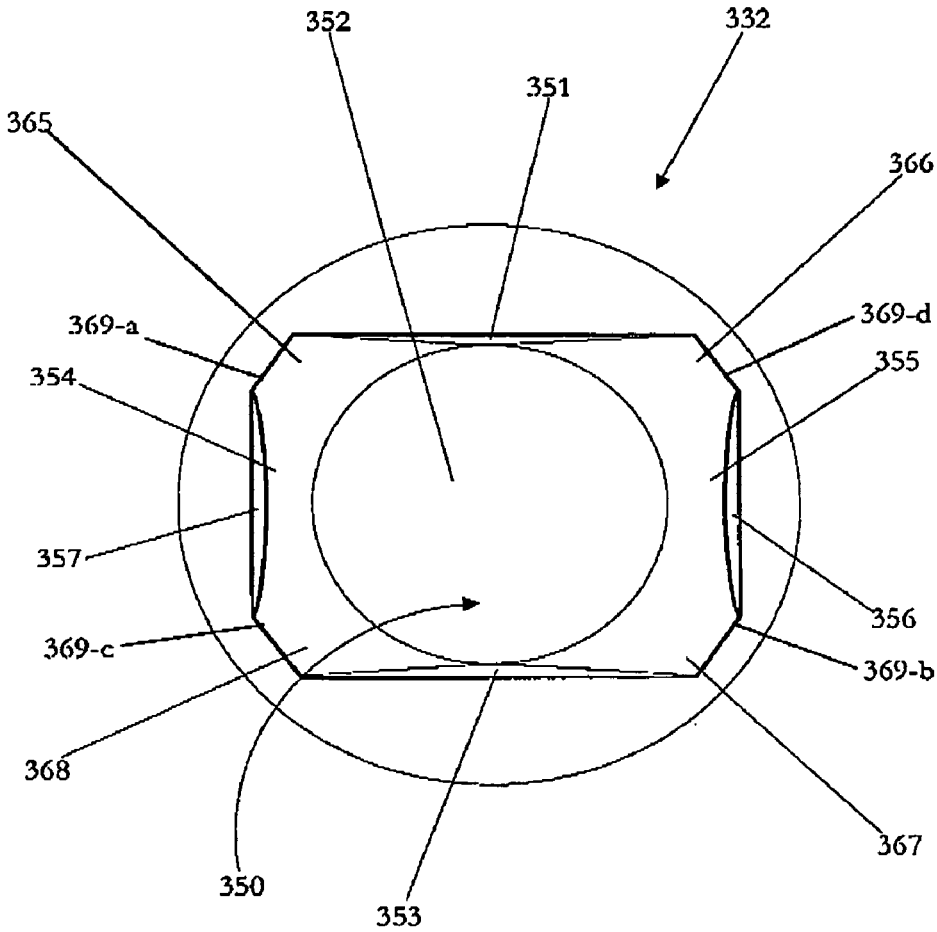
FIG. 48 depicts the top view of another preferred embodiment of a valve lifter body.
Figure 49:
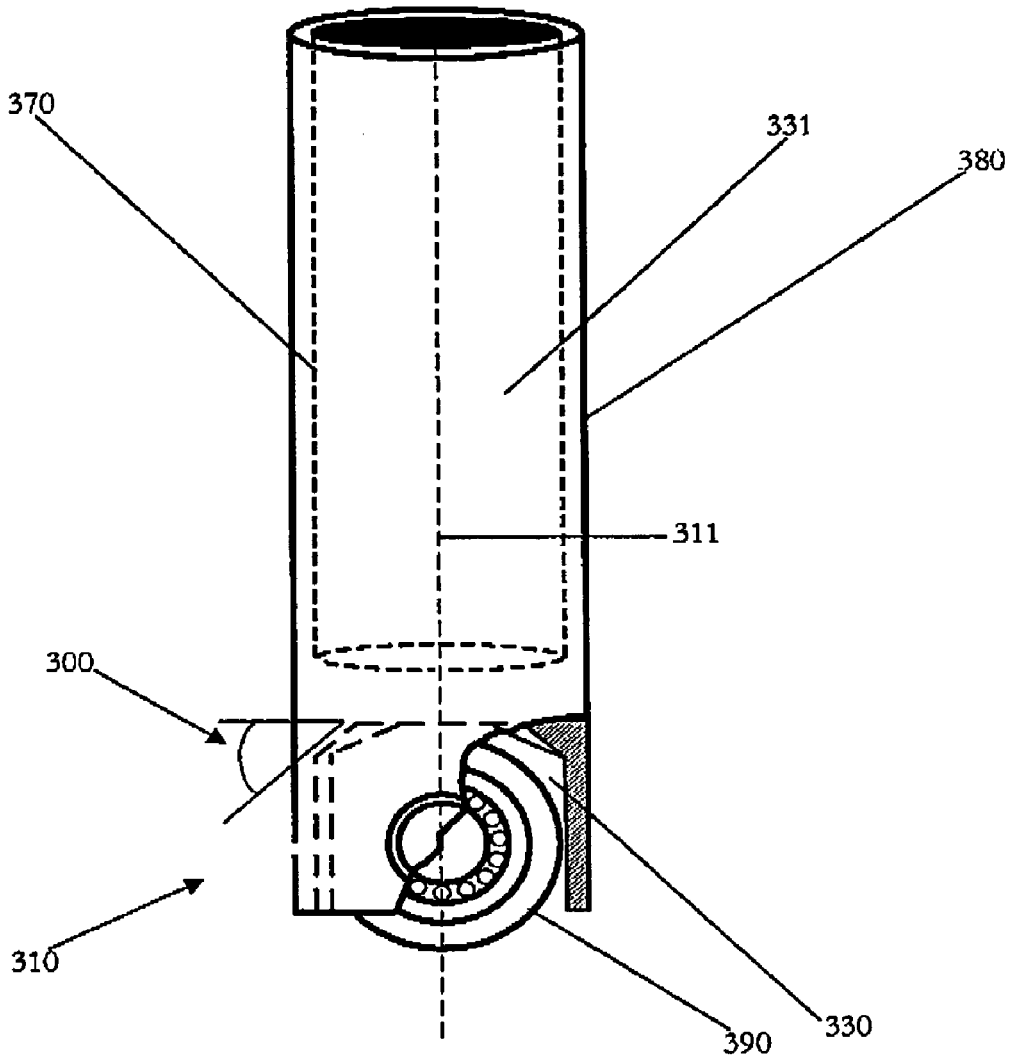
FIG. 49 depicts a third embodiment of a valve lifter body.

In another alternative embodiment of the present invention, as depicted in FIGS. 48 and 49, the first lifter cavity 330 is provided with a first lifter opening 332 shaped to accept a cylindrical insert and a first inner lifter surface 350. The first inner lifter surface 350 includes a plurality of walls referred to herein as a first wall 351, a second wall 353, a third wall 356, and a fourth wall 357. The first inner lifter surface 350 also includes a plurality of angled walls referred to herein as a first angled wall 369-*a*, a second angled wall 369-*b*, a third angled wall 369-*c*, and a fourth angled wall-*d*. Referring to FIG. 48, the first wall 351 is adjacent to a lifter surface 352, which is preferably circular in shape and oriented to be generally orthogonal to the valve lifter axis 311 of the valve lifter body 310. In FIG. 48, the first wall 351 is adjacent to a first angled lifter surface 365 and a second angled lifter surface 366. The first angled wall 369-*a*is shown extending axially into the valve lifter body 310 from the first lifter opening 332 and terminating at the first angled surface 165. The first angled lifter surface 365 is adjacent to the lifter surface 352 and a first curved lifter surface 354. As depicted in FIG. 49 the first angled lifter surface 365 is configured to be at an angle 300 relative to a plane that is generally orthogonal to the valve lifter axis 311 of the valve lifter body 310 (such as the plane of the annular lash adjuster surface 144). Advantageously, the angle 300 measures preferably between twenty-five and about ninety degrees.

The second angled lifter surface 366 is adjacent to the lifter surface 352. The fourth angled wall 369-*d* is shown extending axially into the valve lifter body 310 from the first lifter opening 332 and terminating at the second angled surface 366. As shown in FIG. 49, the second angled lifter surface 366 is configured to be at an angle 300 relative to a plane that is generally orthogonal to the valve lifter axis 311 of the valve lifter body 310 (such as the plane of the annular lash adjuster surface 144). Advantageously the angle 300 measures preferably between twenty-five and about ninety degrees. The second angled lifter surface 366 is adjacent to a second curved lifter surface 355. The second curved lifter surface 355 is adjacent to a third angled lifter surface 367 and a third wall 356. The third angled lifter surface 367 is adjacent to the lifter surface 352 and the second wall 353. The second angled wall 369-*b* is shown extending axially into the valve lifter body 310 from the first lifter opening 332 and terminating at the third angled surface 367. As depicted in FIG. 49, the third angled lifter surface 367 is configured to be at an angle 300 relative to a plane that is generally orthogonal to the valve lifter axis 311 of the valve lifter body 310 (such as the plane of the annular lash adjuster surface 144). Advantageously, the angle 300 measures preferably between twenty-five and about ninety degrees.

The second wall 353 is adjacent to a fourth angled lifter surface 368. The fourth angled lifter surface 368 adjacent to the first curved lifter surface 354 and a fourth wall 357. The third angled wall 369-*c* is shown extending axially into the valve lifter body 310 from first lifter opening 332 and terminating at the fourth angled surface 368. As depicted in FIG. 49, the fourth angled lifter surface 368 is configured to be at an angle 300 relative to a plane that is generally orthogonal to the valve lifter axis 311 of the valve lifter body 310 (such as the plan of the annular lash adjuster surface 344). Advantageously, the angle 300 measures preferably between twenty-five and about ninety degrees FIG. 49 depicts a cross-sectional view of an embodiment with the first lifter cavity 330 of FIG. 48.

Figure 50:
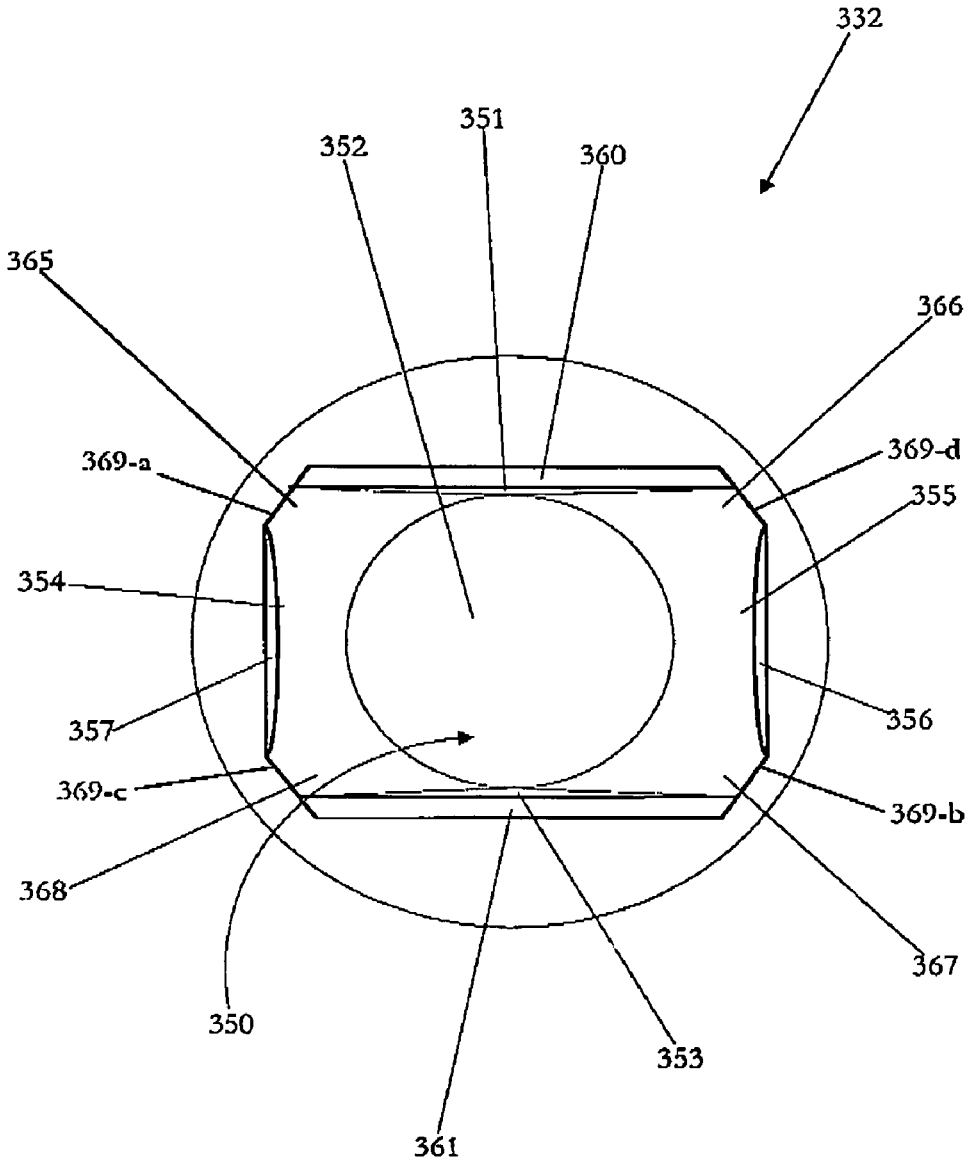
FIG. 50 depicts the top view of another preferred embodiment of a valve lifter body.

Shown in FIG. 50 is an alternative embodiment of the first lifter cavity 330 depicted in FIG. 48. In the embodiment depicted in FIG. 50, the first lifter cavity 330 is provided with a chamfered lifter opening 332 and a first inner lifter surface 350. The chamfered lifter opening 332 functions so that a cylindrical insert can be introduced to the valve lifter body 310 with greater ease. The chamfered lifter opening 332 accomplishes this function through lifter chamfers 360, 361 which are located on opposing sides of the chamfered lifter opening 332. The lifter chamfers 360, 361 of the embodiment shown in FIG. 50 are flat surfaces at an angle relative to the flat lifter surfaces 341, 342 so that a cylindrical insert 390 can be introduced through the first lifter opening 332 with greater ease. Those skilled in the art will appreciate that the lifter chamfers 360, 361 can be fabricated in a number of different configurations; so long as the resulting configuration renders introduction of a cylindrical insert 390 through the first lifter opening 332 with greater ease, it is a "chamfered lifter opening" within the spirit and scope of the present invention.

The lifter chamfers 360, 361 are preferably fabricated through forging via an extruding punch pin. Alternatively, the lifter chamfers 360, 361 are machined by being ground before heat-treating. Those skilled in the art will appreciate that other methods of fabrication can be employed within the scope of the present invention.

Figure 51:
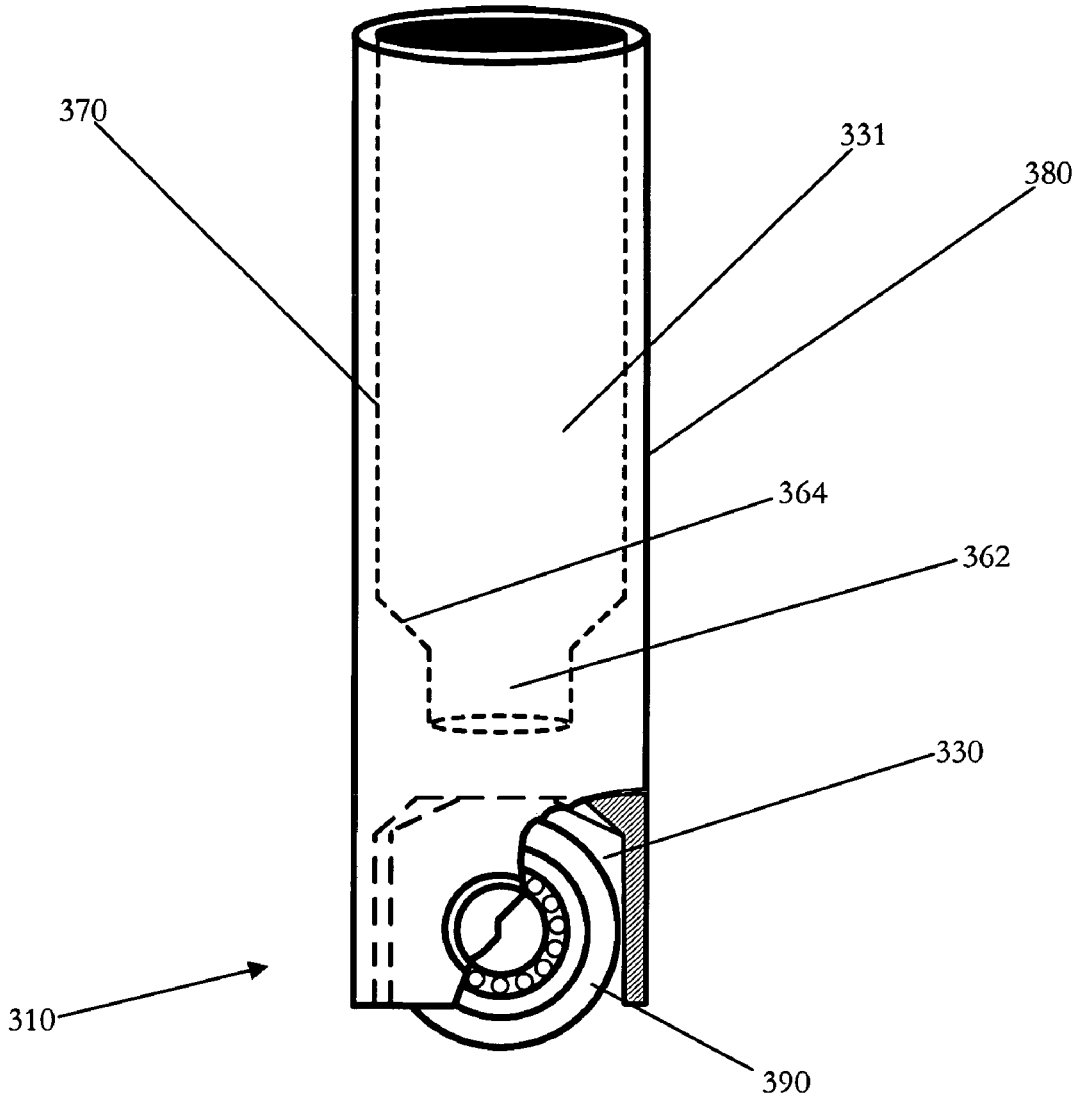
FIG. 51 depicts a fourth embodiment of a valve lifter body.

FIG. 51 discloses yet another alternative embodiment of the present invention. As depicted in FIG. 51, the valve lifter body 310 is provided with a second lifter cavity 331 which includes a plurality of cylindrical and conical surfaces. The second lifter cavity 331 depicted in FIG. 51 includes a second inner lifter surface 370. The second inner lifter surface 370 of the preferred embodiment is cylindrically shaped, concentric relative to the cylindrically shaped outer surface 380. The second inner lifter surface 370 is provided with a lifter well 362. The lifter well 362 is shaped to accommodate a spring (not shown). In the embodiment depicted in FIG. 51, the lifter well 362 is cylindrically shaped at a diameter that is smaller than the diameter of the second inner lifter surface 370. The cylindrical shape of the lifter well 362 is preferably concentric relative to the outer lifter surface 380. The lifter well 362 is preferably forged through use of an extruding die pin.

Alternatively, the lifter well 362 is machined by boring the lifter well 362 in a chucking machine. Alternatively, the lifter well 362 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 362 is ground using an internal diameter grinding machine, such as a Heald grinding machine. Those skilled in the art will appreciate that the lifter well 362 can be ground using other grinding machines.

Adjacent to the lifter well 362, the embodiment depicted in FIG. 51 is provided with a lead lifter surface 364 which can be fabricated through forging or machining. As shown therein the lead lifter surface is generally annular in shape and generally frusto-conical. However, those skilled in the art will appreciate that the present invention can be fabricated without the lead lifter surface 364.

Figure 52:
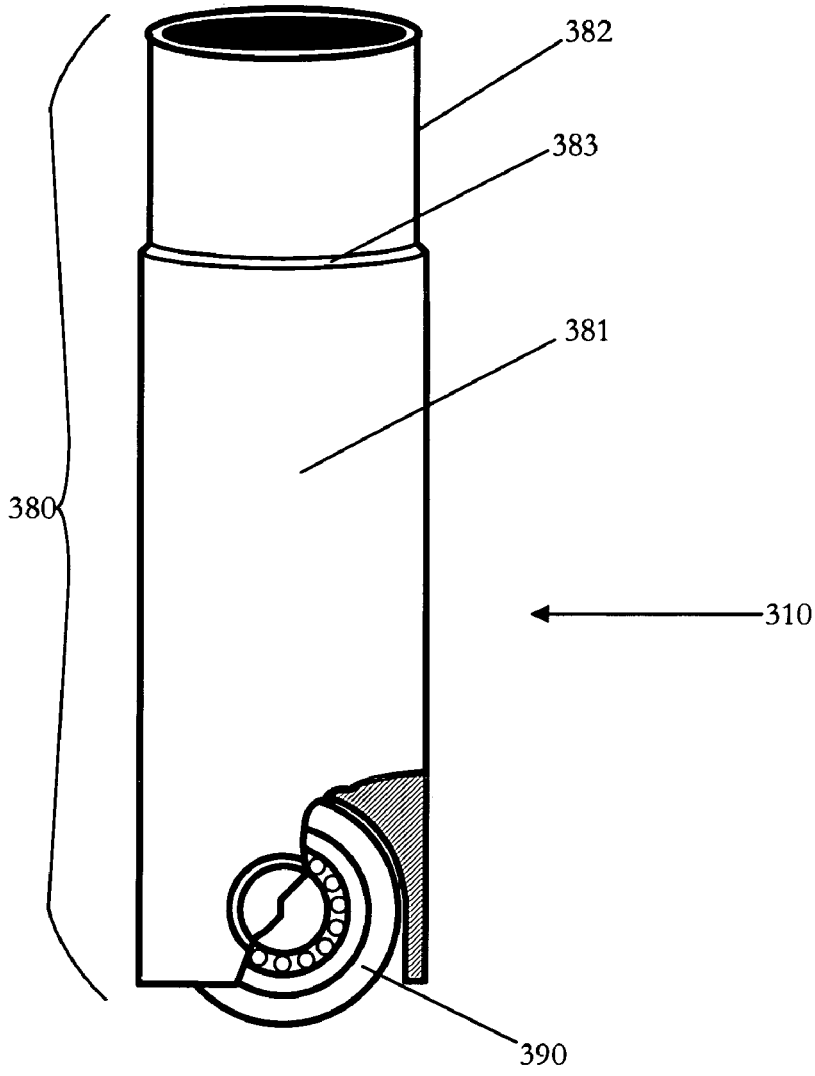
FIG. 52 depicts a fourth embodiment of a valve lifter body.

Depicted in FIG. 52 is another alternative embodiment of the present invention. As shown in FIG. 52, the valve lifter body 310 is provided with an outer lifter surface 380. The outer lifter surface 380 includes a plurality of surfaces. In the embodiment depicted in FIG. 52, the outer lifter surface 380 includes a cylindrical lifter surface 381, an undercut lifter surface 382, and a conical lifter surface 383. As depicted in FIG. 52, the undercut lifter surface 382 extends from one end of the valve lifter body 310 and is cylindrically shaped. The diameter of the undercut lifter surface 382 is smaller than the diameter of the cylindrical lifter surface 381.

The undercut lifter surface 382 is preferably forged through use of an extruding die. Alternatively, the undercut lifter surface 382 is fabricated through machining. Machining the undercut lifter surface 382 is accomplished through use of an infeed centerless grinding machine, such as a Cincinnati grinder. The surface is first heat-treated and then the undercut lifter surface 382 is ground via a grinding wheel. Those skilled in the art will appreciate that additional surfaces can be ground into the outer lifter surface 380 with minor alterations to the grinding wheel.

As depicted in FIG. 52, the conical lifter surface 383 is located between the cylindrical lifter surface 381 and the undercut lifter surface 382. The conical lifter surface 383 is preferably forged through use of an extruding die. Alternatively, the conical lifter surface 383 is fabricated through machining. Those with skill in the art will appreciate that the outer lifter surface 380 can be fabricated without the conical lifter surface 383 so that the cylindrical lifter surface 381 and the undercut lifter surface 382 abut one another.

Figure 53:
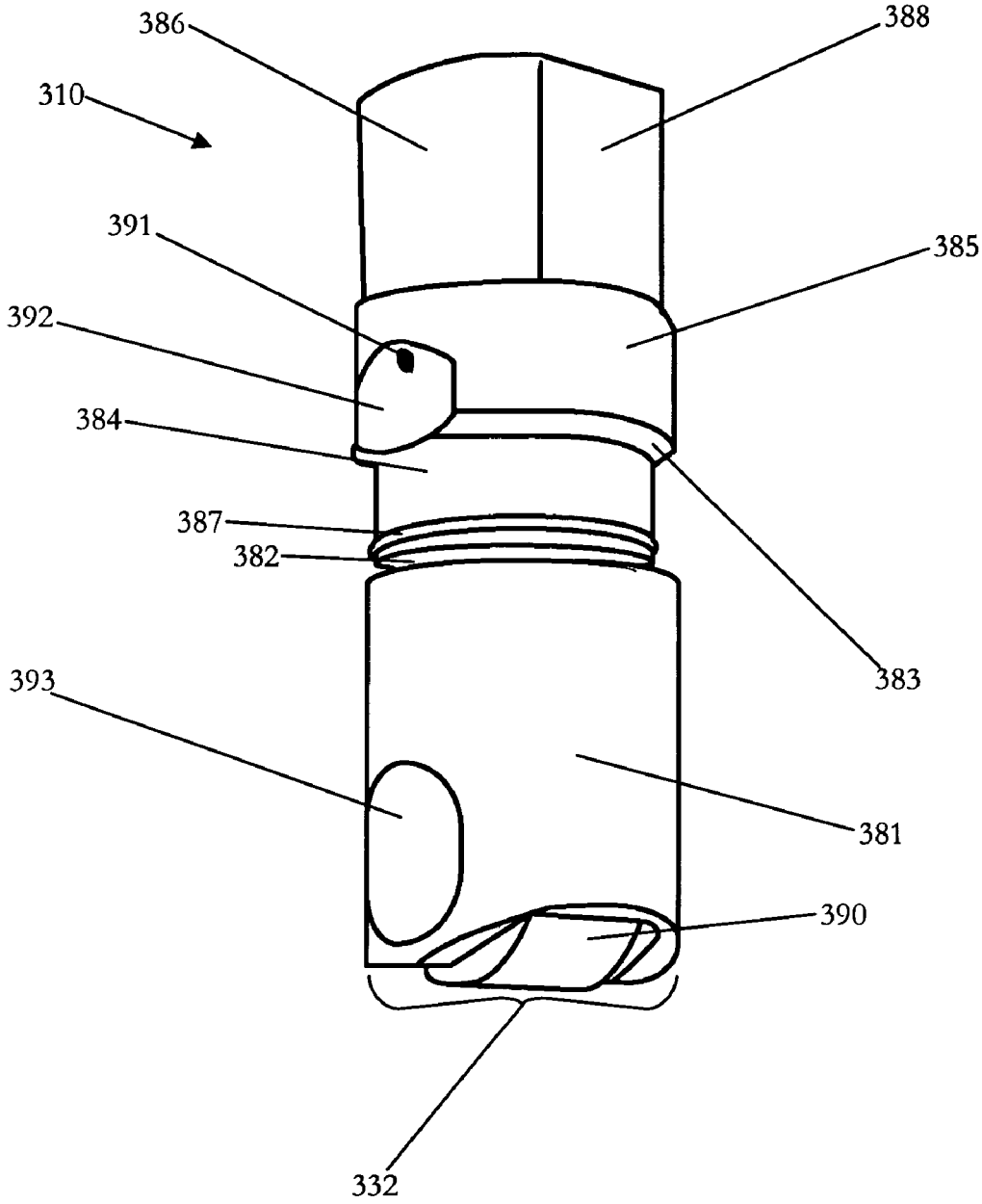
FIG. 53 depicts a fifth embodiment of a valve lifter body.

FIG. 53 depicts another embodiment valve lifter body 310 of the present invention. In the embodiment depicted in FIG. 53, the outer lifter surface 380 includes a plurality of outer surfaces. The outer lifter surface 380 is provided with a first cylindrical lifter surface 381. The first cylindrical lifter surface 381 contains a first lifter depression 393. Adjacent to the first cylindrical lifter surface 381 is a fifth cylindrical lifter surface 382. The fifth cylindrical lifter surface 382 has a radius which is smaller than the radius of the first cylindrical lifter surface 381. The fifth cylindrical lifter surface 382 is adjacent to a second cylindrical lifter surface 384. The second cylindrical lifter surface 384 has a radius which is greater than the radius of the fifth cylindrical lifter surface 382. The second cylindrical lifter surface 384 contains a lifter ridge 387. Adjacent to the second cylindrical lifter surface 384 is a conical lifter surface 383. The conical lifter surface 383 is adjacent to a third cylindrical lifter surface 385. The third cylindrical lifter surface 385 and the conical lifter surface 383 contain a second lifter depression 392. The second lifter depression 392 defines a lifter hole 391. Adjacent to the third cylindrical lifter surface 385 is a flat outer lifter surface 388. The flat outer lifter surface 388 is adjacent to a fourth cylindrical lifter surface 386.

Those skilled in the art will appreciate that the features of the valve lifter body 310 may be fabricated through a combination of machining, forging, and other methods of fabrication. By way of example and not limitation, the first lifter cavity 330 can be machined while the second lifter cavity 331 is forged. Conversely, the second lifter cavity 331 can be machined while the first lifter cavity 330 is forged.

Figure 55:
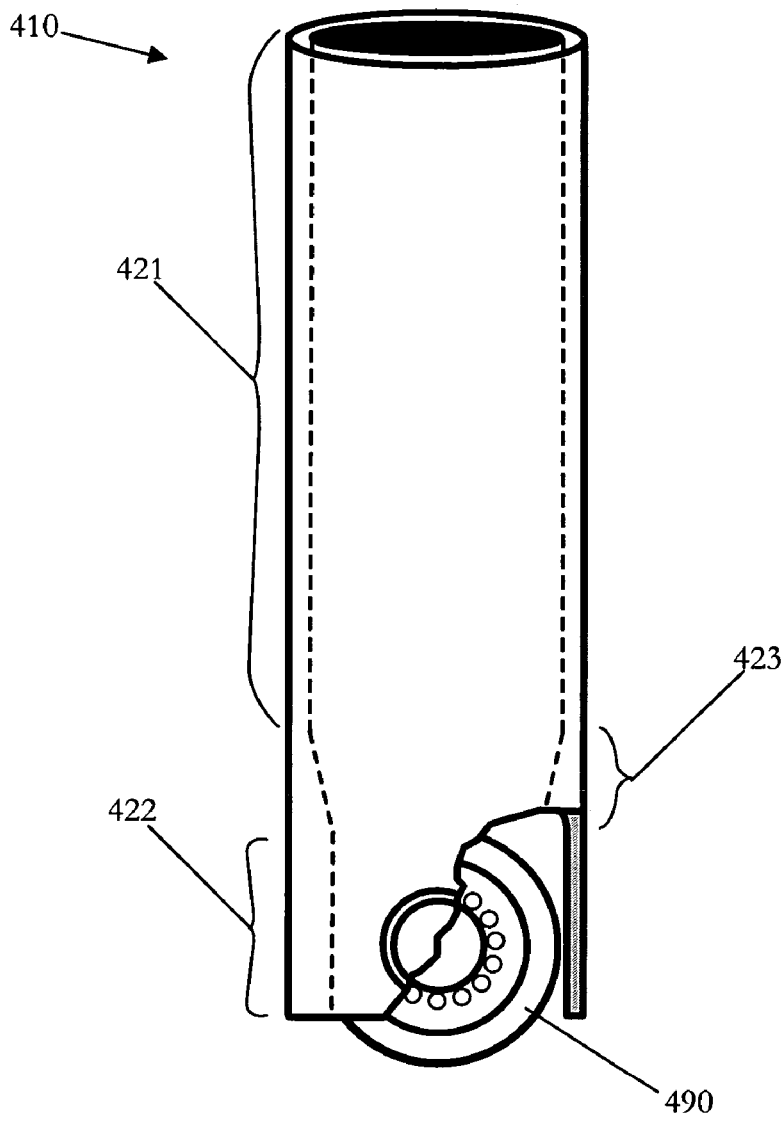
FIG. 55 depicts a preferred embodiment of a roller follower body.
Figure 56:
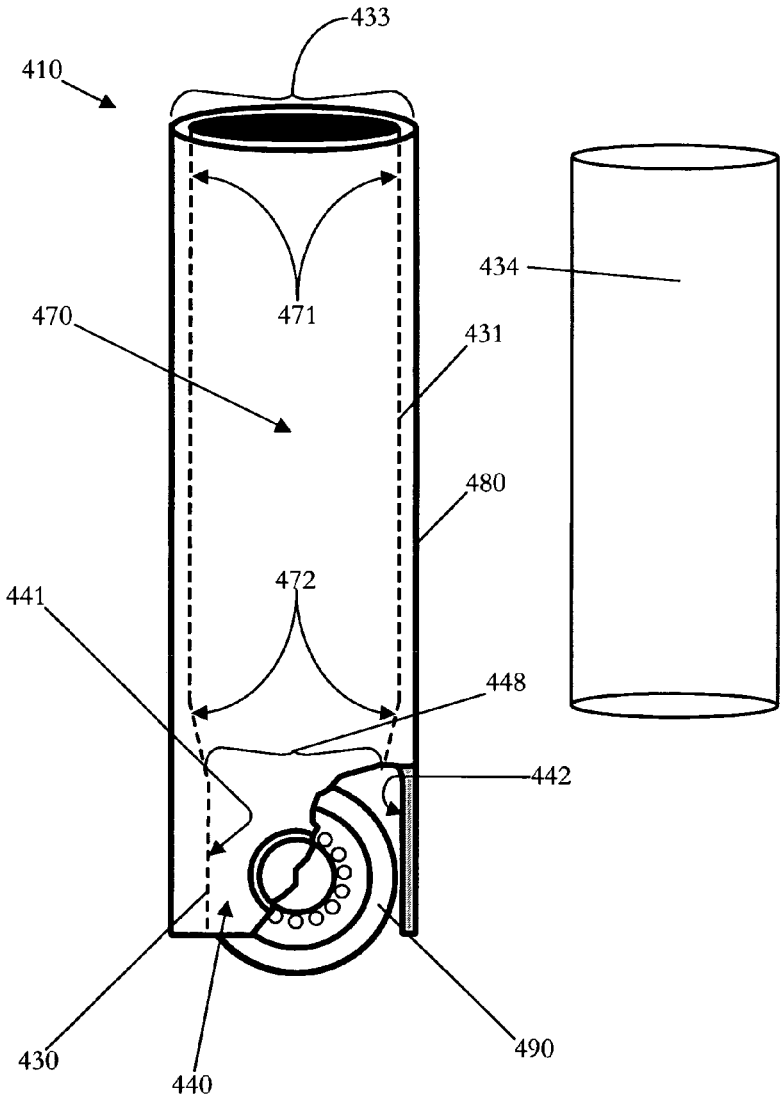
FIG. 56 depicts a preferred embodiment of a roller follower body.

Turning now to the drawings, FIGS. 55 and 56 show a preferred embodiment of the roller follower body 410. The roller follower body 410 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the roller follower body 410 is composed of pearlitic material. According to still another aspect of the present invention, the roller follower body 410 is composed of austenitic material. According to another aspect of the present invention, the metal is a ferritic material.

The roller follower body 410 is composed of a plurality of roller elements. According to one aspect of the present invention, the roller element is cylindrical in shape. According to another aspect of the present invention, the roller element is conical in shape. According to yet another aspect of the present invention, the roller element is solid. According to still another aspect of the present invention, the roller element is hollow.

FIG. 55 depicts a cross-sectional view of the roller follower body 410 composed of a plurality of roller elements. FIG. 55 shows the roller follower body, generally designated 410. The roller follower body 410 of the preferred embodiment is fabricated from a single piece of metal wire or rod and is described herein as a plurality of roller elements. The roller follower body 410 includes a first hollow roller element 421, a second hollow roller element 422, and a third hollow roller element 423. As depicted in FIG. 55, the first hollow roller element 421 is located adjacent to the third hollow roller element 423. The third hollow roller element 423 is located adjacent to the second hollow roller element 422.

The first hollow roller element 421 has a cylindrically shaped inner surface. The second hollow roller element 422 has a cylindrically shaped inner surface with a diameter which is smaller than the diameter of the first hollow roller element 421. The third hollow roller element 423 has an inner surface shaped so that an insert (not shown) rests against its inner surface "above" the second hollow roller element 422. Those skilled in the art will understand that, as used herein, terms like "above" and terms of similar import are used to specify general relationships between parts, and not necessarily to indicate orientation of the part or of the overall assembly. In the preferred embodiment, the third hollow roller element 423 has a conically or frustoconically shaped inner surface; however, an annularly shaped surface could be used without departing from the scope of the present invention.

The roller follower body 410 functions to accommodate a plurality of inserts. According to one aspect of the present invention, the roller follower body 410 accommodates a lash adjuster, such as the lash adjuster body 110. According to another aspect of the present invention, the roller follower body 410 accommodates a leakdown plunger, such as the leakdown plunger 210. According to another aspect of the present invention, the roller follower body 410 accommodates a push rod seat (not shown). According to yet another aspect of the present invention, the roller follower body 410 accommodates a socket, such as the metering socket 10.

The roller follower body 410 is provided with a plurality of outer surfaces and inner surfaces. FIG. 56 depicts a cross-sectional view of the roller follower body 410 of the preferred embodiment. As shown therein, the roller follower body 410 is provided with an outer roller surface 480 which is cylindrically shaped. The outer surface 480 encloses a plurality of cavities. As depicted in FIG. 56, the outer surface 480 encloses a first cavity 430 and a second cavity 431. The first cavity 430 includes a first inner surface 440. The second cavity 431 includes a second inner surface 470.

Figure 57A:
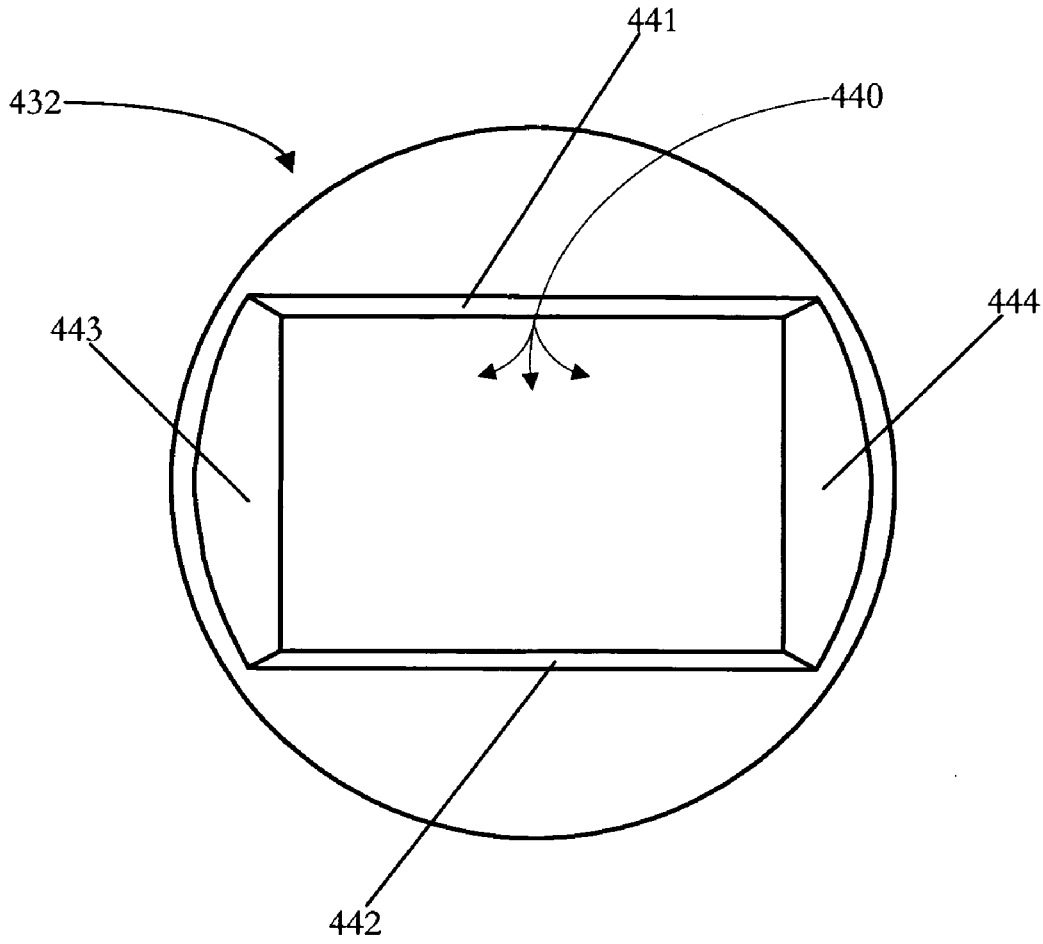
FIG. 57-*a* depicts the top view of a preferred embodiment of a roller follower body.
Figure 57B:
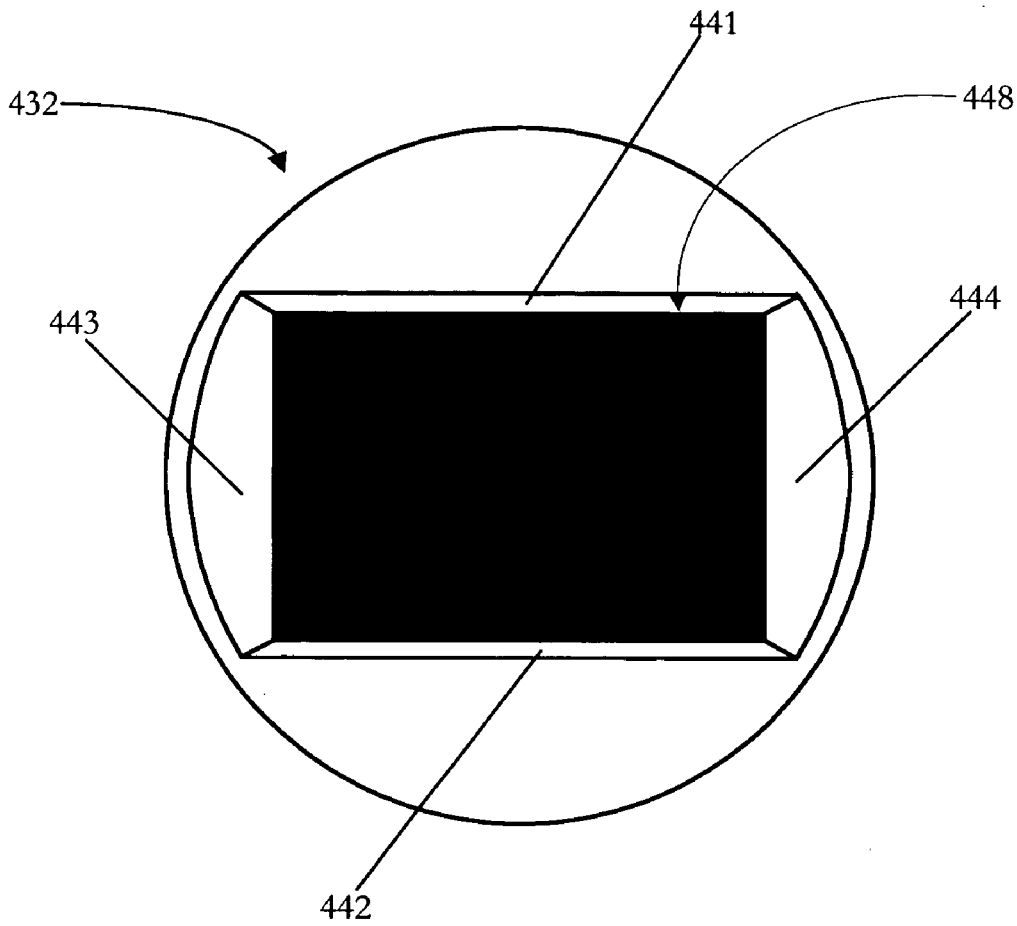

FIG. 57*a* and FIG. 57*b* depict top views and provide greater detail of the first roller cavity 430 of tire preferred embodiment. As shown in FIG. 57*b*, the first roller cavity 430 is provided with a first roller opening 432 shaped to accept a cylindrical insert. Referring to FIG. 57*a* the first inner roller surface 440 is configured to house a cylindrical insert 490, which, in the preferred embodiment of the present invention, functions as a roller. Those skilled in the art will appreciate that housing a cylindrical insert can be accomplished through a plurality of different configurations. In FIGS. 57*a* and 57*b*, the first inner roller surface 440 of the preferred embodiment includes a plurality of walls. As depicted in FIGS. 57*a* and 57*b*, the inner roller surface 440 defines a transition or transition roller opening 448 which is in the shape of a polygon, the preferred embodiment being rectangular. The inner roller surface 440 includes opposing roller walls 441, 442 and opposing roller walls 443, 444. The first roller wall 441 and the second toilet wall 442 are located generally on opposite sides of the transition roller opening 448. The transition roller opening 448 is further defined by the third and fourth roller walls 443, 444.

Referring now to FIG. 56, the second roller cavity 431 of the preferred embodiment includes a second roller opening 433 that is in a circular shape. The second roller cavity 431 is provided with a second inner roller surface 470 that is configured to house an inner body 434. In the preferred embodiment the inner body 434 is the lash adjuster body 110. The second inner roller surface 470 of the preferred embodiment is cylindrically shaped. Alternatively, the second inner roller surface 470 is conically or frustoconically shaped. As depicted in FIG. 56, the second inner roller surface 470 is a plurality of surfaces including a cylindrically shaped roller surface 471 adjacent to a conically or frustoconically shaped roller surface 472.

The present invention is fabricated through a plurality of processes. According to one aspect of the present invention, the roller follower body 410 is machined. According to another aspect of the present invention, the roller follower body 410 is forged. According to yet another aspect of the present invention, the roller follower body 410 is fabricated through casting. The preferred embodiment of the present invention is forged. As used herein, the term "forge," "forging," or "forged" is intended to encompass what is known in the art as "cold forming," "cold heading," "deep drawing," and "hot forging."

The roller follower body 410 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging in the preferred embodiment begins with a metal wire or metal rod which is drawn to size. The ends of the wire or rod are squared off by a punch. After being drawn to size, the wire or rod is run through a series of dies or extrusions.

The second roller cavity 431 is extruded through use of a punch and an extruding pin. After the second roller cavity 431 has been extruded, the first roller cavity 430 is forged. The first roller cavity 430 is extruded through use of an extruding punch and a forming pin.

Alternatively, the roller follower body 410 is fabricated through machining. As used herein, machining means the use of a chucking machine, a drilling machine, a grinding machine, or a broaching machine. Machining is accomplished by first feeding the roller follower body 410 into a chucking machine, such as an ACME-Gridley automatic chucking machine. Those skilled in the art will appreciate that other machines and other manufacturers of automatic chucking machines can be used.

To machine the second roller cavity 431, the end containing the second roller opening 433 is faced so that it is substantially flat. The second roller cavity 431 is bored. Alternatively, the second roller cavity 431 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second roller cavity 431 is ground using an internal diameter grinding machine, such as a Heald grinding machine. Those skilled in the art will appreciate that the second roller cavity 431 can be ground using other grinding machines.

Those skilled in the art will appreciate that the other features of the present invention may be fabricated through machining. For example, the first roller cavity 430 can be machined. To machine the first roller cavity 430, the end containing the first roller opening 432 is faced so that it is substantially flat. The first roller cavity 430 is drilled and then the first roller opening 432 is broached using a broaching machine.

Figure 58:
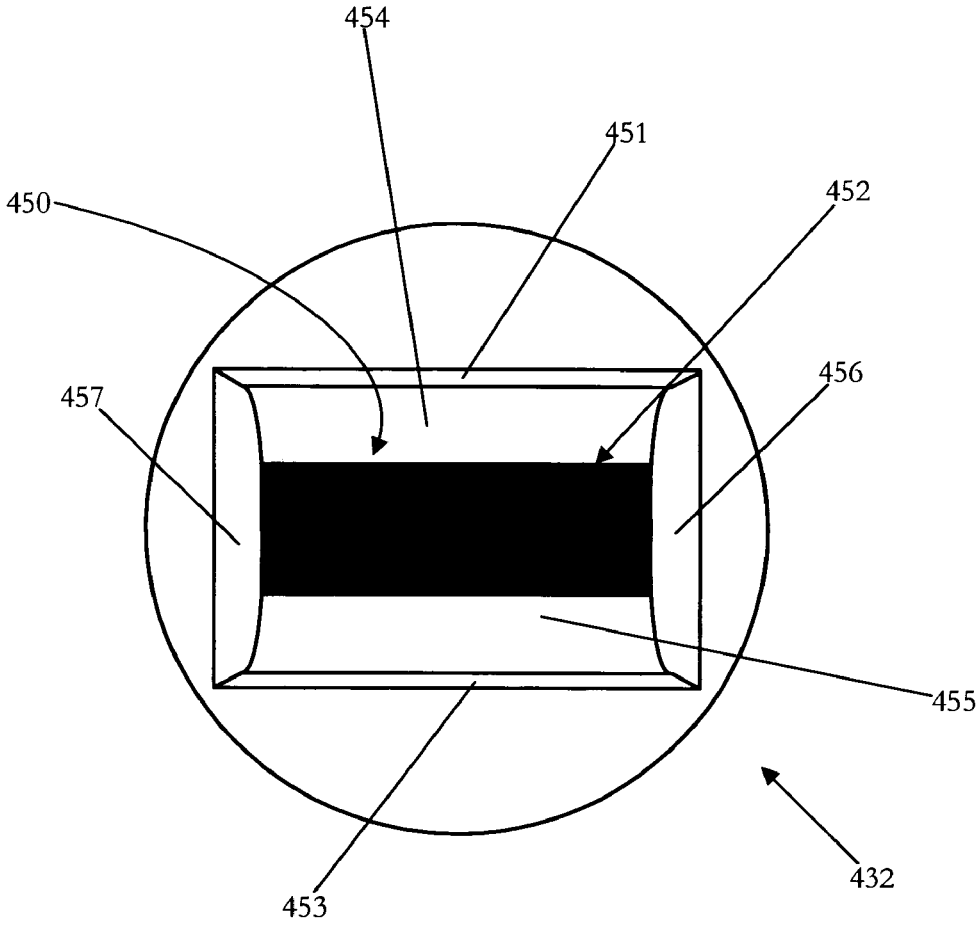
FIG. 58 depicts the top view of another preferred embodiment of a roller follower body.

In an alternative embodiment depicted in FIG. 58, the first roller cavity 430 is provided with a first inner roller surface 450 and first roller opening 432 shaped to accept a cylindrical insert 490. The first inner roller surface 450 defines a transition roller opening 452 and includes a plurality of curved surfaces and a plurality of walls. As depicted in FIG. 58, a first wall 451 is adjacent to a first curved roller surface 454. The first curved roller surface 454 and a second curved roller surface 455 are located on opposing sides of the transition roller opening 452. The second curved roller surface 455 is adjacent to a second wall 453. On opposing sides of the first and second walls 451, 453 are third and fourth walls 456, 457.

Figure 59:
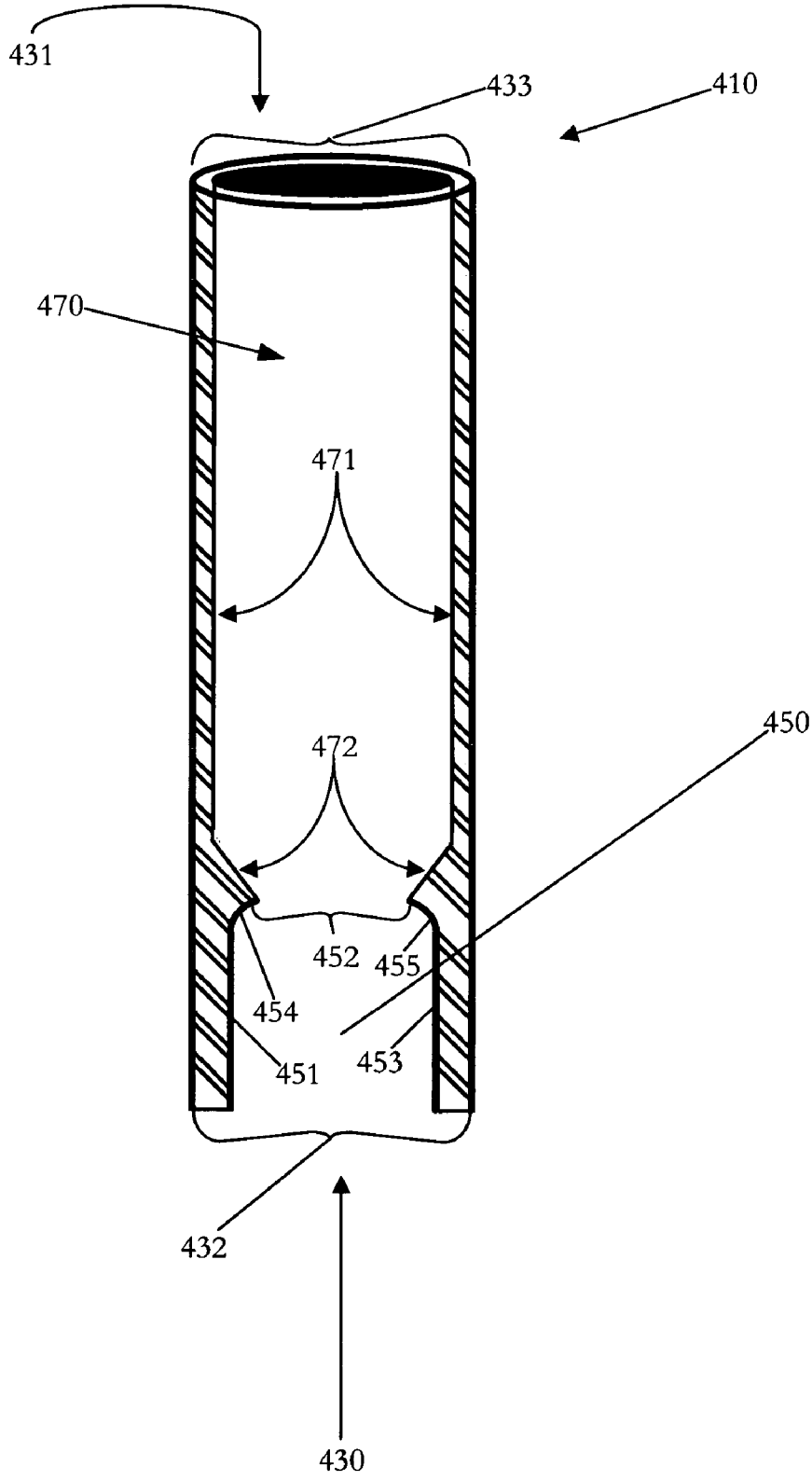
FIG. 59 depicts a second embodiment of a roller follower body.

FIG. 59 depicts a cross-sectional view of the roller follower body 410 with the first roller cavity 430 shown in FIG. 59. As shown in FIG. 59, the roller follower body 410 is also provided with a second cavity 431 which includes a second opening 433 which is in a circular shape. The second cavity 431 is provided with a second inner roller surface 470 which includes a plurality of surfaces. The second inner roller surface 470 includes a cylindrically shaped roller surface 471 and a frustoconically shaped roller surface 472.

Figure 60:
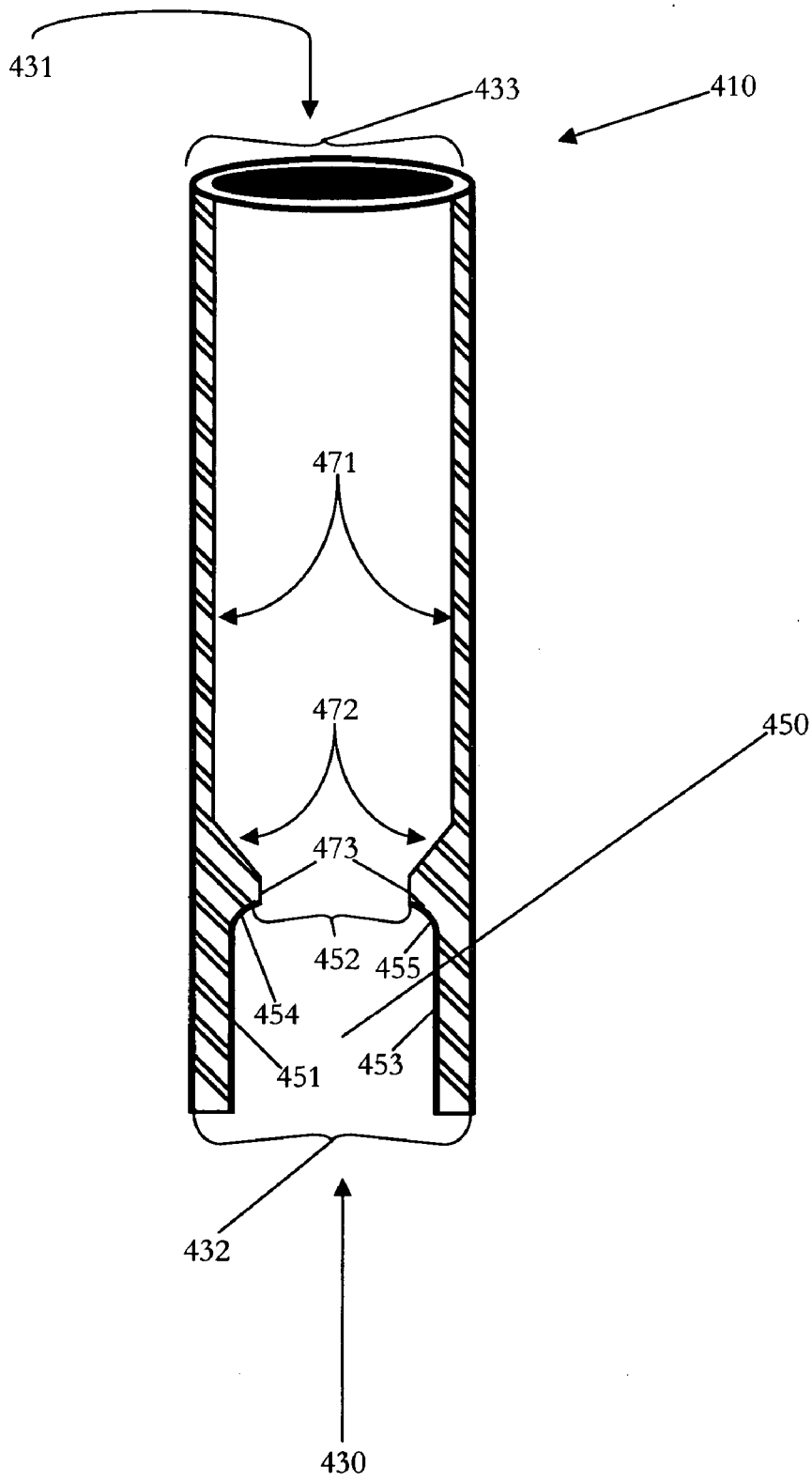
FIG. 60 depicts a third embodiment of a roller follower body.

Alternatively, the second inner roller surface 470 includes a plurality of cylindrical surfaces. As depicted in FIG. 60, the second inner roller surface 470 includes a first cylindrical roller surface 471 and a second cylindrical roller surface 473. The second inner roller surface 470 of the embodiment depicted in FIG. 60 also includes a frustoconical roller surface 472.

Figure 61:
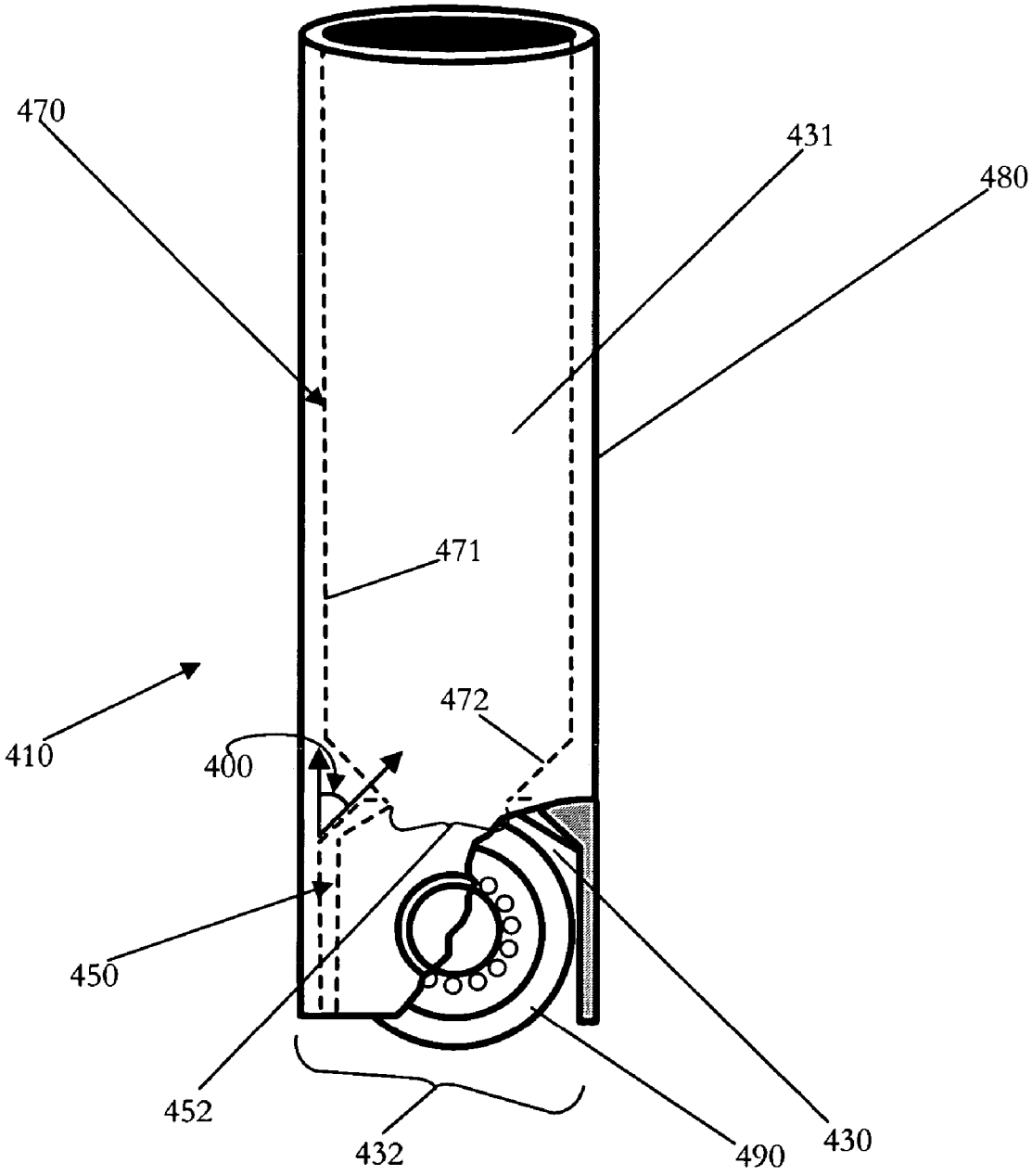
FIG. 61 depicts a fourth embodiment of a roller follower body.

In yet another alternative embodiment of the present invention, as depicted in FIG. 61, the first roller cavity 430 is provided with a first roller opening 432 shaped to accept a cylindrical insert and a first inner roller surface 450. The first inner roller surface 450 defines a transition roller opening 452 linking the first roller cavity 430 with a second roller cavity 431. The second roller cavity 431 is provided with a second inner roller surface 470 which includes a plurality of surfaces. As shown in FIG. 61, the second inner roller surface 470 includes a cylindrical roller surface 471 and a frustoconical roller surface 472.

Figure 62:
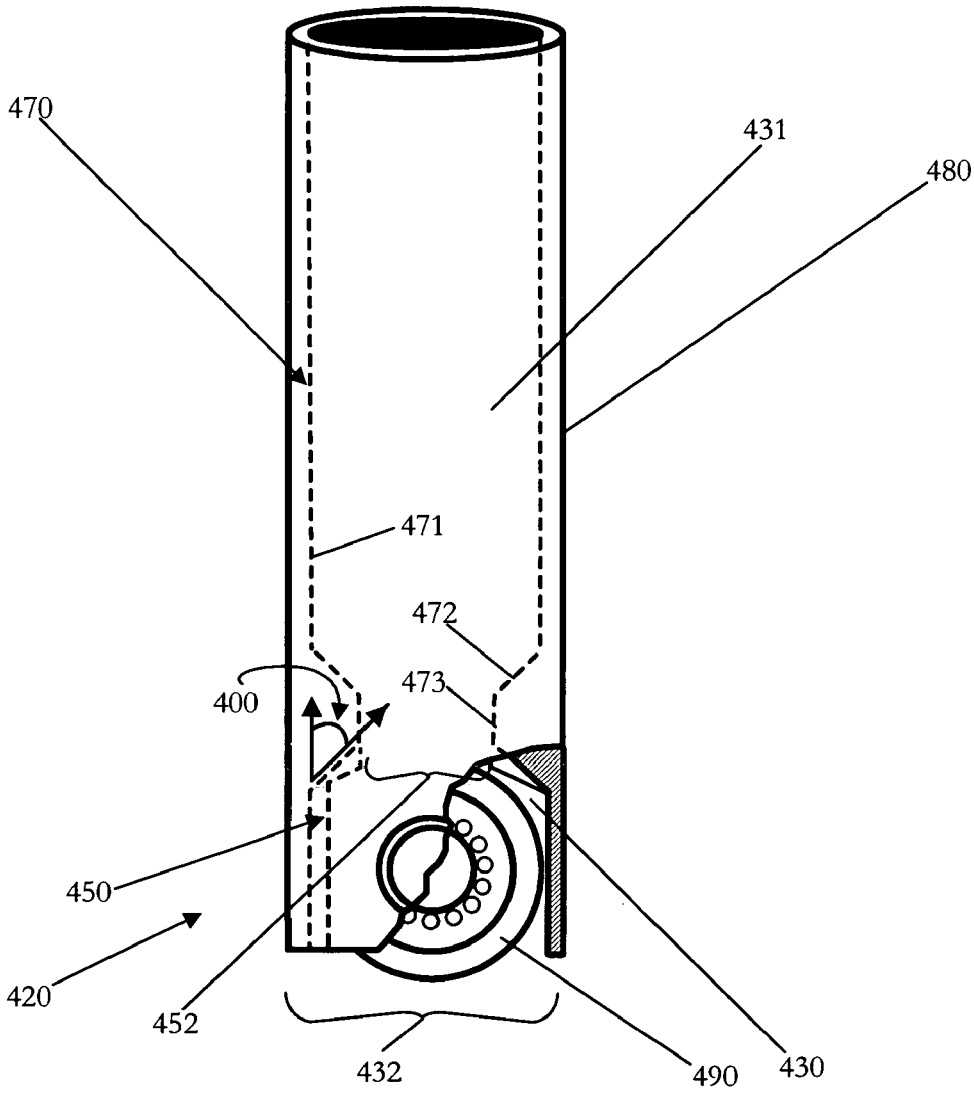
FIG. 62 depicts a fifth embodiment of a roller follower body.

Those skilled in the art will appreciate that the second inner roller surface 470 may include a plurality of cylindrical surfaces. FIG. 62 depicts a second inner roller surface 470 which includes a first cylindrical roller surface 471 adjacent to a frustoconical roller surface 472. Adjacent to the frustoconical roller surface 472 is a second cylindrical roller surface 473. The second cylindrical roller surface 473 depicted in FIG. 62 defines a transition roller opening 452 linking a second roller cavity 431 with a first roller cavity 430. The first roller cavity 430 is provided with a first inner roller surface 450 and a first roller opening 432 shaped to accept a cylindrical insert. The first inner roller surface 450 includes a plurality of curved surfaces, angled surfaces, walls, and angled walls.

Figure 63:
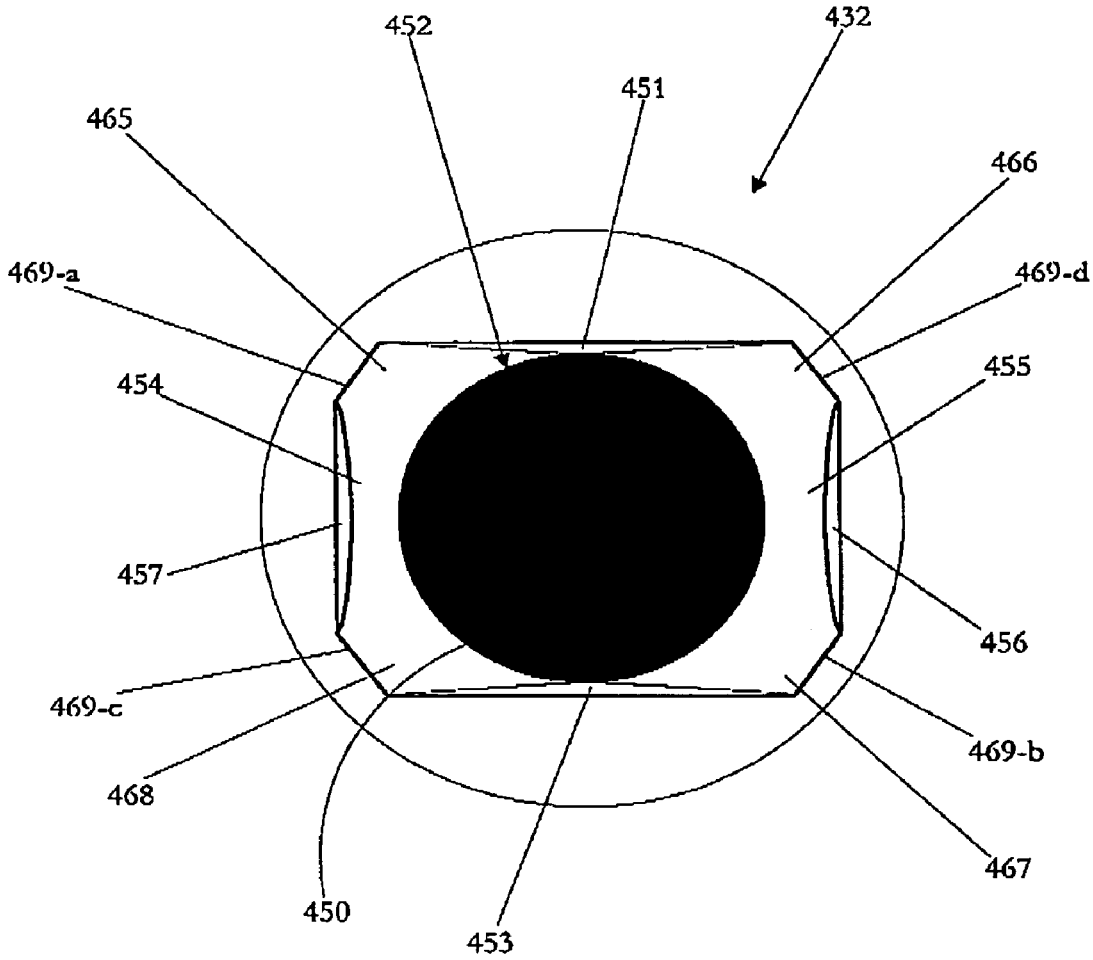
FIG. 63 depicts the top view of another preferred embodiment of a roller follower body.

FIG. 63 depicts a first inner roller surface 450 depicted in FIGS. 61 and 62. A first wall 451 is adjacent to the transition roller opening 452, a first angled roller surface 465, and a second angled roller surface 466. The first angled roller surface 465 is adjacent to the transition roller opening 452, a first roller curved surface 454, and a first angled wall 469-*a*. As depicted in FIGS. 61 and 62, the first angled roller surface 465 is configured to be at an angle 400 relative to the plane of a first angled wall 469-*a*, preferably between sixty-five and about ninety degrees.

The second angled roller surface 466 is adjacent to the transitional roller opening 452 and a fourth angled wall 469-*d*. As shown in FIG. 61 and 62, the second angled roller surface 466 is configured to be at an angle 400 relative to the plane of the fourth angled wall 469-*d*, preferably between sixty-five and about ninety degrees. The second angled roller surface 466 is adjacent to a second curved roller surface 455. The second curved roller surface 455 is adjacent to a third angled roller surface 467 and a third wall 456. The third angled roller surface 467 is adjacent to the transitional roller opening 452, a second wall 453, and a second angled 469-*b*. As depicted in FIGS. 61 & 62, the third angled roller surface 467 is configured to be at an angle 400 relative to the plane of the second angled wall 469-*b*, preferably between sixty-five and about ninety degrees.

The second wall 453 is adjacent to a fourth angled roller surface 468. The fourth angled roller surface 468 adjacent to the first curved roller surface 454, a third angled wall 469-*c*, and a fourth wall 457. As depicted in FIGS. 61 and 62, the fourth angled roller surface 468 is configured to be at an angle relative to the plane of the third angled wall 469-*c*, preferably between sixty-five and about ninety degrees. FIG. 61 and 62 depict cross-sectional views of embodiments with the first roller cavity 430 of FIG. 63.

Figure 64:
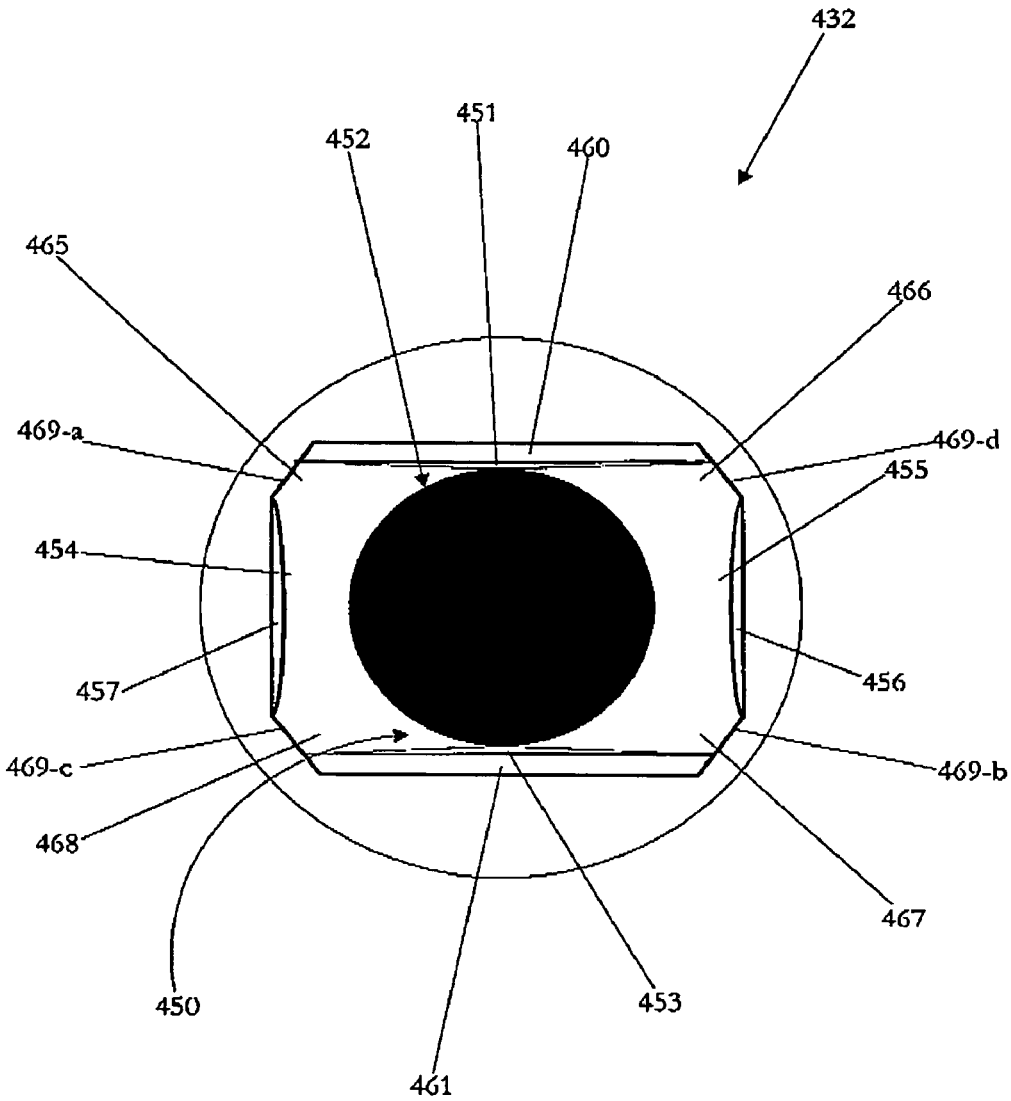
FIG. 64 depicts the top view of another preferred embodiment of a roller follower body.

Shown in FIG. 64 is an alternative embodiment of the first roller cavity 430 depicted in FIG. 63. In the embodiment depicted in FIG. 64, the first roller cavity 430 is provided with a chamfered roller opening 432 and a first inner roller surface 450. The chamfered roller opening 432 functions so that a cylindrical insert can be introduced to the roller follower body 410 with greater ease. The chamfered roller opening 432 accomplishes this function through roller chamfers 460, 461*a*, which are located on opposing sides of the chamfered roller opening 432. The roller chamfers 460, 461 of the embodiment shown in FIG. 64 are flat surfaces at an angle relative to the walls 451, 453 so that a cylindrical insert 490 can be introduced through the first roller opening 432 with greater ease. Those skilled in the art will appreciate that the roller chamfers 460, 461 can be fabricated in a number of different configurations; so long as the resulting configuration renders introduction of a cylindrical insert 490 through the first roller opening 432 with greater ease, it is a "chamfered toilet opening" within the spirit and scope of the present invention.

The second angled roller surface 466 is adjacent to the transitional roller opening 452 and a second angled roller wall 469-*b*. As shown in FIGS. 61 and 62, the second angled roller surface 466 is configured to be at an angle 400 relative to the plane of the second angled roller wall 469-*b*, preferably between sixty-five and about ninety degrees. The second angled roller surface 466 is adjacent to a second curved roller surface 455. The second curved roller surface 455 is adjacent to a third angled roller surface 467 and a second roller wall 456. The third angled roller surface 467 is adjacent to the transitional roller opening 452, a third roller wall 453, and a third angled roller wall 469-*c*. As depicted in FIGS. 61 & 62, the third angled roller surface 467 is configured to be at an angle 400 relative to the plane of the third angled roller wall 469-*c*, preferably between sixty-five and about ninety degrees.

The second flat roller surface 453 is adjacent to a fourth angled roller surface 468. The fourth angled roller surface 468 adjacent to the first curved roller surface 454, a fourth angled roller wall 469-*d*, and a fourth roller wall 457. As depicted in FIGS. 61 and 62, the fourth angled roller surface 468 is configured to be at an angle relative to the plane of the fourth angled roller wall 469-*d*, preferably between sixty-five and about ninety degrees. FIGS. 61 and 62 depict cross-sectional views of embodiments with the first roller cavity 430 of FIG. 63.

Shown in FIG. 64 is an alternative embodiment of the first roller cavity 430 depicted in FIG. 63. In the embodiment depicted in FIG. 64, the first roller cavity 430 is provided with a chamfered roller opening 432 and a first inner roller surface 450. The chamfered roller opening 432 functions so that a cylindrical insert can be introduced to the roller follower body 410 with greater ease. The chamfered roller opening 432 accomplishes this function through roller chamfers 460, 461 which are located on opposing sides of the chamfered roller opening 432. The roller chamfers 460, 461 of the embodiment shown in FIG. 64 are flat surfaces at an angle relative to the flat roller surfaces 451, 452 so that a cylindrical insert 490 can be introduced through the first roller opening 432 with greater ease. Those skilled in the art will appreciate that the roller chamfers 460, 461 can be fabricated in a number of different configurations; so long as the resulting configuration renders introduction of a cylindrical insert 490 through the first roller opening 432 with greater ease, it is a "chamfered roller opening" within the spirit and scope of the present invention.

The roller chamfers 460, 461 are preferably fabricated through forging via an extruding punch pin. Alternatively, the roller chamfers 460, 461 are machined by being ground before heat-treating. Those skilled in the art will appreciate that other methods of fabrication can be employed within the scope of the present invention.

Figure 65:
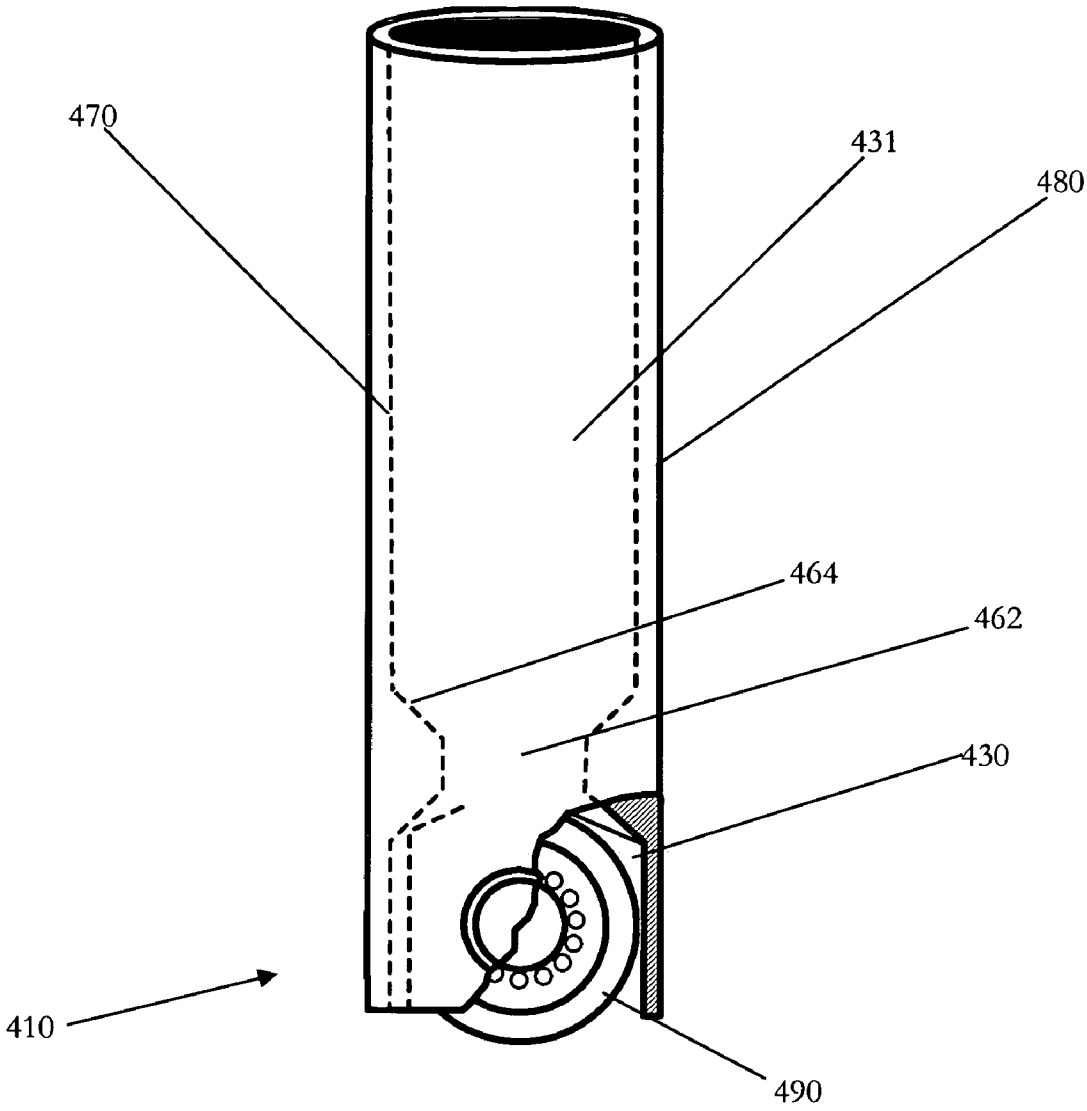
FIG. 65 depicts a sixth embodiment of a roller follower body.

FIG. 65 discloses the second toiler cavity 431 of yet another alternative embodiment of the present invention. As depicted in FIG. 65, the roller follower body 410 is provided with a second roller cavity 431 which includes a plurality of cylindrical and conical surfaces. The second roller cavity 431 depicted in FIG. 65 includes a second inner roller surface 470. The second inner roller surface 470 of the preferred embodiment is cylindrically shaped, concentric relative to the cylindrically shaped outer roller surface 480. The second inner roller surface 470 is provided with a transition or transitional tube 462. The transitional tube 462 is shaped to fluidly link the second roller cavity 431 with a first roller cavity 430. In the embodiment depicted in FIG. 65, the transitional tube 462 is cylindrically shaped at a diameter that is smaller than the diameter of the second inner toilet surface 470. The cylindrical shape of the transitional tube 462 is preferably concentric relative to the outer roller surface 480. The transitional tube 462 is preferably forged through use of an extruding die pin.

Alternatively, the transitional tube 462 is machined by boring the transitional tube 462 in a chucking machine. Alternatively, the transitional tube 462 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the transitional tube 462 is ground using an internal diameter grinding machine, such as a Heald grinding machine. Those skilled in the art will appreciate that the transitional tube 462 can be ground using other grinding machines.

Adjacent to the transitional tube 462, the embodiment depicted in FIG. 64 is provided with a conically-shaped roller lead surface 464 which can be fabricated through forging or machining. However, those skilled in the art will appreciate that the present invention can be fabricated without the roller lead surface 464

Figure 66:
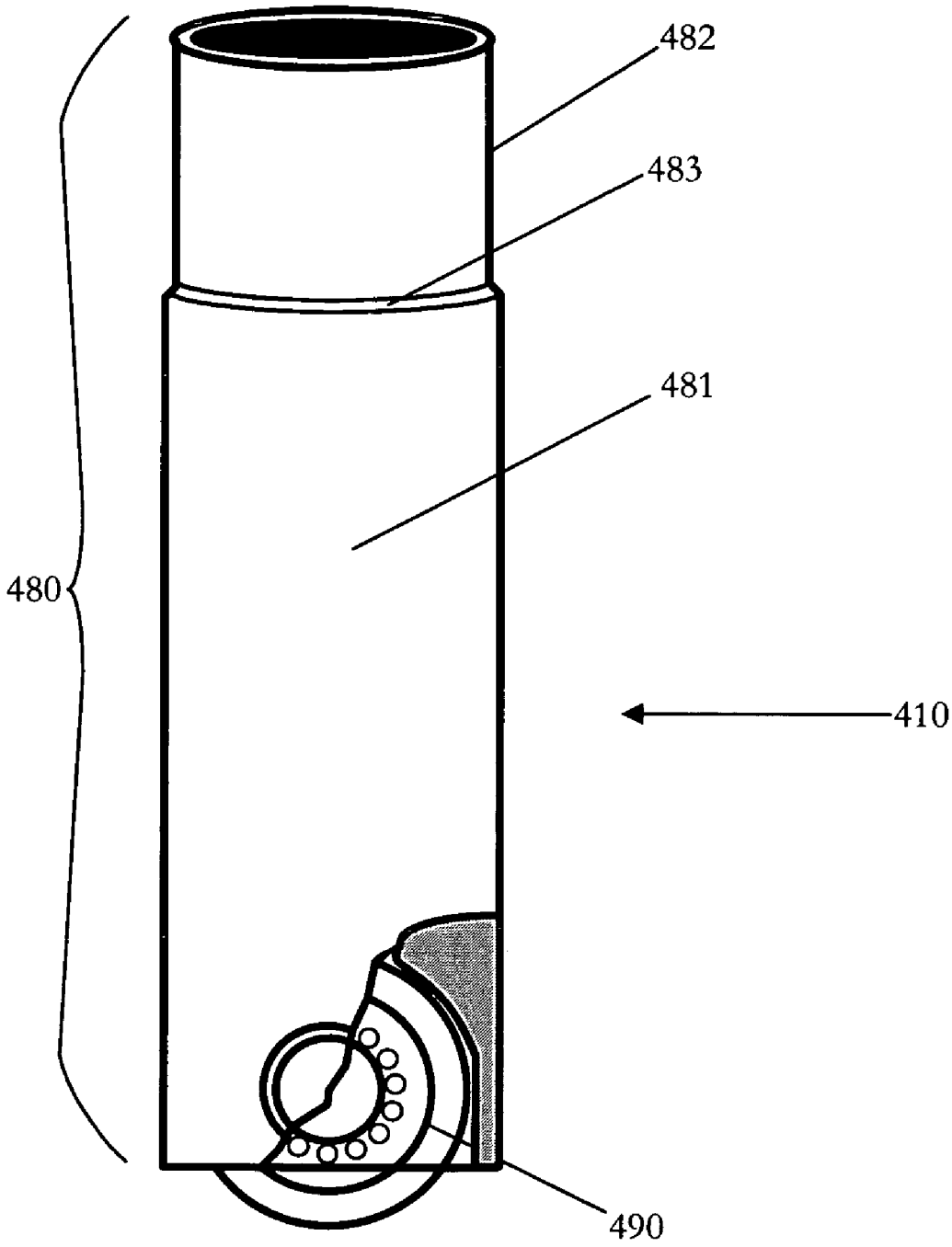
FIG. 66 depicts a seventh embodiment of a roller follower body.

Depicted in FIG. 66 is a roller follower body 410 of an alternative embodiment of the present invention. As shown in FIG. 66, the roller follower body 410 is provided with an outer roller surface 480. The outer roller surface 480 includes a plurality of surfaces. In the embodiment depicted in FIG. 66, the outer roller surface 480 includes a cylindrical roller surface 481, an undercut roller surface 482, and a conical roller surface 483. As depicted in FIG. 66, the undercut roller surface 482 extends from one end of the roller follower body 410 and is cylindrically shaped. The diameter of the undercut roller surface 482 is smaller than the diameter of the cylindrical roller surface 481.

The undercut roller surface 482 is preferably forged through use of an extruding die. Alternatively, the undercut roller surface 482 is fabricated through machining. Machining the undercut roller surface 482 is accomplished through use of an infeed centerless grinding machine, such as a Cincinnati grinder. The surface is first heat-treated and then the undercut roller surface 482 is ground via a grinding wheel. Those skilled in the art will appreciate that additional surfaces can be ground into the outer roller surface with minor alterations to the grinding wheel.

As depicted in FIG. 66, the conical roller surface 483 is located between the cylindrical roller surface 481 and the undercut roller surface 482. The conical roller surface 483 is preferably forged through use of an extruding die. Alternatively, the conical roller surface 483 is fabricated through machining. Those with skill in the art will appreciate that the outer roller surface 480 can be fabricated without the conical roller surface 483 so that the cylindrical surface 481 and the undercut roller surface 482 abut one another.

Figure 67:
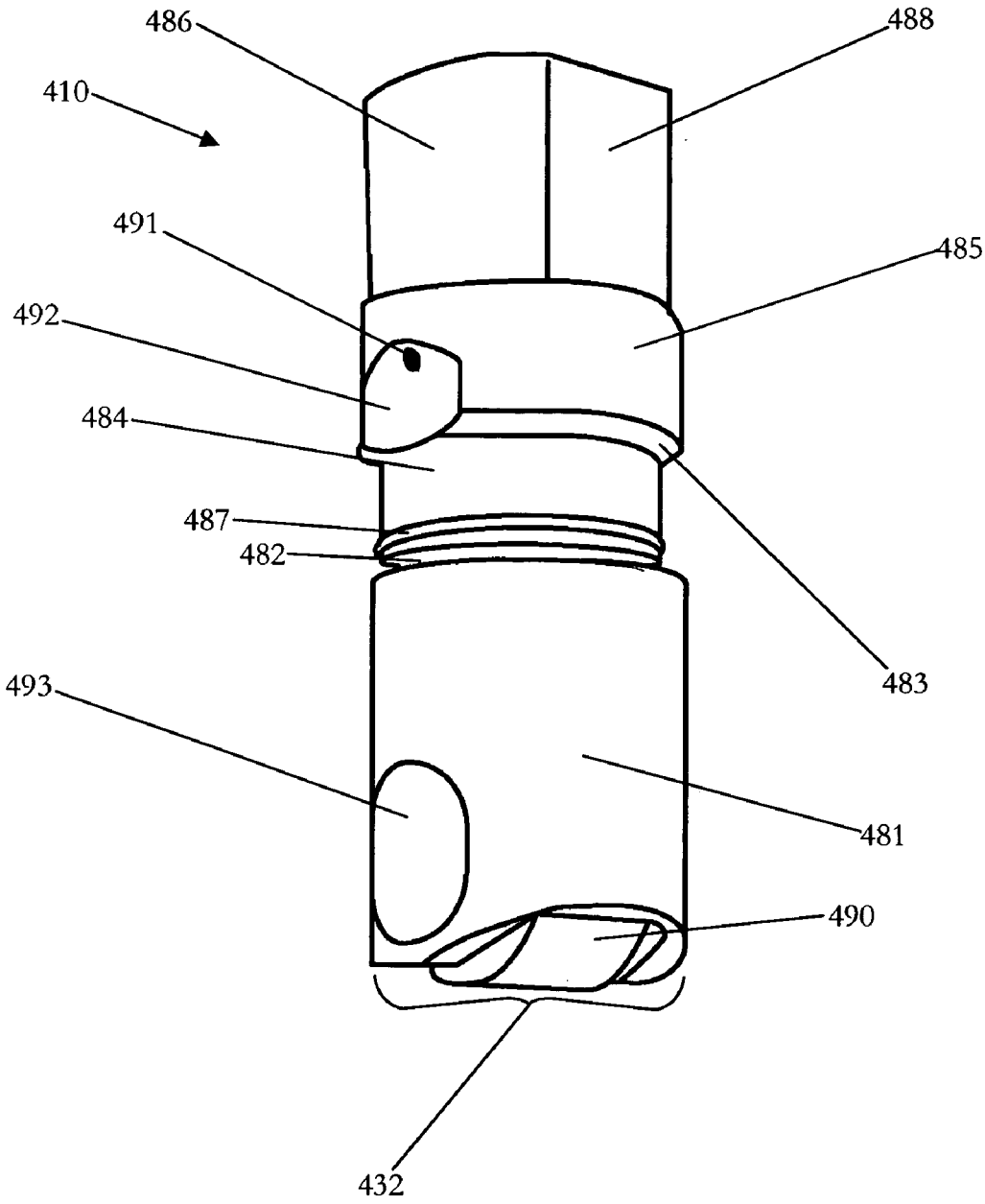
FIG. 67 depicts an eighth embodiment of a roller follower body.

FIG. 67 depicts a roller follower body 410 constituting another embodiment. In the embodiment depicted in FIG. 67, the outer roller surface 480 includes a plurality of surfaces. The outer roller surface 480 is provided with a first cylindrical roller surface 481. The first cylindrical roller surface 481 contains a first roller depression 493. Adjacent to the first cylindrical roller surface 481 is a second cylindrical roller surface 482. The second cylindrical roller surface 482 has a radius that is smaller than the radius of the first cylindrical roller surface 481. The second cylindrical roller surface 482 is adjacent to a third cylindrical roller surface 484. The third cylindrical roller surface 484 has a radius that is greater than the radius of the second cylindrical roller surface 482. The third cylindrical roller surface 484 contains a ridge 487. Adjacent to the third cylindrical roller surface 484 is a conical roller surface 483. The conical roller surface 483 is adjacent to a fourth cylindrical roller surface 485. The fourth cylindrical roller surface 485 and the conical roller surface 483 contain a second roller depression 492. The second roller depression 492 defines a roller hole 491. Adjacent to the fourth cylindrical roller surface 485 is a flat outer roller surface 488. The flat outer roller surface 488 is adjacent to a fifth cylindrical roller surface 486.

Those skilled in the art will appreciate that the features of the roller follower body 410 may be fabricated through a combination of machining, forging, and other methods of fabrication. By way of example and not limitation, the first roller cavity 430 can be machined while the second roller cavity 431 is forged. Conversely, the second roller cavity 431 can be machined while the first roller cavity 430 is forged.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A process for manufacturing a valve operating assembly, comprising the steps of:

a) cold forming, at least in part, a socket comprising the steps of:
   i) providing a first rod;
   ii) cold forming, at least in part, a first socket surface into the first rod so that the first socket surface includes a push rod cooperating surface;
   iii) cold forming, at least in part, a second socket surface into the first rod so that the second socket surface includes a protruding surface, a first flat surface, and a second flat surface, wherein the protruding surface is located between the first flat surface and the second flat surface;

b) cold forming, at least in part, a leakdown plunger, comprising the steps of:
   i) providing a second rod;
   ii) cold forming, at least in part, a first plunger opening into the second rod so that the first plunger opening is provided with an annular plunger surface that defines a plunger hole shaped to accommodate a generally spherical member;
   iii) cold forming, at least in part, a second plunger opening into the second rod;

c) cold forming, at least in part, a valve lifter body that is provided with a valve lifter axis, comprising the steps of:
   i) providing a third rod;
   ii) cold forming a first lifter cavity into the third rod so that the third rod is provided with a first inner lifter surface that includes a first wall, a second wall, a third wall, and a fourth wall that extend axially into the third rod with the fourth wall being located adjacent to a first curved surface, the third wall being located adjacent to a second curved surface, and the first and second curved surfaces are located adjacent to a lifter surface that is oriented to be generally orthogonal to the valve lifter axis of the valve lifter body; and
   iii) cold forming, at least in part, a second lifter cavity into the third rod so that the second lifter cavity is provided with a second inner lifter surface that includes a generally cylindrical surface.

2. The process for manufacturing a valve operating assembly according to claim 1, wherein the step of cold forming the first lifter cavity into the third rod further provides the first inner lifter surface with a first angled wall, a second angled wall, a third angled wall, and a fourth angled wall.

3. The process for manufacturing a valve operating assembly according to claim 2, wherein the first lifter cavity is cold formed into the third rod so that the first angled wall is located adjacent to a first angled surface, the fourth angled wall is located adjacent to a second angled surface, the second angled wall is located adjacent to a third angled surface, and the third angled wall is located adjacent to a fourth angled surface.

4. The process for manufacturing a valve operating assembly according to claim 3, wherein the first lifter cavity is cold formed into the third rod so that at least one of the angled surfaces is oriented to be at an angle, relative to a plane that is generally orthogonal to the valve lifter axis, measuring between 25 degrees and 75 degrees.

5. The process for manufacturing a valve operating assembly according to claim 4, further comprising the step of drilling the cold-formed valve lifter body to provide a transition linking the first lifter cavity and the second lifter cavity.

6. The process for manufacturing a valve operating assembly according to claim 5, further comprising the step of profiling the transition.

7. The process for manufacturing a valve operating assembly according to claim 5 further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

8. The process for manufacturing a valve operating assembly according to claim 6, further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

9. The process for manufacturing a valve operating assembly according to claim 4, further comprising the step of boring the cold-formed valve lifter body to provide a transition linking the first lifter cavity and the second lifter cavity.

10. The process for manufacturing a valve operating assembly according to claim 9 further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

11. The process for manufacturing a valve operating assembly according to claim 4, further comprising the step of grinding the cold-formed valve lifter body to provide a transition linking the first lifter cavity and the second lifter cavity.

12. The process for manufacturing a valve operating assembly according to claim 11, further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

13. The process for manufacturing a valve operating assembly according to claim 4, further comprising the steps of:

a) heat treating the valve lifter body after it has been cold formed; and b) machining the valve lifter body.

14. The process for manufacturing a valve operating assembly according to claim 13, further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

15. The process for manufacturing a valve operating assembly according to claim 4, further comprising the step of cold forming, at least in part, a lash adjuster body, including the steps of:

a) providing a fourth rod; and b) cold forming a lash adjuster cavity into the fourth rod so that the fourth rod is provided with an inner lash adjuster surface.

16. The process for manufacturing a valve operating assembly according to claim 1, further comprising the step of cold forming, at least in part, the second rod so that the second rod is provided with an inner plunger surface that includes an inner frusto-conical plunger surface located adjacent to the plunger hole.

17. A process for manufacturing a valve operating assembly, comprising the steps of:

a) cold forming, at least in part, a socket comprising the steps of:

i) providing a first rod;

ii) cold forming, at least in part, a first socket surface into the first rod so that the first socket surface includes a push rod cooperating surface;

iii) cold forming, at least in part, a second socket surface into the first rod so that the second socket surface includes a protruding surface, a first flat surface, and a second flat surface, wherein the protruding surface is located between the first flat surface and the second flat surface;

b) cold forming, at least in part, a leakdown plunger, comprising the steps of:

i) providing a second rod;

ii) cold forming, at least in part, a first plunger opening into the second rod so that the first plunger opening is provided with an annular plunger surface that defines a plunger hole shaped to accommodate a generally spherical member;

iii) cold forming, at least in part, a second plunger opening into the second rod;

c) cold forming, at least in part, a roller follower body that is provided with an axis comprising the steps of:

i) providing a third rod;

ii) cold forming a first roller cavity into the third rod so that the third rod is provided with a first roller opening and a first inner roller surface that includes a first wall, a second wall, a third wall, and a fourth wall that extend from the first roller opening into the third rod with the fourth wall being located adjacent to a first curved surface, the third wall being located adjacent to a second curved surface;

iii) cold forming, at least in part, a second roller cavity into the third rod so that the second roller cavity is provided with a second roller opening and a second inner roller surface that includes a generally cylindrical surface;

iv) fabricating a transition that links the first and second roller cavities so that the first and second curved surfaces are located adjacent to the transition;

d) cold forming, at least in part, a lash adjuster body for insertion into the second roller cavity of the roller follower body, including the steps of:

i) providing a fourth rod; and ii) cold forming, at least in part, a lash adjuster cavity into the fourth rod so that the fourth rod is provided with an inner lash adjuster surface.

18. The process for manufacturing a valve operating assembly according to claim 17, further comprising the steps of:

a) heat treating the lash adjuster body after it has been cold formed; and b) machining, at least in part, an annular lash adjuster surface into the inner lash adjuster surface so that a cylindrical lash adjuster surface terminates at the annular lash adjuster surface.

19. The process for manufacturing a valve operating assembly according to claim 17 wherein the step of cold forming the first roller cavity into the third rod further provides the first inner roller surface with a first angled wall, a second angled wall, a third angled wall, and a fourth angled wall that extend from the first roller opening.

20. The process for manufacturing a valve operating assembly according to claim 19 wherein the first lifter cavity is cold formed into the third rod so that the first angled wall terminates at least in part at a first angled surface, the fourth angled wall terminates at least in part at a second angled surface, the second angled wall terminates at least in part at a third angled surface, and the third angled wall terminates at least in part at a fourth angled surface.

21. The process for manufacturing a valve operating assembly according to claim 20 wherein the first roller cavity is cold formed into the third rod so that at least one of the angled surfaces is oriented to be at an angle relative to a plane of at least one of the angled walls, the angle measuring between 65 degrees and 75 degrees.

22. The process for manufacturing a valve operating assembly according to claim 17, wherein the transition is fabricated through drilling the cold formed roller follower body.

23. The process for manufacturing a valve operating assembly according to claim 22, further comprising the step of profiling the transition.

24. The process for manufacturing a valve operating assembly according to claim 17, wherein the transition is fabricated through boring the cold formed roller follower body.

25. The process for manufacturing a valve operating assembly according to claim 17, wherein the transition is fabricated through grinding the cold formed roller follower body.

26. The process for manufacturing a valve operating assembly according to claim 17, further comprising the step of cold forming the second rod so that the second rod is provided with an inner plunger surface that includes an inner frusto-conical plunger surface located adjacent to the plunger hole.

27. A process for manufacturing a valve operating assembly, comprising the steps of:

a) cold forming, at least in part, a socket comprising the steps of:

i) providing a first rod;

ii) cold forming, at least in part, a first socket surface into the first rod so that the first socket surface includes a push rod cooperating surface;

iii) cold forming, at least in part, a second socket surface into the first rod so that the second socket surface includes a protruding surface, a first flat surface, and a second flat surface, wherein the protruding surface is located between the first flat surface and the second flat surface;

b) cold forming, at least in part, a leakdown plunger, comprising the steps of:

i) providing a second rod;

ii) cold forming, at least in part, a first plunger opening into the second rod so that the first plunger opening is provided with an annular plunger surface that defines a plunger hole shaped to accommodate a generally spherical member;

iii) cold forming a second plunger opening into the second rod;

c) cold forming, at least in part, a valve lifter body that is provided with a valve lifter axis, comprising the steps of:

i) providing a third rod;

ii) cold forming a first lifter cavity into the third rod so that the third rod is provided with a first lifter opening and a first wall, a second wall, a third wall, a fourth wall, a first angled wall, a second angled wall, a third angled wall, and a fourth angled wall that extend from the first lifter opening into the third rod with the fourth wall being located adjacent to a first curved surface, the third wall being located adjacent to a second curved surface; and iii) cold forming, at least in part, a second lifter cavity into the third rod so that the second lifter cavity is provided with a second inner lifter surface that includes a generally cylindrical surface.

28. The process for manufacturing a valve operating assembly according to claim 27, further comprising the steps of squaring off the first rod, the second rod, and the third rod.

29. The process for manufacturing a valve operating assembly according to claim 27, further comprising the step of piercing the second rod to provide the plunger hole.

30. The process for manufacturing a valve operating assembly according to claim 27, further comprising the step of cold forming, at least in part, the annular plunger surface so that the annular plunger surface is located adjacent to a round plunger surface that defines the plunger hole.

31. The process for manufacturing a valve operating assembly according to claim 27, further comprising the step of cold forming an inner frusto-conical plunger surface so that the inner frusto-conical plunger surface is located within the inner plunger surface adjacent to the plunger hole.

32. The process for manufacturing a valve operating assembly according to claim 27, further comprising the step of cold forming an inner frusto-conical plunger surface so that the inner frusto-conical plunger surface is located within the inner plunger surface adjacent to the plunger hole and a cylindrical surface.

33. The process for manufacturing a valve operating assembly according to claim 27, further comprising the step of cold forming the second plunger opening into the second rod so that the second plunger opening is provided with an annular surface.

* * * * *